US011834785B2

(12) United States Patent
Laleg et al.

(10) Patent No.: US 11,834,785 B2
(45) Date of Patent: Dec. 5, 2023

(54) METHOD OF TRANSFORMING HIGH CONSISTENCY PULP FIBERS INTO PRE-DISPERSED SEMI-DRY AND DRY FIBROUS MATERIALS

(71) Applicant: FPInnovations, Pointe-Claire (CA)

(72) Inventors: Makhlouf Laleg, Pointe-Claire (CA); Lahoucine Ettaleb, Pointe-Claire (CA); Michael Stacey, Howick (CA)

(73) Assignee: FPInnovations, Pointe-Claire (CA)

( * ) Notice: Subject to any disclaimer, the term of this patent is extended or adjusted under 35 U.S.C. 154(b) by 817 days.

(21) Appl. No.: 16/332,386

(22) PCT Filed: Sep. 14, 2017

(86) PCT No.: PCT/CA2017/051079
§ 371 (c)(1),
(2) Date: Mar. 12, 2019

(87) PCT Pub. No.: WO2018/049522
PCT Pub. Date: Mar. 22, 2018

(65) Prior Publication Data

US 2021/0285156 A1 Sep. 16, 2021

Related U.S. Application Data

(60) Provisional application No. 62/394,456, filed on Sep. 14, 2016.

(51) Int. Cl.
*D21D 1/30* (2006.01)
*D21D 1/00* (2006.01)
(Continued)

(52) U.S. Cl.
CPC ..... *D21D 1/30* (2013.01); *D21C 3/003* (2013.01); *D21C 3/12* (2013.01); *D21C 3/24* (2013.01);
(Continued)

(58) Field of Classification Search
CPC ..... D21D 1/30; D21C 9/004; D21C 9/005; D21C 9/007
See application file for complete search history.

(56) References Cited

U.S. PATENT DOCUMENTS 3,992,249 A * 11/1976 Farley ..... D21C 9/086 162/72
2001/0040015 A1* 11/2001 Lee ..... D21C 9/007 162/9
2004/0069427 A1 4/2004 Xu

FOREIGN PATENT DOCUMENTS

CA 2144433 4/1994
CA 2824191 7/2012

OTHER PUBLICATIONS

Christenesen, P.K; Giertz, H.W.; "The Cellulose/Water Relationship" Consolidation of the Paper Web, p. 59-84(1966).
(Continued)

*Primary Examiner* — Anthony Calandra
(74) *Attorney, Agent, or Firm* — NORTON ROSE FULBRIGHT CANADA LLP

(57) ABSTRACT

The present invention is directed to a method of transforming a pulp fibrous into a pre-dispersed semi-dry or dry fibrous material and to the material produced. The method opens, de-entangles and fibrillates the fibrous material of the input pulp. The method mixes the input fibrous with chemicals while evaporating moisture in an updated mechanical disc refiner process. The refiner operates to set three process variables: 1) applied refining specific energy; 2) refiner gap opening and 3) refiner output consistency. Depending on the feed pulp type and consistency, the refiner's output is a pre-dispersed semi-dry fibrous material of 30 to 99% solids with 70 to 100% of separated fibers that depending on chemical treatment are loosely entangled fibrous that disperse in water using common techniques. The pre-dispersed
(Continued)

semi-dry output may be further processed inline or by batch process air agitation at velocities sufficient to further separate fibers and loosen fibrous entanglements.

20 Claims, 22 Drawing Sheets

(51) Int. Cl.

| | |
|---|---|
| ***D21C 3/00*** | (2006.01) |
| ***D21C 3/12*** | (2006.01) |
| ***D21C 3/24*** | (2006.01) |
| ***D21H 27/00*** | (2006.01) |

(52) U.S. Cl.
CPC ..... *D21D 1/004* (2013.01); *D21D 1/006* (2013.01); *D21H 27/002* (2013.01)

(56) References Cited

OTHER PUBLICATIONS

Beath, Neill and Masse (F.A. Pulp Paper Mag. Can. 67(10) T423-T430 (1966)).
Jones (Pulp, Paper Mag. Can. 67(6) T283-T291 (1963)).
Karnis (Latency in mechanical pulp fibres, Paperi ia Puu 75, No. 7 (1993): 505-509).
Miles ("Refining Intensity and Pulp Quality in High-Consistency Refining", Paperi ja Puu 72(5):508 (1990).
Piotr Przybysz, Marcin Dubowik, Marta Anna Kucner, Kazimierz Przybysz, Kamila Przybysz Buzała ("Contribution of Hydrogen Bonds to Paper Strength Properties", PLOS One. May 26, 2016;11(5):e0155809. doi: 10.1371/journal.pone.0155809. eCollection 2016).

* cited by examiner

METHOD OF TRANSFORMING HIGH CONSISTENCY PULP FIBERS INTO PRE-DISPERSED SEMI-DRY AND DRY FIBROUS MATERIALS

CROSS-REFERENCE TO RELATED APPLICATIONS

The present application is a U.S. National Phase of International Application No. PCT/CA2017/051079, filed on Sep. 14, 2017, and claiming priority from U.S. Provisional Application No. 62/394,456 filed Sep. 14, 2016, the content of which is hereby incorporated by reference in its entirety.

BACKGROUND

Field

The present specification relates to a method that allow transforming high consistency pulp fibers into dispersible pulp fibrous materials of pre-dispersed semi-dry and dry forms and having desirable properties for efficient uses in wet, semi-dry, dry, aqueous and non-aqueous systems or compositions.

Description of the Prior Art

Mechanical, thermomechanical, semi-chemi-thermomechanical or fully chemical methods are commonly used to transform wood chips and many bast and leaf fibers into defibered fibrous of different physical properties intended for various applications. A piece of wood chip is composed of aggregates of many fibers, which in turn are constructed of several layers of elementary fibrils of cellulose bound together and surrounded by hemicelluloses and outer lignin lamellas [A. P. Shchniewind in Concise Encyclopedia of Wood & Wood-Based Materials, Pergamon, Oxford, p. 63 (1989)]. In the ultrastructure of native celluloses the basic elementary fibrils have dimensions of 2-4 nm in cross-section and 100 nm in length. These elementary fibrils are randomly aggregated into microfibrils of 10-30 nm width, themselves grouped into macrofibrils 100-400 nm wide, which are structured in different cell wall layers. Hydrogen bonding occurring between the oxygen atoms of hydroxyl groups of different molecules or elementary fibrils is the basis of the supramolecular structure of cellulose fibers. The hemicelluloses and traces of lignin are involved in the microfibrillar assembly at the periphery of the cellulose well-ordered chains. The average dimensions of fibers in wood are 0.5 mm<length <5 mm and 10 μm<width <45 μm giving an average aspect ratio of about 50 to 110. In general, hardwood fibers (aspen, birch, maple, eucalyptus) are much shorter, thinner and stiffer, while softwood fibers (spruce, fir, pine) are long, thick and more flexible. The wood fibers are shorter to many natural fibers of plants and seeds.

The wood fiber commonly used in the manufacture of fiber board products, such as MDF (medium density fiberboard) and other wood fiber board products are considered as the cheapest grade of mechanical fibers. They are manufactured from moistened wood chips on pressurized high consistency disc refiners (HCR). Because of the low energy applied they are not fully fiberized to individual fibers and thus are stiff bundles that do not self-bond well if dried out from the water slurry to products. Therefore, they can easily be produced in separated or dispersed dry fiber bundles. In the manufacturing of MDF board products the pressurized high consistency moving fiber bundles are generally blasted with a solution of thermosetting resins, such as urea formaldehyde, at the refiner's exit blow line followed by mild tube or flash drying to remove a high level of moisture without premature crosslinking of resin. The resin-impregnated wood fibers are then formed into nonwoven thick mats followed by high pressing at elevated temperature (up to 260° C.) to form the final MDF boards. International Applications WO2006/001717 and WO2011/002314 teach how to use the MDF blow line system to apply solutions comprising a thermoset resin, a thermoplastic polymer, monomer, or oligomer on moving wood fibers carried by air or steam. The dry consolidated material is turned into diced pellets for subsequent applications in thermoplastic composites. Dry plant fibers and thermomechanical wood fibers have been successfully used to manufacture wood polymer composites, thermoplastic composites or thermoset composites, and for improved processing, uniformity and reinforcement performance, they require good dispersion, compatibility and adhesion or reaction with the polymers or resins. For example, US Patent application 20090314442 and U.S. Pat. Nos. 3,943,079 and 4,414,267 as well as the many references listed in them described methods to improve the strength of thermoplastic composites filled with lignocellulose fibers.

Unlike thermomechanical and semi-chemi-thermomechanical wood pulp fibers (TMP, CTMP), the more advanced cellulose fibers including kraft fibers, sulfite fibers and market fluff fibers are stripped of their lignin during the chemical pulping and bleaching processes, have intact fiber fractions and generally contain less than 8% fibrous fines. These wood-based fibrous, in bleached, semi-bleached or non-bleached forms, are the largest source of sustainable fibers for manufacturing printing paper, paperboard, paper tissue and towel, sac and bag paper, specialty paper, fiber molded or thermoformed fiber products, and cement and gypsum products. They are also used in water-dispersed or dry individualized forms for making nonwoven mats desirable for filtration and absorbent applications. When slurries of these fibers are flash dried to flakes or formed to paper sheets they can be easily dispersed again in water to individualized fibers using well known papermaking pulping equipment. The content of hemicelluloses in these pulp fibers is key criterion to make well bonded paper sheets and also the main cause of difficulty to produce them in dry individualized fibers.

Mechanical and chemical pulp fibers in dry roll, sheet or bale forms are commonly separated or individualized using dry defibration or disintegration devices. U.S. Pat. No. 4,252,279 describes the different defibration or disintegration devices intended to transform pulp fibers in form of sheets or bales into individualized fibers for making nonwoven mats useful for sanitary napkins or disposable diapers or other applications. For example, the sheet or roll are cut to specific dimensions prior to processing on hammer mill fluffers, whereas the defibration devices manufactured by the Swedish company MoDo Mekan AB works with baled pulp and the Kamas B-fluffer device manufactured by the Swedish company Kamas Industri AB makes fluff from mechanical flake dried pulp in blocks. The fluffed fibres can then be fed into an air stream and from there to a moving belt or perforated drum, where they form a randomly oriented air led web (a nonwoven structure).

The fluffed fibers made by these devices always contain some levels of aggregates or knots of fibers, sometimes referred to as nits or nodules. They are fiber clumps that remain as undesirable by-products after the defibration process and can easily be observed by eyes and under optical microscope. For improved absorbency in diapers the fluffed fibers need to be highly individualized and contain as little as possible of knots and fines, have good affinity to absorb water and preferably the fibres are in crosslinked, twisted and/or curled forms. Several other published patents have described methods for producing fluff fibers for increasing ease of liquid acquisition, rate of absorbency, strength and resilience of the liquid saturated fiber network of fibrous mat (U.S. Pat. Nos. 6,910,285 B2, 4,252,279 A, 8,845,757 B2). For example, Canadian Patent No. 993618 (Estes, 1976) describes a process for producing a low density fluff pad from individual fibers that have significant kink and interlocking to provide improved strength and higher bulk of pad. In accordance with the process of Estes patent, wet pulp is separated into individual fibers during the drying stage. The process uses fluid jet drying equipment that employs air-jets or steam-jets for separating the fibers. The fibers are laid on a perforated screen upon exiting from the jet drier. The fibers produced by the process of the Estes patent have high knot content.

Hartler and Teder (Paper Technology 4 (4): T129, 1963) showed many years ago that mechanical shredding and fluffing to small pieces or flakes of pulp pre-dewatered on twin roll press (TRP) are quite important for efficient flash drying. They found that in order to dry the pulp rapidly the pieces are of high surface area, because a pulp that was well fluffed to smaller pieces showed the lowest heat consumption in a flash dryer. This is a common practice used today for enhancing flash drying market pulps, namely semi-bleached and bleached chemi-thermomechanical (BCTMP) or some bleached hardwood kraft pulp (BHWK), by ensuring the best possible heat transmission between the hot drying air and the moist pulp pieces. The flash dried market pulps are supplied at dryness of 80 to 90% solids and are easily dispersible in water to singular fibers for making papers. The technique of pre-shredding and fluffling of high consistency pulp followed by flash drying as described by Hartler and Teder is not designed to handle high consistency bleached softwood kraft fibers (BSWK). It is known in the art of market pulp manufacture that drying moist chemical pulp fibers by flash drying will cause fibrous hornification and loss in bonding ability during papermaking [Paper Technology and Industry, Vol 26(1), 1985].

Highly refined cellulose fibers produced in disc refiners, such as the highly hydrated cellulose fibers, externally fibrillated cellulose fibers and cellulose nanofilaments, have been disclosed in many patents as useful fibrous materials for making thin sheets or specialty papers (namely glassine and grease proof sheets, labels, micro filters), for the reinforcement of printing papers, highly filled papers and paperboard products, cement and gypsum products, and for achieving some barrier properties. Today, to our knowledge fibrillated fibers mechanically processed from wood or plant fibers, namely the externally fibrillated fiber, microfibrilated cellulose and the cellulose nanofilaments made by the mechanical refining methods of patent CA2824191 A1, are not industrially available as pre-dispersed semi-dry or dry materials that can be easily dispersible in water or in non-aqueous mediums or compositions. Furthermore, if they become available then they need to be substantially free of knots and for continuous industrial applications they must be made easy to handle, feed and accurately dose to the application compositions. It may not be the case for stiff fiber bundles used to make MDF board products or the low strength hardwood pulp fibers, which do not have the ability to entangle and self-bond well on drying, or the high freeness softwood market pulps or fluff pulps, where their dry thick sheets are made with the purpose to be mechanically dispersed to individualized fibers then air-laid to non-woven mates. We found that common defibration or disintegration devices, such those described in U.S. Pat. No. 4,252,279, are not suitable for separating semi-dry and dry pulps or sheets of highly refined fibers to individualized fibrous material. They are not designed to impart fluff pulp with some desirable physical properties, such as higher curl or twist. Furthermore, they also are not designed for mixing fibers with chemicals or blending them with other additives or fibrous materials or functional additives while also simultaneously evaporating moisture.

The high consistency, high energy disc refining technique (HCR), is the oldest method used to successfully make highly fibrillated softwood thermomechanical pulp (TMP) fibers well suited for manufacturing dense and strong paper sheets, namely super calendared grades. High consistency here refers to a discharge consistency that is generally higher than 20% and it depends on the type and size of the refiner employed. Small double disc refiners operate in the lower range of high consistency while in large modern refiners the discharge consistency can exceed 60%. The high consistency refining stage of TMP is always rapidly followed by dilution with hot water in a latency chest to remove latency by straightening fibers for making more uniform and strong paper. The high consistency disc refining technique has also been shown over 40 years ago as an efficient means to make strong paper, such as sack kraft papers, by creating external and internal fibrillation of the softwood kraft fibers (U.S. Pat. Nos. 3,382,140, 3,445,329). Because of the high transfer of stresses between fibers in HCR some micro compressions are imparted and thus curled and kinked fibers are created. Making papers from such fibers would result in poor formation, high bulk, high porosity and low tensile strength properties. For making sac paper with high tensile energy absorption the HCR stage must thus be directly followed inline by a low consistency refiner stage as a mean to disperse and straighten the fibers and thus improve formation, density and strength of sheet. Well dispersed and straightened externally fibrillated fibers have a great tendency to bond to one another in paper due to their high surface area and increased flexibility. Exposed fibrils on straightened fibers are believed to be the reason of the imparted high tensile properties of paper.

Two major issues associated with high consistency disc refiners, especially when employed at high energy levels, such for making externally fibrillated fibers (U.S. Pat. Nos. 3,382,140, 3,445,329) or cellulose nanofilaments (CA2824191 A), are entanglement of fibrous or knots and hornification of cellulose. The moist pulp is highly compressed in the tight gap between the plates of refiner and because a considerable amount of energy expended on the pulp fibers during their motions they tend to entangle into knots of different sizes. A dehydration effect of fiber, that causes hornification, can also simultaneously takes place due to increased heat, especially if water molecules become less available for bonding to hydroxyl groups of fibers. Further, pulp fiber dehydration in refiner is function of pulp consistency and temperature and these will increase when residence time in refiner increases (i.e., several number of passes on refiner). High consistency refining of softwood kraft fibers at high energy levels have been identified as a new type of fiber and called "frayed fibers" (Yuhe Chen and Mousa M. Nazhad: Journal of Engineered Fibers and Fabrics Volume 5, Issue 3-2010). The "frayed fibers" are composed of highly concentrated fibrous masses or knots in pulp that can be very difficult to disperse in water using normal disintegration techniques, especially if pulp is stored for long periods of time or dried, even at room temperature. Furthermore, the external fibrils do not remain projected on fiber surfaces after ageing and drying. A hot condition of the high consistency pulp after its production on HCR, such as in a stored container or a flash dryer, will thus always accelerates hornification. This will result in dramatic changes in fiber properties, such as poor re-dispersion in water, poor bonding, and the potential formation of permanent knots and curls. Fibrous knots and hornification created in HCR can interfere with the reinforcement potential of fibrillated fibers in papermaking or in non-water based applications.

Hornification is a measure of the reduced capacity of fiber to absorb water (to hydrate) expressed as the water retention value (WRV) [Tappi test method: UM 256]. Cellulose hornification is mainly caused by the reduced fiber swelling in water at normal pH due to the formation of a large number of hydrogen bonds between the hydroxyl groups of adjacent fibrils of fibers and closure of fibrous voids [Paperi Ja Puu, 90 (2): 110-115 (1998)]. Practically, the fibrous voids are interfaces, pores and channels ranging from 1 nm to 5 nm widths. This void system determines the internal active surface and plays an important role in the swelling properties of the fibers. It was described that the cross-sectional area of single fiber decreases on drying from the swollen to the dry state by about 20% and the length or axial shrinkage is in the order of only a few percent [Paper products physics and technology, Monica Ek, et al., Eds. de Gruyter, 2009, page 79]. Previous studies have demonstrated that dried-down fibrils became unavailable for fiber bonding during subsequent papermaking processes using recycled fiber or dried market pulp (Paper Technology and Industry February 1985, Vol. 26, No. 1, p 38-41.)

Therefore, it is very important that freshly made high consistency, refined cellulose fibrous not be allowed to age or dry out, even at room temperature. This is because dehydration will turn the fibrous into high density clumpy solid materials where re-dispersion into aqueous slurry becomes very difficult even at high shear mixing and their reinforcement potential for paper, tissue or board products can be highly diminished. GB1185402 patent discloses a method to avoid strength loss on storing (or ageing) high consistency softwood kraft fiber processed on a disc refiner by rapidly mixing in fresh water the discharged pulp before the raised fibrils fall down or stick onto the fibers and form an aggregated clumpy material. Accordingly, the rapidly diluted pulp subsequently thickened and stored before further processing to paper has no significant loss in strength. The method of GB patent would not be practical for those high energy fibrous materials made by the method of CA2824191 A due to the eventual very poor dewatering on thickening operation. Furthermore, even if dewatering of fibrillated cellulose is improved any formed high solids content pulp or web will still be very difficult to separate into semi-dry or dry individual fibers.

Three important industrial requirements for efficient use of any fibers or their fibrillated fibers, whether in aqueous, non-aqueous or hydrophobic compositions, are good compatibility, dispersion, bonding, and interaction with components of the compositions. Completely dispersed fibers, in slurry, semi-dry or dry forms, will occur when all fibers and their attached or free fibrils are separated completely from their closest neighbor's fibrous and the final material is free of entanglements or knots. While the fibrous materials are dispersible in water and in water-based polymers or aqueous compositions, so far their applications in hydrophobic mediums have been difficult due primarily to their poor dispersion and compatibility. Because of these issues if combined with the hydrophobic thermoplastic polymers or thermoset resins they can eventually lead to aggregation and phase separation in the composite products. Such aggregation will have detrimental impact resulting in undesirable effects on the strength properties of composites as aggregates act as stress concentrators. These issues have been the major obstacles for the integration of lignocellulose fibers and their fibrillated fibers in many industry sectors. In the next paragraphs we will know issues or limitations to produce dispersed and dispersible fibrous materials in semi-dry and dry forms.

The above information specifies that any moist or slurry pulp fibers, especially a high consistency fibrillated softwood fiber, that can form strong interfibrous bond when stored at high consistency or dried into pulp flakes or sheets, will be difficult to mechanically separate into individual semi-dry or dry fibrillated fibers, such as using the defibration or disintegration devices discussed earlier. If fibrillated fibrous materials could be produced and supplied in pre-dispersed semi-dry or dry forms and chemically tailored to be dispersible and compatible with aqueous, non-aqueous and hydrophobic compositions, then they would have many added-value applications in different industry sectors. For example, they could be a cost-competitive substitution to the individualized short cut synthetic fibers and their fibrillated fibers commonly used in cement, nonwoven mate and polymer composites and many more applications. Examples of short cut synthetic fibers, available in different length & width and forms desirable for different industry sectors, comprise all those from organic polymers, from regenerated cellulose and the glass fibers. The organic synthetic fibers or filaments can be acrylic or polyacrylonitrile, aramid, carbon, polyvinyl alcohol, polyamide, polyester, polyethylene, and the most common nylon and polypropylene. Some of these synthetic fibers made in fibrillated forms, are several times more expensive than fibrillated wood fibers. These fibrillated forms of synthetic fibers are fibrillary structure or network that finds excellent opportunity for making microfiber sheet or used for the reinforcement of nonwoven fiber matt, cement or composite matrix. Fibrillated polypropylene fibers are generally used for temperature-shrinkage reinforcement and impact resistance.

The synthetic fibers and their fibrillated fibers have poor affinity to self-bond when dried-out from water slurries and thus can be dispersed to individual fibrous, either in slurry, semi-dry or dry forms provided that the aspect ratio of their fibers or fibrils is at levels where formation of fibrous entanglements and knots is minimal. Therefore, if the fibrillated natural fibers could be supplied in pre-dispersed semi-dry or dry forms, easily dispersible in aqueous compositions and without loss of their original reinforcement potential, then they could be great advanced fibrous source for optimizing strength of many paper and paperboard sheets, strength of bulky tissue and towel sheets, strength and porosity of wet-laid nonwoven products, such as absorbent and filtration mats and wipe sheets, reinforcing cement and gypsum products or integrated to low strength market pulps as means of boosting strength and optimizing porosity. Dispersible dry fibers and their fibrillated fibers made compatible with hydrophobic compositions and simple to meter could be used as reinforcement fibrous in thermoplastic polymers (polypropylene, polyethylene, polylactic acid, polystyrene, polyvinyl chloride and many biodegradable thermoplastics) or for making thermoset composites, such as sheet molding compound (SMC) and bulk molding compound (BMC), as well as many fiber-reinforced composite products.

One advantage of natural fibers against organic synthetic fibers is that they can be more easily chemically modified in aqueous medium in order to create intra fiber or inter fibers cross-links, to introduce reactive groups or polymeric chains on their surfaces and to treat them with surface active agents, such as making them hydrophobic or hydrophilic. Such chemical modifications have been used to make market kraft fluff fiber sheets to easily disintegrate in hammer mills and/or to impart higher absorbency (U.S. Pat. No. 6,910,285 B2, U.S. Pat. No. 8,845,757 B2). Chemical modifications could make fibrous disperse and adhere well with matrices of hydrophobic polymers, rubber or thermoset resins thus making strong composite products. Unlike the commercially available grades of dispersible fibrillated synthetic fibers, such as those of acrylic and lyocell (regenerated cellulose) supplied by Engineered Fibers Technology, LLC as moist pulps of 30 to 50% solids for ease of handling, wood or plant non-regenerated cellulose fibers are not presently supplied in fibrillated forms as pre-dispersed semi-dry or dry materials and have the ability to easily disperse in dry forms and in slurry or high consistency compositions of aqueous or hydrophobic natures.

Presently there exist serious challenges preventing the production of pre-dispersed fibrillated cellulose fibers in semi-dry or dry forms, specifically from those processed on high consistency refiners at low, medium or high energy levels, directly from their high consistency pulps, dry pulps or dry sheets. Unlike the common fibers of high CSF levels, the refiner's outputs high consistency fibrillated fibers have low CSF values and are in clumpy forms and contain many entangled fibrous or knots. "CSF stands for Canadian Standard Freeness which is determined in accordance with TAPPI Standard T 227 M-94 (Canadian Standard Method)". Under these conditions they will be difficult to unravel into separate semi-dry fibrillated fibers using the previously mentioned defibration devices commonly used to individualize dry market pulp sheets or bales. Since the moist fibrillated fibers will eventually strongly self-bond and fibrils dry down on fibers when water is evaporated by air drying, flash drying or cylinder drying, then the chance for their separation into individualized fibrillated fibers, using the common defibration devices, will not be practical. Attempts to convert these forms of fibrillated fibers to separate or pre-disperse fibrous materials having individualized fibrillated fibers with raised fibril elements by the mechanical action of the previously discussed defibration devices or using the disclosed combination of a hammer mill with a disk refiner (U.S. Pat. No. 3,596,840), is impossible without irreversible damage of the fibrous materials.

The literature describe many chemicals as means to reduce the negative impact of drying on fiber hornification and the drying down of fibrils and other chemicals were disclosed as means of making individualized, cross-linked fluff kraft fibers (U.S. Pat. No. 3,224,926). Several patents related to market fluff pulp disclose the use of chemical pre-treatment methods as means to reduce the mechanical energy required to hammer mill sheets to separate fibers, minimize level of knots and improve liquid absorbency of the air laid mat. For fluff pulp making, de-bonding chemicals are generally added to diluted slurries of pulp fibers before dewatering and drying of web, or directly applied to the dry sheet by impregnating it prior to hammer milling step. Cationic surfactants, such as the fatty acid quaternary amines have been suggested as de-bonders for cellulose fibers (Svensk Papperstidning, Kolmodin et al, No. 12, pgs. 73-78, 1981 and U.S. Pat. No. 4,144,122.) Cationic surfactants adsorbed on fibers prior to sheet making can either achieve de-bonding without impairing hydrophilicity (preserving water absorbency) of fibers, such as those described in U.S. Pat. Nos. 4,144,122 and 4,432,833, or cause increased hydrophobicity (reducing water wettability) of fibers, such as those described in U.S. Pat. Nos. 4,432,833, 4,425,186, and 5,776,308. Sheet treatment with plasticizers and lubricants (glycerin, triacetin, propylene carbonate, 1,4-cyclohexanedimethanol, mineral oil) have been disclosed as useful means for better individualization of fibers on hammer mills. Other chemicals have also been introduced to natural fibers to improve softness, wettability, absorbency or hydrophobicity, reactivity or water re-dispensability.

For instance, a chemical treatment method to produce water dispersible, dried microfibrillated cellulose (MFC) was disclosed in U.S. Pat. No. 4,481,076. The MFC slurry is then spray dried to small flakes or aggregates. Among the useful additives that yielded water re-dispersible dry MFC aggregates are polyhydroxy compounds, including in particular carbohydrates or carbohydrate related compounds, such as sugars, starch, oligo- and polysaccharides and their derivatives. The amount of chemical used to enhance water re-dispersion of the MFC aggregates varied from as little as one half to as high as twice the weight of the MFC. This high dosage rate of chemicals was needed probably because the surface area of MFC is enormously greater than those of ordinary cellulose fibers (such as market fluff kraft pulp). Also, the problems of hornification on spray drying are more severe with MFC than normal cellulose fibers. In general unlike MFC materials produced on HCR it is well known that those made on homogenizers at low consistency levels are essentially of low aspect ratios and free of entanglements or knots. While the dry aggregates of the MFC made in U.S. Pat. No. 4,481,076 can be re-dispersed in water, there was no mention on the possibility for their dispersion into separated dry fibrils or have the ability to be dispersible in hydrophobic mediums.

If a method is developed to produce pre-dispersed dry fibrillated fibers, especially from those of fibrillated fibers made by high consistency disc refiners, then in order to achieve their full performance in the manufacture of polymer composite products they must be made hydrophobic and/or have reactive functional groups essential for ideal compatibility, dispensability and adhesion with the matrices of hydrophobic polymers or resins. Without these features if they are introduced in such hydrophobic matrices they will not efficiently disperse nor bond, but instead will form separate aggregates in matrices that bring little added value to the strength and water resistance properties of the final composites. Due to these concerns, the theoretically predicted super reinforcement potential of composites by adding well developed pulp fibers (TMP. CTMP, SWK, HWK, plant fibers) or their fibrillated fibers (MFC, CNF) have not yet reached their full performance potential, and as a consequence they have made only little penetration in the plastic composite industry.

The first aim of the method described herein is to overcome the difficulties of producing semi-dry wood or plant-based fibers, fibrillated fibers, cellulose filaments and blends of fibers in well opened or pre-dispersed forms. They should contain high levels of separated fibrous and loosened low fibrous entanglements or knots. These pre-dispersed fibrous should be easily dispersible in water slurries. The second aim is to prevent hornification and self-bonding of fibrous during a pre-dispersing operation and subsequent water evaporation or drying stages. The third aim is to make the opened fibrous with tailored functionalities desirable for their efficient applications as semi-dry and dry materials in water-based compositions or in hydrophobic compounds. The purpose to achieve the aims of the technology described herein is thus to develop a method and the production process needed to achieve the desirable characteristics of pre-dispersed or dispersible fibrous materials, preferably in a simultaneous manner, using existing equipment and chemicals. The successful developed technology should be cost-efficient and use safe and environmentally friendly chemicals. An important criterion is that the objectives are to be achieved without degrading the structural properties of fibrous materials, namely fiber cutting.

SUMMARY

In one aspect of the method described herein is achieved by using a thermomechanical high consistency disc refining device (process) under gentle non-traditional conditions, that is, lower than normal specific energy conditions (kWh/h). The disc refiner used here is also arranged to have a wide open plate gap (i.e. the distance between the rotating discs) that is an energy efficient method that simultaneously opens; de-entangles; fibrillates; mixes any chemicals into the input fibers; blends different fibers; blends the fibers with adjuvants, and that while the generated frictional heat allows evaporating some water from the moist fibers. The addition of chemicals is intended to overcome any hornification, self-sticking of fibers and fibril elements and to impart desirable functionalities to the transformed pre-dispersed fibrous material. The out of the disc refiner is an opened semi-dry fibrous material that has high level of separated fibers and some loosely entangled fibrous material or knots, that is easily dispersible in water using common papermaking disintegration techniques. The opened fibrous materials are further processed inline by air agitation at velocities sufficient to separate fibrous and their loosened fibrous entanglements and subsequently forming them by air laying and gentle drying techniques into compressed bales, non-woven webs (mats or rolls) or diced web pellets of desirable dryness levels. Using the method and process described herein to make pre-dispersed semi-dry or dry fibrous that have the ability to become dispersible in dry form, water and hydrophobic compositions, has to our knowledge never been done before, and there are no prior arts or published reports available in the open literature that might be conflicting with our approach.

In accordance with one aspect, there is provided a method of transforming a pulp to a pre-dispersed pulp fibrous material comprising: providing the pulp at a high consistency of 20 to 97 wt % solids content; providing a treatment chemical; and dispersing the pulp and the treatment chemical in a multi-stage refiner system comprising at least one disc refiner, at a specific energy of 50 to 400 kWh/t per pass, wherein the at least one disc refiner has a disc refiner plate clearance defining a gap of 0.5 to 3.5 mm, wherein the pre-dispersed pulp fibrous material have a product consistency of 30 to 99 wt % solids content.

In accordance with another aspect, there is provided the method described herein, wherein the pre-dispersed pulp fibrous materials are 70 to 100 wt % individualized fibrous, and comprise a fiber surface fibrillation.

In accordance with another aspect, there is provided the method described herein, wherein during said dispersing the pulp in refiner consistency increases due to the specific energy evaporating water with at least some of water replaced by the treatment chemical.

In accordance with another aspect, there is provided the method described herein, wherein the consistency is 30 to 60 wt % solids content.

In accordance with another aspect, there is provided the method described herein, the product consistency is of 50 to 80 wt % solids content.

In accordance with another aspect, there is provided the method described herein, wherein the consistency is 40 to 70 wt % solids content.

In accordance with another aspect, there is provided the method described herein, the product consistency is of 60 to 80 wt % solids content.

In accordance with another aspect, there is provided the method described herein, wherein the consistency is 30 to 50 wt % solids content.

In accordance with another aspect, there is provided the method described herein, the product consistency is of 60 to 75 wt % solids content.

In accordance with another aspect, there is provided the method described herein, wherein a total specific energy after the multi stage refiner system is a sum of all the specific energies per pass in the refiner system applied to pulp fibrous material and is 50 to 2000 kWh/t.

In accordance with another aspect, there is provided the method described herein, wherein the specific energy is 50 to less than 100 kWh/t per pass and the gap is greater than 2.5 mm to 3.5 mm.

In accordance with another aspect, there is provided the method described herein, wherein the specific energy is 100 to less than 200 kWh/t per pass and the gap is greater than 2.0 mm to 2.5 mm.

In accordance with another aspect, there is provided the method described herein, wherein the specific energy is 200 to 400 kWh/t per pass and the gap is 1.5 mm to 2.0 mm.

In accordance with another aspect, there is provided the method described herein, wherein the pulp is a non-refined or refined kraft pulp, thermomechanical pulp (TMP), chemi-thermo mechanical pulp (CTMP), cellulose filaments (CA2824191 A), mixtures thereof, or the mixtures with non-wood plant fibers and synthetic fibers.

In accordance with another aspect, there is provided the method described herein, wherein the pulp comprises fibers with a length of 0.1 to 10 mm, a diameter of 0.02 to 40 micron and an equivalent average aspect ratio of 5 to 2000.

In accordance with another aspect, there is provided the method described herein, wherein the equivalent average aspect ratio is 10 to 500.

In accordance with another aspect, there is provided the method described herein, wherein the method is a continuous process.

In accordance with another aspect, there is provided the method described herein, wherein the method is a semi-continuous process.

In accordance with another aspect, there is provided the method described herein, wherein the method is a batch process.

In accordance with another aspect, there is provided the method described herein, wherein the treatment chemicals are introduced alone or mixed with water to pulp fibers and fibrous materials prior to or in the refining system.

In accordance with another aspect, there is provided the method described herein, wherein the treatment chemicals are selected from the group consisting of plasticizers, lubricants, surfactants, fixatives, alkalis and acids, cellulose reactive chemicals, cellulose crosslinking chemicals, hydrophobic agents, hydrophobic substances, organic and inorganic (mineral) particulates, foaming or bulking agents, absorbent particulates, oil resistant agents, dyes, preservatives, bleaching agents, fire retardant agents, natural polymers, synthetic polymers, polysaccharides, latexes, thermoset resins, kraft lignin and biorefinery extracted lignin, and combinations thereof.

In accordance with another aspect, there is provided the method described herein, wherein the multi-stage refiner system comprises three disc refiners and the refiner treatment chemicals are added upstream of each of the three disc refiners.

In accordance with another aspect, there is provided the method described herein, wherein the treatment chemicals added upstream of each of the three disc refiners are the same or different treatment chemicals.

In accordance with another aspect, there is provided the method described herein, wherein the plasticizers are selected from the group consisting of polyhydroxy compounds.

In accordance with another aspect, there is provided the method described herein, wherein the polyhydroxy compounds are poly-functional alcohols or polyols.

In accordance with another aspect, there is provided the method described herein, wherein the poly-functional alcohols or polyols are selected from the group consisting of ethylene glycol, propylene glycol, dipropylene glycol, tripropylene glycol, butylene glycol, glycerin and combinations thereof.

In accordance with another aspect, there is provided the method described herein, further comprising mineral oil and a lubricant selected from the group consisting of phthalates, citrates, sebacates, adipates, phosphates and combinations thereof.

In accordance with another aspect, there is provided the method described herein, wherein the surfactant is Triton™ X100 (Iso-octyl phenoxy polyethoxy ethanol), sodium dodecyl (ester) sulfate, dimethyl ether of tetradecyl phosphonic, polyethoxylated octyl phenol, glycerol diester (diglyceride), linear alkylbenzenesulfonates, lignin sulfonates, fatty alcohol ethoxylates, and alkylphenol ethoxylates and combinations thereof.

In accordance with another aspect, there is provided the method described herein, wherein the treatment chemicals are dipolar aprotic liquids selected from the group consisting of alkylene carbonates, used alone or combined with other chemicals.

In accordance with another aspect, there is provided the method described herein, wherein the other chemicals are at least one of triacetin, 1,4-cyclohexanedimethanol, and dimethylol ethylene urea.

In accordance with another aspect, there is provided the method described herein, wherein the alkylene carbonates are selected from the group consisting of propylene carbonate, ethylene carbonate, butylene carbonate, glycerol carbonate and combinations thereof.

In accordance with another aspect, there is provided the method described herein, wherein the treatment chemicals are water-soluble hydrophilic linear or branched polymers.

In accordance with another aspect, there is provided the method described herein, wherein the water-soluble hydrophilic linear or branched polymer is a polysaccharide selected from the group consisting of starch, modified starch, alginate, hemicellulose, xylan, carboxymethyl cellulose, hydroxyethyl cellulose, hydroxylpropyl cellulose and combinations thereof.

In accordance with another aspect, there is provided the method described herein, wherein the treatment chemical is at least one of a sizing chemical solution or emulsion, a de-bonding chemical and a softening chemical.

In accordance with another aspect, there is provided the method described herein, wherein the sizing chemical is selected from the group consisting of alkyl ketene dimer (AKD), alkenyl succinic anhydride (ASA), rosin, styrene maleic anhydride (SMA), styrene acrylic acid (SAA) and polymeric sizing agents; fatty acids, Quilon™ C and Quilon™ H.

In accordance with another aspect, there is provided the method described herein, wherein the sizing chemicals alkyl ketene dimer (AKD), alkenyl succinic anhydride (ASA), rosin, styrene maleic anhydride (SMA), styrene acrylic acid (SAA) polymeric sizing agents; fatty acids, Quilon™ C and Quilon™ H and known polymeric sizing agents such as Basoplast series commercialized by BASF are introduced as solutions of pure chemicals or as pre-emulsified with starch or synthetic polymers.

In accordance with another aspect, there is provided the method described herein, wherein the de-bonding chemicals and softening chemicals are at least one of Arquad™ 2HT-75 (di (hydrogenated tallow) dimethyl ammonium chloride), hexadecyltrimethyl ammonium bromide, methyltrioctyl ammonium chloride, dimethyldioctadecyl ammonium chloride and Hexamethyldisilazane (HMDS).

In accordance with another aspect, there is provided the method described herein, wherein the treatment chemical is a high molecular weight polymer selected from the group consisting of ethyl acrylic acid (EAA); HYPOD™ waterborne polyolefin from Dow (ethylene copolymer and propylene copolymer), water-based polyurethane dispersions, latexes, polyvinylalcohol, polyvinylacetate and combinations thereof.

In accordance with another aspect, there is provided the method described herein, wherein the coupling agents are selected from the group consisting of a maleic anhydride, a maleated polymer, a silane, a zirconate, a titanate and combinations thereof.

In accordance with another aspect, there is provided the method described herein, the silane comprises a structure of $(RO)_3SiCH_2CH_2CH_2—X$ where RO is a hydrolysable group, and R is methoxy, ethoxy, or acetoxy, and X is an organo-functional group, an amino, a methacryloxy, or an epoxy group.

In accordance with another aspect, there is provided the method described herein, wherein the cross-linker is any selected from the group consisting of glyoxal, glutaraldehyde, formaldehyde, citric acid, di-carboxylic acid, polycarboxylic acid and combinations thereof.

In accordance with another aspect, there is provided the method described herein, wherein the thermoset resin is an acrylic resin (Acrodur™ or AQUASET™), a urea formaldehyde resin, a melamine formaldehyde, a melamine urea formaldehyde, a phenol formaldehyde (Resol or Novolac), and an epoxy resin.

In accordance with another aspect, there is provided the method described herein, wherein the polymer is a cationic or an amphoteric polymer selected from the group consisting of chitosan, homopolymer polyvinylamine (PVAm), copolymer PVAm, polyetlyleneimine (PEI), polydiallyldimethylammonium chloride (polyDADMAC), cationic cellulose, cationic starch, cationic guar gum and combinations thereof.

In accordance with another aspect, there is provided the method described herein, wherein the bleaching chemicals are reducing agents selected from the group of sodium sulfite, sodium bisulfite, sodium meta bisulfite and oxidizing agents selected from hydrogen peroxide, percarbonate and sodium perborate.

In accordance with another aspect, there is provided the method described herein, wherein the organic and inorganic (mineral) particulates are selected from the group of consisting of calcium carbonate, clay, gypsum and combinations thereof.

In accordance with another aspect, there is provided a pre-dispersed fibrous material produced by and described herein, further processed by batch or inline air agitation and air laid forming into compressed bales or air laying into compressed nonwoven webs or diced web pellets of desirable dryness levels using gentle drying technique.

In accordance with another aspect, there is provided the material described herein, further transformed to a pre-dispersed fibrous material in a bale, web or web pellet and dispersible either into dry particulates by mechanical action, in water and aqueous compositions or in hydrophobic composition.

In accordance with another aspect, there is provided the material described herein, wherein the hydrophobic composition is at least one of a thermoset resin and a thermoplastic polymer.

In accordance with another aspect, there is provided a pre-dispersed fibrous material produced by and described herein further processed into paper, paperboard, packaging, tissue and towel; foamed products, fiber board products, thermoset and thermoplastic composites; cement, concrete and gypsum products; and oil spill cleaning, nonwoven mats, absorbent core of diapers or personal care products.

In accordance with another aspect, there is provided the a multi-stage refiner system for transforming a high consistency pulp to a pre-dispersed fibrous material, the refiner system comprising: at least one disc refiner comprising a disc refiner plate clearance defining a gap of 0.5 to 3.5 mm, and imparting a specific energy of 50 to 400 kWh/t per pass, wherein the high consistency pulp is 20 to 97 wt % solids content, wherein the pre-dispersed material exits the refiner system with a product consistency of 30 to 99 wt % solids content.

In accordance with another aspect, there is provided the refiner system described herein, wherein the specific energy is 50 to less than 100 kWh/t per pass and the gap is greater than 2.5 mm to 3.5 mm.

In accordance with another aspect, there is provided the refiner system described herein, wherein the specific energy is 100 to less than 200 kWh/t per pass and the gap is greater than 2.0 mm to 2.5 mm.

In accordance with another aspect, there is provided the refiner system described herein, wherein the specific energy is 200 to 400 kWh/t per pass and the gap is 1.5 mm to 2.0 mm.

DETAILED DESCRIPTION

Figure 1:
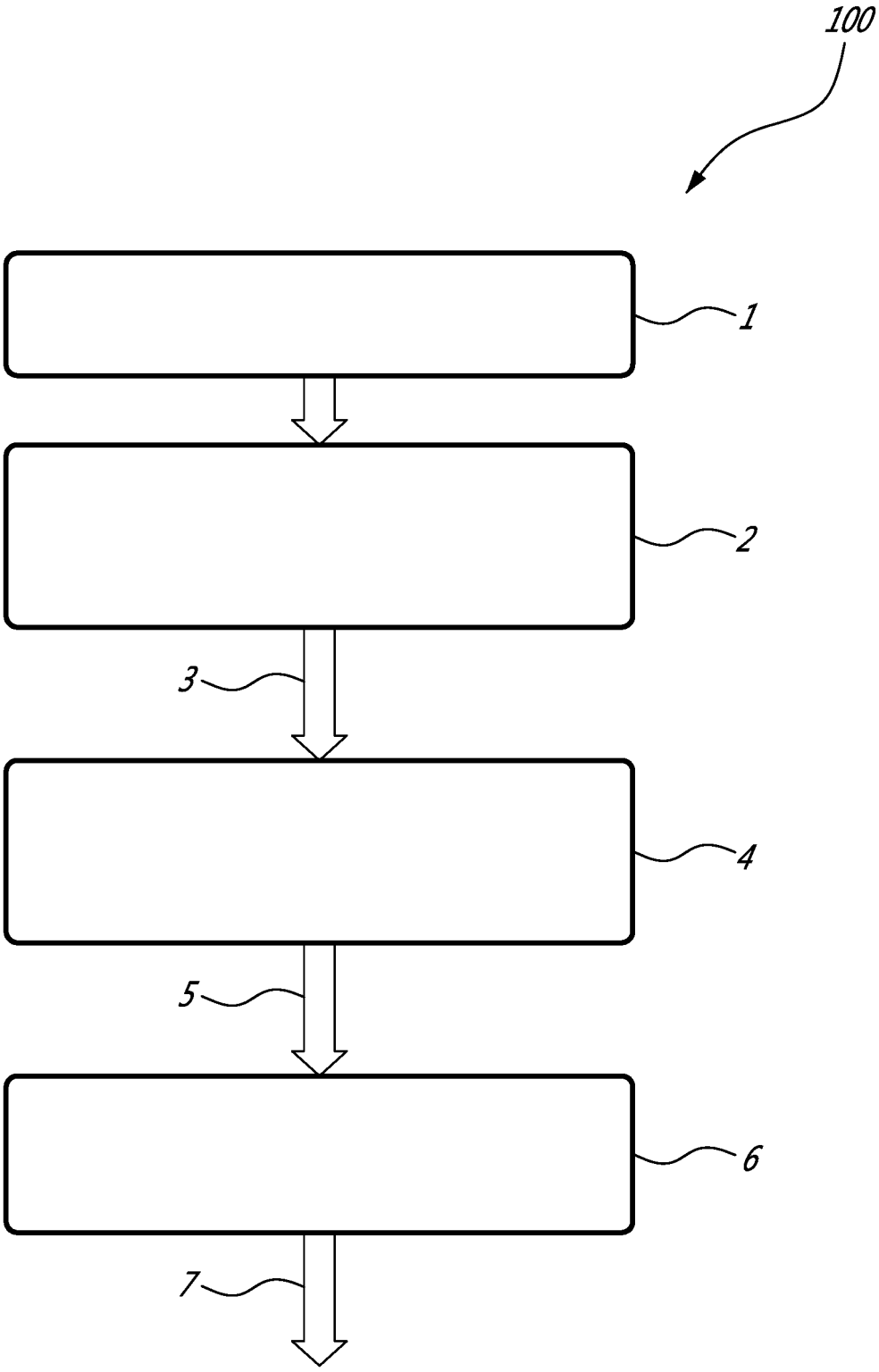
FIG. 1 illustrates a process diagram for the manufacturing of pre-dispersed or dispersible fibrous according to one embodiment described herein.

The present description is directed to a method of transforming an input pulp fibrous into a pre-dispersed semi-dry or dry fibrous material and to the transformed pre-dispersed fibrous material. The method simultaneously opens, de-entangles and fibrillates the fibrous material of the input pulp. The method may also efficiently mix the input fibrous with chemicals while evaporating moisture in an updated mechanical disc refiner process. The refiner is used under special operating set-point control target for three process variables, which are; 1) applied refining specific energy, 2) refiner gap opening and 3) refiner output consistency. Depending on the feed pulp type and the feed pulp consistency, the refiner's output is pre-dispersed semi-dry fibrous materials of 30 to 99% solids with 70 to 100% of separated fibers and depending on chemical treatment used the remaining are loosely entangled fibrous which at this stage disperse in water or hydrophobic mediums using common disintegration or compounding techniques. The pre-dispersed semi-dry output is further processed inline or batch process by air agitation at velocities sufficient to further separate fibers and loosen fibrous entanglements and subsequently putting them into compressed bales or air laying them into nonwoven webs and diced web pellets, using gentle drying techniques to desirable dryness levels. The refiner's feed pulp types of forms suitable for processing by the method herein described are any of the common lignocellulose and cellulose fibers and their fibrillated fibers, some applicable synthetic fibers, and blends of the different lignocellulose fibers and fibrillated fibers or any blends of lignocellulose fibers or fibrillated fibers with proper synthetic fibers and/or organic or inorganic particulates. The chemicals are intended to simplify separation of high consistency entangled fibers and fiber fibrils, prevent their self-sticking and hornification on water evaporation and impart them with novel functional properties desirable for their efficient applications in dry, aqueous and non-aqueous systems. The dispersible semi-dry and dry fibrous materials of the compressed bales, webs or diced web pellets are tailored with specific functional properties appropriate for efficient applications in paper, paperboard, packaging, tissue and towel; foamed products, fiber board products, thermoset and thermoplastic composites; cement, concrete and gypsum products; and oil spill cleaning, absorbent core of diapers, personal care products and other uses.

The fibrous material produced is applicable to dry, aqueous and non-aqueous systems or compositions and products. The method described herein begins with: a disc refiner operating at 1) lower specific energy per tonne of fiber solids, 2) and a wider gap between the disc refiner than conventional disc refiners, and 3) a higher output fibrous material consistency as compared to the input pulp. The presently described method achieves the opening, separating, fibrillating, chemical treating or blending of pulp fibers having a range of 20 to 97% solids content, through a batch or a continuous process with a disc refiner or multiple refiners commonly employed in the pulp and paper industry. The disc refiners are employed under non-traditional conditions and operated at atmospheric or under pressurized conditions. The non-traditional conditions are based on increasing the volume of the refining zone inside the disc refiner by controlling the gap opening between the discs to a set-point target to allow a wider opening, controlling the applied specific energy to a set-point target to apply only minimal specific energy that is predetermined and calculated and to control refiner consistency to a set point-target so that the water evaporation is controlled to be progressive but non aggressive in-order to facilitate the opening of fibers and to facilitate the chemical treatment happening inside the refining zone. Selected process and functional chemicals are dosed to the pulp prior to the refiner inlet or preferably at the inlet of feed pulp toward the refiner center where rapid uniform mixing takes place with pulp fibers. The chemicals are intended to simplify separation of fibers and their entanglements or knots, prevent their hornification and self-sticking on water evaporation and impart them with novel functional properties desirable for efficient dispersion in dry, aqueous and non-aqueous compositions. The output is opened or pre-dispersed, fibrous materials of 30 to 99 wt % solids preferably 50 to 99 wt % solids content that depending on feed pulp type and form can contain 100% separated fibers or substantially high levels of separated fibrillated fibers and the entangled fibers and/or fibrils are loosened, which are at this stage easily dispersible in water using common papermaking disintegration techniques. The pre-dispersed output is preferably further processed, by batch or inline, using air agitation at velocities sufficient to further separate fibers and loosen entanglements and subsequently forming into compressed bales or air laying into compressed nonwoven webs or diced web pellets of desirable dryness levels using gentle drying technique. Depending on the chemical treatment and/or functional additives used the fibrous of the bales, webs or web pellets are dispersible either in dry forms, water and aqueous compositions or in hydrophobic compositions, such as thermoset resins and thermoplastic polymers. "Fibrous" here refers to any lignocellulose or cellulose fibers in non-fibrillated, externally fibrillated, microfibrillated or nanofilament fibrils wherein the length to diameter ratio (aspect ratio) of such fibrous material is at least 5 to 2000, but most preferably 10 to 500.

The refiner's feed pulp fibrous types suitable for processing by the method described herein are any of the common lignocellulose and cellulose fibers, their fibrillated fibers or pre-curled fibers including common wood-based pulp fibers, such as refiner mechanical pulp, thermomechanical pulp, chemi-thermomechanical pulp, chemical pulp (kraft and sulfite), market fluff pulp; seed hull pulp fiber, such as from soybean hulls, pea hulls, corn hulls; bast pulp, such as from flax, hemp, jute, ramie, kenaf; leaf pulp, such as from manila hemp, sisal hemp; stalk or straw fibers, such as from bagasse, corn, wheat; grass fibers, such as from bamboo; synthetic short-cut fibers, such as lyocell, acrylic (polyacrylonitrile PAN), aramid, polyvinylalcohol PVOH, polylactic acid PLA, polyethylene PE, polypropylene PP, polyester (polyethyleneterephtalate PET), nylon (polyamide PA); blends of different lignocellulose fibers, cellulose fibers and fibrillated fibers, or any blends of lignocellulose fibers, cellulose fibers or fibrillated fibers with other applicable chopped synthetic fibers and/or organic or inorganic particulates. The preferred fibrous lengths in the pulps or in the blends of pulps to be processed by the method described herein, range between 0.1 mm to 10 mm and of diameters between 0.02 to 40 microns or average aspect ratios 5 to 2000, but most preferably 10 to 500. To avoid formation of fibrous entanglements the long plant fibers (hemp, sisal, flax, kenaf and jute) of aspect ratios typically ranging from 100 to 2000 can be processed with this method provided that some special measures are taken to avoid any premature entanglements. For some special applications, such as in nonwoven dry laid or wet laid, plant fibers can be blended with wood pulp fibers as a means to create novel higher performance pre-dispersed fibrous materials. Synthetic short fibers, such as those described above, can also be blended in the disc refiner with the high consistency lignocellulose or cellulose fibers or their fibrillated fibers. These short synthetic fibers can play a major role in enhancing the debonding of wood-based fibrous materials and thus improving the processing and properties of nonwoven mats made with high proportions of wood fibrous. The solids contents of the pulp fibrous can range from 20% to 85% and up to 97%.

The method described herein is intended to solve the issue of dispersing the high consistency fibrillated fibers similar to those made on high consistency disc refiners disclosed in U.S. Pat. Nos. 3,382,140, 3,445,329 and GB 1185402 patents, and more specifically those cellulose nanofilaments disclosed in our recently published patent CA2824191 A1 produced at refining energy levels varying between 2,000 and 20,000 kWh/t, preferably 5,000 to 20,000 kWh/t and more preferably 5,000 to 12,000 kWh/t. Furthermore, the most preferred fibrillated fibers to process by the method described herein are those produced on double disc refiners at consistency levels of 30 to 60% and at energy levels ranging from 200 to 2,000 kWh/t, and most preferably at energy levels between 400 and 1,000 kWh/t. The preferred fibrillated fibers can also be produced on low to medium consistencies disc refiners (3 to 20% solids) at energy levels 200 to 2,000 kWh/t then dewatered on twin roll press or screw press to a solids content of 30 to 60%. The fibrillated fibers suitable to process the present method are pulps that have attached and/or detached or free fibrils of aspect ratios at least 10 to 1,000 and a width of 20 nm to 500 nm.

The method can be implemented by belt or screw conveyer feeding to opener refiner of any of the above common pulp fibers or blends of several pulp fibers that may contain also adjuvants of organic and mineral natures. These pulps can be fed to the opener refiner inlet in forms of pieces or flakes of dewatered pulps, such as those dewatered on twin roll press or screw press, or in forms of pre-shredded never-dried or dried market pulp sheets and bales. These pulp forms will be directly impregnated in the opener refiner with water or chemicals to achieve the desired consistency and chemical treatment. A high consistency fibrillated pulp fiber that has already been pre-processed on high consistency refiner can be fed to opener refiner in similar way as the above pulps or it can be directly fed inline to opener refiner from another high consistency disc refiner or a series of disc refiners. Recycled paper or paper machine broke, such as those of printing paper, linerboard paper, sac kraft paper, wall paper, towel paper and liquid packaging paper, can also be shredded and impregnated in opener refiner with some water and/or chemicals to achieve desired consistencies and chemical treatment. The dilution water and/or chemicals are directly metered to the pulp at the disc refiner center through a positive displacement pump. Reaction of fibers with some chemicals can take place under the gentle refiner conditions and/or during a subsequent drying at desired temperatures. The opening of pulp in refiner, without or with chemicals introduced, can be passed several times on the same refiner (batch process) or continually processed on other refiners placed in series. Depending on the desirable properties of the pre-dispersed fibrous to be produced by the present method, several chemicals could be introduced in refiner as a mix during first pass fiber opening and/or sequentially introduced to first pass, second pass or third and fourth pass of a batch refiner or of continuous multiple refiners.

The refiner used to obtain the results of these examples was a pilot atmospheric Bauer 400 double disc refiner operated at a pulp feed rate of around 2.25 kg/min and a rotational speed of 1,200 rpm. The gentle refiner conditions set to achieve the objective of the method described herein are based on the wide gap opening between discs and the use of very low energy levels. These conditions were sufficient enough to cause the immediate opening and fibrillating fibers or curling them while efficiently mixing them with chemical additives and/or adjuvants and evaporating water moisture generated by the thermokinetic heat. As will be explained later for a given pulp consistency feed to the disc refiner, the level of water evaporation during one pass will essentially depend on the initial pulp consistency, plate gap opening level or energy level applied, and the size of disc refiner. These gentle operating conditions are required to prevent cutting the fibres and their external fibrils during the simultaneous opening of pulp fibrous and de-entangling their knots.

We found that the common high consistency wood or plant fibers, in forms of never-dried pulp or flakes or dry shredded sheet, such as thermomechanical fibers, chemi-thermomechanical fibers and kraft fibers, were all easy to open in the refiner operated at wide open plates gap and at varying energy levels, into pre-dispersed separated fibers and potentially imparted with external fibrils. Depending on the pulp consistency in refiner and whether chemicals are used or not, the level of separated fibers in the pre-dispersed semi-dry output pulp can range between 95% and 100% for thermomechanical, chemi-thermomechanical fibers and hardwood chemical pulps and from 70 to 95% for softwood chemical fibers, such as those of northern and southern softwood kraft pulps. For softwood kraft pulps the lower their pulp consistency in refiner the less is the level of individualized fibers in the pre-dispersed semi-dry pulp. The remaining non-separated fibers are essentially loosely entangled fibrous that can be dispersed by agitation in air, water or aqueous compositions. If the pre-dispersed fibers are allowed to fully dry then they can still be dispersible into individual fibers, either in dry form or in water, using the convenient dispersion means. With appropriate chemical treatments in refiner the produced pre-dispersed semi-dry and dried fibers can be dispersible to separated fibers by air agitation and in hydrophobic mediums, such as in thermoplastic polymers.

We also found that by passing in the opener refiner, operated under the same above conditions, a freshly made high energy refined softwood kraft pulp of 20 to 45% solids, that is in a form of dense bundles or clumps and contains high level of entanglements, it was possible to convert it to a pre-dispersed form of solids contents as high as 60%. This output pre-dispersed semi-dry fibrillated fiber contained essentially dispersed fibrous materials and some residual loosed entanglements that were dispersible in water with some mechanical shear. But drying of the pre-dispersed semi-dry fibrous turned them into solids hornificated networks and consequently their mechanical mixing in water required longer time for their dispersion and their reinforcement potential for paper decreased. However, when appropriate chemicals were introduced to same above fibrillated fiber in opener refiner, it was possible to pre-disperse fibrous and evaporate water while still achieving well separated fibrous in semi-dry form. The semi-dry pre-dispersed samples dispersed well in water and had practically no knots and the degree of hornification was only slightly different from that of the initial sample before any pre-dispersing. The chemicals were used for the purpose of preventing self-sticking and entanglement of fibers and fibrils. Other selected chemicals were also used under the same conditions to impart novel functional properties to the dispersed semi-dry and dry fibrous materials. These added functional properties have important significance as they can be tailored to improve performance in the targeted applications, such as improved absorbency, hydrophobicity or adhesion.

The above pre-dispersed semi-dry fibers and semi-dry fibrillated fibers were further separated using high air jet flow or air agitation while forming them into nonwoven mat or continuous web by air suction. The web in semi-dry forms was further dried to about 99% solids. The separated fibrous in dry web forms were much easier to handle, free of dust and can be diced to pellets for efficient dose or feed to the intended applications. Forming the separated fibrous into nonwoven web can be achieved with well know air laying techniques. In air laying techniques, the fibers, which can be short or of same sizes of the fibrous to process by the present method, are fed into an air stream and from there to a moving belt or perforated drum, where they form a randomly oriented web. The air laying technique is known generally from GB Patent No. 1,499,687 which describes a plant for the dry production of a nonwoven fiber web or mat. This plant has an air lay forming head in form of a box which is defined by a perforated base at the bottom. Above the base are rows of rotating wings which distribute the fibers during operation into flows across the perforated base. Below this base is placed an air-permeable forming wire which is running endlessly during operation for accommodating fibers which are drawn through the openings of the perforated base by the negative pressure in a suction box placed under the forming wire. The pre-dispersed fibrous produced by the present method. The semi-dry fibrous webs are consolidated between pressing rolls. At this stage the webs can be diced to pellets or cut to mats. The continuous webs can also be dried and formed into rolls.

As discussed earlier drying a high consistency refined pulp can increase hornification and create more permanent knots and curls. Such pulp will hydrate and disperse less in air, water and its sheets would have low strength properties. The water retention value (WRV) of pulp is used here as a measure to assess the thermal impact on pre-dispersing in the refiner as a function of the increase in their output consistency. The WRV is measured on pulp samples soaked in water then disintegrated at 1.2% consistency using a standard laboratory British disintegrator (T205 om-88). We found that the loss in WRV of pulp due to water evaporation or drying was highly dependent on the type of fiber processed and its freeness or its degree of refining. For instance, when disintegrating in water a highly refined softwood kraft pulp of about 30% solids using a standard British disintegrator the slurry contained high level of fibrous knots. The level of knots was found to significantly decrease if the pulp is soaked in hot water, raising the pH or by further disintegration in a Waring food blender for several minutes. When the same high consistency highly refined softwood kraft pulp was pre-dispersed, according to the method of described herein, we found that as the level of water evaporation increased due to increased number of passes in refiner the WRV of the pre-dispersed semi-dry pulp dropped. On the other hand, with the unrefined softwood kraft pulp as the level of water evaporation increased due to increased number of passes in opener refiner the pre-dispersed semi-dry pulp fibers became externally fibrillated and slightly curled. Initially the WRV of pre-dispersed semi-dry pulp increased then after 4 passes the WRV started to drop, but still remained higher than that of the control non-pre-dispersed sample. Consequently, the pre-dispersed semi-dry pulp easily disintegrates in water and formed strong sheets, whereas the pre-dispersed semi-dry fibrillated kraft fiber after 3 passes still disintegrated well in water and formed strong sheets, but as the number of pre-dispersing passes increased to more than 4 it became gradually difficult to disintegrate in water and the formed sheets were weaker and contained some residual fibrous knots. Again, when appropriate chemicals were introduced to the above fibers or fibrillated fibers in opener refiner, it was possible to pre-disperse the semi-dry pulps several times and evaporate their water to high consistencies, but they still disperse well in water and form strong sheets as will be demonstrated in the examples section.

By using the method described herein many commercially available chemicals or additives can be introduced to pulp fibers during their pre-dispersing in refiner to achieve properties desired for the specific applications. We found that the refiner is an excellent instantaneous mixer for chemicals with pulp fibrous and the available thermal condition promote their homogeneous adsorption and reaction on fibrous surfaces and interfaces. This method of incorporating the chemicals into the refiner is different from those used in traditional processes or novel disclosed methods for producing individualized pre-dispersed pulp fibers using common mechanical defibration devices, such as a hammer mill. The treatment chemicals may include, but is not limited to, plasticizers, lubricants, surfactants, fixatives, cross-linkers, hydrophobic materials, organic and inorganic (mineral) particulates, foaming agents, absorbent particulates, bulking agents, dyes or colourants, preservatives, bleaching agents, fire retardant agents, polymers, latexes, thermoset resins, lignins, combinations of treatment substances and other materials for developing specific end-use properties for fibers. The preferred chemicals are intended to (1) promote fibrous separation or dispersion and eliminate entanglements of high consistency fibrillated fibers as well as other pulp fibers, prevent effect of drying on hornification and self-sticking and aggregation of fibrous; (2) impart hydrophilic and hydrophobic characters to fibers, and possibility develop external fibrils on fibers or curly fibrous; (3) introduce to fibrous, polymer chains, resin molecules, coupling agents, cellulose reactant agents, surfactants, foam developer agents, bulk developing agents, inter-fiber and intra-fiber cross-linkers, coupling agents, antimicrobial substantive molecules; (4) fixing colloidal fines on fiber surfaces or attaching bulk enhancing agents, organic and mineral particles or absorbing particulates or polymer particles. Some of the useful chemicals or additives are described below:

1. Chemical aids: Among the most useful chemical aids suitable to reduce hornification and self-sticking of pulp fibrous are plasticizers or lubricants. The plasticizers are polyhydroxy compounds known also as poly-functional alcohols or polyols, such as ethylene, propylene, dipropylene, butylene and low molecular weight glycol polymers and their mixtures. These polar protic compounds have a hydroxyl group and non-polar hydrocarbon chain, and thus have the affinity to form hydrogen bonds with cellulose and water, which is a powerful intermolecular force. Protic compounds are defined as molecules having O—H or N—H bonds. The O—H or N—H bonds can serve as a source of protons (H+). Mineral oil and many lubricants that can be used in combination with polyhydroxy compounds may include phthalates, citrates, sebacates, adipates, and phosphates. Because of their high boiling and flash point temperatures some of these chemicals can act as a good replacement for some of the evaporated water during the pre-dispersing operation in the disc refiner. As described earlier the water re-dispersible, fully dry microfibrillated cellulose disclosed in U.S. Pat. No. 4,481,076, that contains a polyhydroxy compound as a plasticizer, is in the form of hydrophilic aggregates that are not dispersible into dry separate individual fibrils nor the fibrils of aggregates disperse in hydrophobic compositions.

Other chemical aids that are found to perform well as plasticizers and are good replacements for some of the evaporated water on pre-dispersing fibers in refiner are dipolar aprotic solvents, such the alkylene carbonates namely propylene carbonate, ethylene carbonate, butylene carbonate, glycerol carbonate and their blends or blends with other chemicals such as triacetin, 1,4-cyclohexanedimethanol, and dimethylol ethylene urea and polyols. Dipolar aprotic solvents are defined as follow: "Aprotic solvents may have hydrogens on them somewhere, but they lack O—H or N—H bonds, and therefore cannot hydrogen bond with themselves." Alkylene carbonates are miscible with water, act as scavenger for water and are relatively inexpensive. They have a high dielectric constant and high polarity, and also have high boiling and flash points. They are commonly used in many industrial applications, such as a co-reactant solvent in epoxy resins. For the present method the selected alkylene carbonates are to be introduced to the high consistency pulp in refiner alone or in combination with polyhydroxy chemicals and other functional additives. Other dipolar aprotic solvents meeting the criteria include DMF and DMSO, but because of their chemical nature these organic solvents are not considered in the present method.

Mixing of the moist high energy refined kraft pulps with the above plasticizers and/or alkylene carbonate liquids in the disc refiner provides the ability to produce pre-dispersed semi-dry fibrous that are hydrophilic and easily dispersible in water by common disintegration methods, such as in a hydrapulper commonly used in papermaking. The pulp slurry contains highly dispersed fibrous free of entanglements or knots. When the pre-dispersed semi-dry fibrous is further dried or air agitated then dried it also remain well dispersible in water and the pulp slurry is free of knots. As will be demonstrated latter by examples the reinforcement potential of their water dispersed semi-dry or dry fibrous previously treated with plasticizers or lubricants, are applied to paper furnishes or water-based compositions, was similar or even better compared to the freshly produced never-aged or dried fibrous. While the plasticizers and lubricants have the potential to reduce the effect of drying on fibrous hornifcation and self-sticking of fibrils on fibers, if they are retained in sheet during papermaking the strengthening benefits can be affected due to interference on fibrous bonding.

2. Functional additives: Since the above chemical aids can minimize hornification and self-sticking of fibrils on fibers during pre-dispersing in refiner and drying, the introduction of selected functional additives is thus needed to impart fibrous with hydrophilicity or hydrophobicity characters, or impart them with curl, bulk, density, porosity, foaming, extensibility or bonding ability, or antimicrobial, fire retardant properties and mineral fillers required for the specific end-uses of the many products. The following are two series of examples where the functional additives may be used alone or in combination with the chemical aids:

Water soluble polysaccharide polymers and water insoluble polymers or particulates: These are water-soluble hydrophilic linear and branched polymers. Examples of polysaccharides include starch, alginate, hemicellulose, xylan, carboxymethyl cellulose and hydroxyethyl cellulose. When added to moist pulp fibrous alone or in presence of some chemical aids according to the method described herein, the chemicals can adsorb on fibrous surfaces. The fixation of these polysaccharides on fibrous surfaces will make the pre-dispersed fibrous easily dispersible in water and will thus find uses as high reinforcement additives for papermaking products and other water-based product products. Dry superabsorbent polymer (SAP) particulates, which have the capacity to rapidly absorb large amount of water or human liquids without dissolving, could also be fixed during the pre-dispersing of semi-dry fibrous. Such a fixation of SAP particulates on fibrous surfaces could prevent their undesirable physical dislodgement and migration on liquid absorption in the absorbent mats.

Sizing, de-bonding, softening and surfactant chemicals: Common papermaking size emulsions, such as alkyl ketene dimer (AKD), alkenyl succinic anhydride (ASA), rosin, styrene maleic anhydride (SMA) and styrene acrylic acid (SAA); fatty acids, namely sodium stearate, and calcium stearate; silanes, chromium complexes, such as solutions of Quilon™ C and Quilon™ H, which contains hydrocarbon hydrophobic chain such as stearic acid group with chromium. The sizing emulsions make the pre-dispersed fibers hydrophobic and promote their separation. The chromium complexes, such as Quilon, as well as a solution of polyoxo-aluminum stearate can provide high surface hydrophobicity after drying the fibrous material and thus can act as a de-bonding agent and also minimize dusting in dry materials. These hydrophobic fibrous materials will find use as filtration media, oil absorbents and in plastic composites.

A chemical de-bonder or softener that does not significantly change hydrophilicity of fibers contains, in addition to the hydrophobic alkyl chains, ethylene oxide units. A good example is Arquad™ 2HT-75 (di (hydrogenated tallow) dimethyl ammonium chloride) which was found to prevent bonding of pulp fibers without impairing hydrophilicity. Other chemicals such as hexadecyltrimethyl ammonium bromide, methyltrioctyl ammonium chloride, dimethyldioctadecyl ammonium chloride could be used to achieve debonding and softness. The hydrophilic de-bonded fibrous can be used to make good water absorbing bulky mats for different industry applications. Hexamethyldisilazane (HMDS) is another example of chemicals that are well substantive to cellulose fibers and promote their dispersion and compatibility with hydrophobic polymers. Recent studies have suggested that HMDS treatment of pulp fibers will raise dried-down fibrils and microfibrils (Irving B. Sachs, Wood and Firber Science. 20(3). 1988, pp. 336-343.)

These de-bonder chemicals are preferably introduced to the moist fibrous material with the chemical aids to facilitate wetting and dispersion of fibrous materials. Examples of chemicals useful for the purposes the present method are similar to those well described in U.S. Pat. Nos. 4,303,471, 4,432,833, 4,425,186, US577308 and U.S. Pat. No. 5,750, 492. For the purpose of the present method, the fixation of these molecules on fibrous surfaces is rapidly achieved during the first pass pre-dispersing in refiner and thus no complicated stages are needed, such as pre-treatment of pulp slurry and dewatering or washing of treated pulp or pre-impregnating pulp sheet.

Surfactant compounds (short for surface-active-agents) of nonionic, anionic, cationic, amphoteric and polymeric nature are commonly used in many applications as mean to lower the surface tension (or interfacial tension) between two liquids or between a liquid and a solid. Surfactants are useful for wetting, emulsifying, foaming, dispersing and de-bonding pulp fibers. Well-fixed, non-ionic surfactants composed of a hydrophilic head and hydrophobic tail, can impart hydrophobicity and reactive functional groups to fibrous materials. One particular non-ionic surfactant is Triton™ X100 (Iso-octyl phenoxy polyethoxy ethanol) that can improve fibrous compatibility with epoxy and polyester resins. Triton™ X100 has an affinity to fix onto fibrous surfaces in the presence of an enhancer, such as phenol and lignin. Other useful surfactants for the present method are sodium dodecyl (ester) sulfate, dimethyl ether of tetradecyl phosphonic, polyethoxylated octyl phenol, glycerol diester (diglyceride), linear alkylbenzenesulfonates, lignin sulfonates, fatty alcohol ethoxylates, and alkylphenol ethoxylates.

Another reactive molecule that can be fixed on fibrous surfaces by the process of the present method is benzoyl chloride. Its phenolic group can interact with benzene rings and methyl groups present on polyester resin used to make thermoset composites. This will impart compatibility with fibrous material and polyester resin and also reduce fibrous hydrophilicity.

Depending on the chemistry of the functional additive used the pre-dispersed fibrous will have the potential to easily re-disperse in papermaking furnishes and other water-based compositions or have good compatibility and mixing during extrusion compounding with polyolefin polymers. However, for thermoplastic composites the dosages of the chemical aids, de-bonders or sizing agents must be maintained low in order to avoid loss in tensile strength of the final composite product. This is because the fixed low molecular weight plasticizers, hydrophobic de-bonders and sizing agents on dry pre-dispersed fibrous surfaces promote good dispersion during extrusion compounding and injection molding, improve water resistance, but decreased adhesion between the fibrous and the matrix.

3. Other functional additives: In order to achieve compatibility, adhesion, cross-linking, hydrophobicity, or create novel fibrous formulations other types of functional additives can be introduced to the pulp during the pre-dispersing operation in refiner. The selected additive can be introduced in combination with the chemical aids. The selected functional additives should have good affinity to fix and/or react with fibrous materials in refiner and during the final drying stage, such as those described below:

Copolymer water dispersions: Such high molecular weight anionic copolymers include ethyl acrylic acid (EAA); HYPOD™ waterborne polyolefin from Dow (ethylene copolymer and propylene copolymer), water-based polyurethane dispersions namely supplied by BASF and DOW Chemical and many latexes, such as styrene butadiene rubber (SBR), can all be adsorbed or coated on fibrous surfaces in disc refiner. These copolymer dispersions can impart hydrophobicity and play a role of polymeric coupling agents to the dry fibrous and thus allow better compatibility, compounding and additional reinforcement with conventional thermoplastic polymers, such as polylactic acid (PLA), polybutyrate adipate terephthalate (PBAT, Ecoflex), PLA/PBAT blend (Ecovio), polypropylene (PP), polyethylene (PE), polystyrene (PS), polyvinylchloride (PVC), thermoplastic polyurethane (TPU), rubber, and many other commodity thermoplastics.

Coupling agents and cross-linkers: Chemicals that achieve this goal are many maleic anhydride or maleated polymers, silanes, zircontes and titanates. Silane molecules contain two types of reactivity—inorganic and organic—in the same molecule. A typical general molecular structure of silanes is $(RO)_3SiCH_2CH_2CH_2$—X where RO is a hydrolysable group, such as methoxy, ethoxy, or acetoxy, and X is an organo-functional group, such as amino, methacryloxy, epoxy, etc. Thus a single silane coupling agent molecule attached to a fibrous surface can act at the interface between the fibrous and the polymer matrix of the composite to bond, or couple these two dissimilar materials.

Chemical agents such as multifunctional acids and multifunctional amines can also be integrated with moist pulp fiber to develop surface functionalities and intra-fiber cross-links or inter-fiber crosslinks. Many prior patents describe well the many cross linkers, namely glyoxal, aldehyde, formaldehyde, citric acid, di-carboxylic acid, polycarboxylic acid, used for treating cellulose under heat as a means to impart resiliency and absorption capacity of pre-dispersed pulp (U.S. Pat. Nos. 5,049,235, 6,165,919, 6,264,791, 7,195, 695, 8,475,631). Intra cross-linked pre-dispersed fibers or fibrous materials have been used for application in nonwoven mats used in diapers and other hygiene liquid absorbent products.

High consistency pre-refining or pre-mechanical shearing and compaction of softwood kraft pulp, such as in a disc refiner or a Frotapulper™, combined with the method described herein (by pre-dispersing in presence of adequate chemical agents) can be optimized to create curly fibers of hydrophobic nature. Such pre-dispersed fibrous can be very desirable for combination with superabsorbent polymers in manufacture of absorbent mats as a means to exhibiting improved resilient bulking and absorbent properties. In the manufacturing of diapers superabsorbent polymers provided in the form of particulate powders, granules, or fibers are distributed throughout the pre-dispersed fibrous mats necessary to achieve high liquid absorbency. Crosslinked curly fibers would allow achieving resilient networks during absorbency or acquisition and retention of polar liquids, namely water, by the superabsorbent polymer particulates.

Thermosetting resins: Examples of the most preferred thermosetting resins for the method described herein are water-based resins or emulsions, such as the acrylic resins (Acrodur™ series) supplied by BASF and AQUASET™ supplied by Dow Chemical) and the common aqueous resins, namely urea formaldehyde, melamine formaldehyde, phenol formaldehyde, melamine urea formaldehyde, and epoxy, which can be impregnated on fibrous materials during the pre-dispersing operation in refiner of the present method described herein.

Depending on the chemical aids and the water-based resin injected to the mixing pulp in refiner, the produced pre-dispersed impregnated fibrous can be employed in compounding with thermoplastic polymers or used in the manufacture of thermoset composites based on polyester resin matrices commonly used in BMC (bulk molding compound) and SMC (sheet molding compound) or wood composites such as MDF and HDF as well as in many other composite products.

4. Cationic polymeric fixatives: For some uses the fractions of small anionic fines and dissolved and colloidal substances of market pulps are undesirable in papermaking. The injection of selected cationic or amphoteric agents or polymers of low to high molecular weight, namely alum, chitosan, polyvinylamine (PVAm), polyetlyleneimine (PEI), polydadmac, cationic cellulose and cationic starch, during pre-dispersing operation in refiner, can allow neutralizing and fixing the fine materials on fiber surfaces. These additives can also create ionic cross-links within fibrous and between fibrous creating fibrous networks having high resiliency, bulk and porosity and improved strength and absorbency. Cationic metallic complexes can also be used to achieve fixation and impart hydrophobicity to fibers. We found that fixation and ionic crosslinking allow reducing dusting propensity of pre-dispersed fibrous material.

In accordance with the present method, pulps during their pre-dispersing in the refiner are impregnated, mixed or blended with 0.1 to 40%, based on materials weight, of the selected chemicals combined with other additives or adjuvants. The preferred dosages of chemicals may range between 0.1 to 20 wt %. The more preferred dosages of chemicals may range between 0.1 and 10 wt %. The pulp in refiner is pre-dispersed in presence of one, two or several of the above selected chemicals injected together during first pass opening or by subsequent additions during second pass or third pass pre-dispersing in refiner. The selected chemicals are intended to remain as part of the semi-dry and dry fibrous materials and no washing, extraction or material evaporation is needed prior to their uses.

As described earlier, the lignocellulose pulp fibers or their fibrillated fibers can be blended with any plant or seed fibers and/or synthetic fibers of proper lengths and aspect ratios described earlier. These dimensions are necessary to avoiding formation of undesirable entanglements during pre-dispersing. The proportions of the plant or seed fibers and/or synthetic fibers that may be blended together with the lignocellulose pulp fibers or their fibrillated fibers in refiner can vary between 1 to 99%. They can be introduced to refiner from different feed lines, such as via one, two or multiple belt or screw conveyer feeders as will be described later.

The following process descriptions can be employed to produce the pre-dispersed semi-dry fibrous materials and their further dispersion by air agitation, drying and forming them to compressed bales, webs, or diced web pallets of desirable dryness levels. If the pulp to be pre-dispersed is originated from medium or low consistency fiber slurry then it must be first dewatered in a device such as a screw press, belt press, continuous centrifuge, batch centrifuge, or double roll press to raise consistency, preferably to around 30-60% solids, then turned to small pieces or flakes by shredding in order to allow normal feeding and pre-dispersing operation in disc refiner. Similarly, if the pulp is originated from a dry market pulp sheet or bales then it must first be shredded to small pieces of 10 to 30 $cm^2$ sizes then fed through a screw conveyer to the refiner where water and/or chemicals are introduced and consistency is controlled to the desired processing level. Preferably, the preferred range of pulp consistency during first opening pass in refiner is 20 to 97%, and the preferred corresponding output pre-dispersed material has solids content ranges between 30 and 99%.

The output pre-dispersed semi-dry fibrous can be further dispersed by air agitation and gentle drying while forming it to compressed bales, webs or diced web pellets. In accordance with the process the refiner's output pre-dispersed material is quickly mixed with high velocity air flow generated by external fans then delivered through a conduit to a cyclone. The cyclone is connected to a transfer pump where moving fibrous are sucked from cyclone and pulverized to form bales or webs. The external fans, cyclone and the conduits of inlet and outlet cyclone are sized to provide an air stream velocity sufficient to separate the fibers and loosen the fibrous entanglements'. The temperature of the air in cyclone can be adjusted to desired level below 100° C., preferably between 70 and 80° C., by blowing hot air from a heater through the fans. The semi-dry separated fibers are collected from the cyclone by propelling them through a conduit into bales or formed into webs by suction through a screen moving on a vacuum box. Any screen's escaped fines under the vacuum box are returned through a conduit to the cyclone. The moving formed web is gently compressed between two rolls then if necessary further dried at adequate temperatures required to complete reaction of chemicals with fibers. We found that by keeping the air dispersed fibrous in semi-dry forms it was possible to give the compressed webs with some mechanical strength necessary for handling and also practically free of dust.

Other drying techniques can also be integrated with the present method, specifically when the pre-dispersed semi-dry fibrous material is meant to be collected in form of bales. While the conveyer dryer, the screw conveyer dryer and the conventional flash drying techniques could be used for drying the pre-dispersed semi-dry fibrous material made by the present method, the convenient technique could be the Superheated Steam Dryer (SHSD) or an equivalent drying set up that could be connected in the continuous process of this method. The superheated dryer is a closed loop pneumatic conveying type. If steam pressure is kept constant and more energy is added, its temperature increases and saturated steam becomes superheated steam (SHS). The pre-dispersed semi-dry fibrous can be fed directly after air agitation into the flow of pressurized superheated transport steam by means of a tight pressure rotary valve, plug screw or similar. The transport steam is superheated indirectly via a tubular heat exchanger, by a heating media. Normally, the residence time in the dry system is 5-60 seconds. Using a closed pressurized steam system there are no dust particles or volatile compounds vented to the atmosphere, nor any visible steam plume. If needed the possible volatiles from the reaction of chemicals with fibrous can easily be handled or treated in the condensate, where they are collected by condensation of the generated steam.

A key element of this method is producing pre-dispersed semi-dry fibrous materials that can be, at this stage, easily dispersible by mixing in water or in aqueous compositions, or in a high velocity air agitation environment. Such pre-dispersed semi-dry fibrous materials are successfully produced on a high consistency disc refining process by lowering the energy to a minimal level and opening wide the plate gap during the repeated passes in refiner(s) using a batch single refiner or in continue process using a series of refiners. These specific conditions allowed proper simultaneous blending of pulp with chemicals and other additives while opening, de-entangling and externally fibrillating fibers or separating already fibrillated fibers. The pre-dispersed semi-dry fibrous is quickly further dispersed inline by air agitation to desirable dryness levels and formed into compressed bales, webs or diced web pellets. When pulp is blended in refiner with appropriate chemicals and/or additives then both pre-dispersed semi-dry and dry fibrous materials become well dispersible and substantially free of fibrous entanglements on agitation in water or aqueous compositions. Further, with other appropriate chemicals and/or additives the dry fibrous materials become dispersible in hydrophobic mediums and the final composition is free of fibrous entanglements. In absence of chemicals aids the generated heat can cause some hornificaton, drying down of fibrils on fibers, shrinkage and curling of fibers and fibrils. However, these physical changes in fibrous are substantially minimized or eliminated by the addition of the appropriate chemical aids described earlier. The chemical aids have the task here to prevent self-sticking of fibers and fibrils on water evaporation during pre-dispersing stage and will remain part of the pre-dispersed fibrous to prevent their hornification on storage and drying.

The method presently described herein, is well suited for pre-dispersing difficult pulp fibers, specifically the fibrillated fibers produced by a high consistency disc refiner at high specific energy levels can be to converted to pre-dispersed semi-dry fibrous materials containing 70 to 100% individualized fibers and the remaining loosened fibrous entanglements that can be dispersed in the application compositions. Any high consistency pulp of kraft, sulfite, soda or alkaline cooking process is suitable for processing by the present method. Suitable high consistency pulps can also be obtained from mechanical pulping processes, such as MDF TMP fiber bundles and the more defibered unbleached or bleached thermomechanical pulp (TMP) and chemi-thermo mechanical pulp (CTMP). Plant fibers of lengths of 1 to 6 mm, such as abaca, can also be pre-dispersed. Other pre-cut plant fibers including flax, kenaf, hemp, jute, sisal, cotton or similar materials, could also be pre-dispersed. Like wood-based fibers, plant fibers may also be refined and subsequently used to provide high consistency fibrillated fibers for converting them to pre-dispersed semi-dry fibrous materials practical in accordance with the present method. Synthetic short fibers (such as polyethylene, polypropylene, polyester, aramid, polyacrylonitrile, polyamide, polyvinyl alcohol, rayon, lyocell, glass, carbon) can also be pre-dispersed in refiner together with the above lignocellulose fibers or their fibrillated fibers. Synthetic short fibers of high melting temperatures are more preferred.

FIG. 1 illustrates a process 100 for manufacturing pre-dispersed or dispersible fibrous materials according to the embodiments described herein with the steps of: feeding of pulp fibers 1; processing of the pulp fiber by opening mixing, fibrillation, separation and de-entanglement as well as chemical addition to the fibers 2; and further air separation of semi-dry fibrous and their collection in bales or transformation 4 into compressed webs and diced web pellets. The feeding 1 of refiner is with any pulp type in the forms suitable for processing by the method described herein. The pulp type may be any of the common lignocellulose and cellulose fibers and their fibrillated fibers, some applicable synthetic fibers, and blends of the different lignocellulose fibers and fibrillated fibers or any blends of lignocellulose fibers or fibrillated fibers with proper synthetic fibers. One or a blend of high consistency pulp fibrous are processed in a simultaneous way to achieve their opening, dilution or chemical treatment, pre-dispersing, fibrillating and moisture evaporation 2 using a batch or a continuous process of a disc refiner or multiple refiners. The output pre-dispersed semi-dry fibrous materials 3 are at this stage dispersible in water or aqueous compositions using common disintegration techniques. The pre-dispersed semi-dry fibrous materials 3 can be further gently dried and supplied 4 in form of bales or in super sacs. When proper chemical treatment is being used during the opening stage then the pre-dispersed fibrous 3 can be dispersible in hydrophobic compositions. The pre-dispersed semi-dry fibrous 3 output is further processed, by batch or inline, using air agitation 4 techniques at velocities sufficient to further separate fibers and loosen entanglements and subsequently forming them into bales or air laid them into webs or diced web pellets using gentle drying technique into compressed nonwoven bales, webs or diced web pellets of desirable dryness levels. Depending on the chemical treatment and/or functional additives used the fibrous of the bales, webs or web pellets 5 are dispersible either in by mechanical (milling) 6 action, water and aqueous compositions or in hydrophobic compositions, such as thermoset resins and thermoplastic polymers. After milling 6 there is can be complete fibrous separation and/or size reduction by mechanical action into dry flowable particulates 7.

Figure 2:
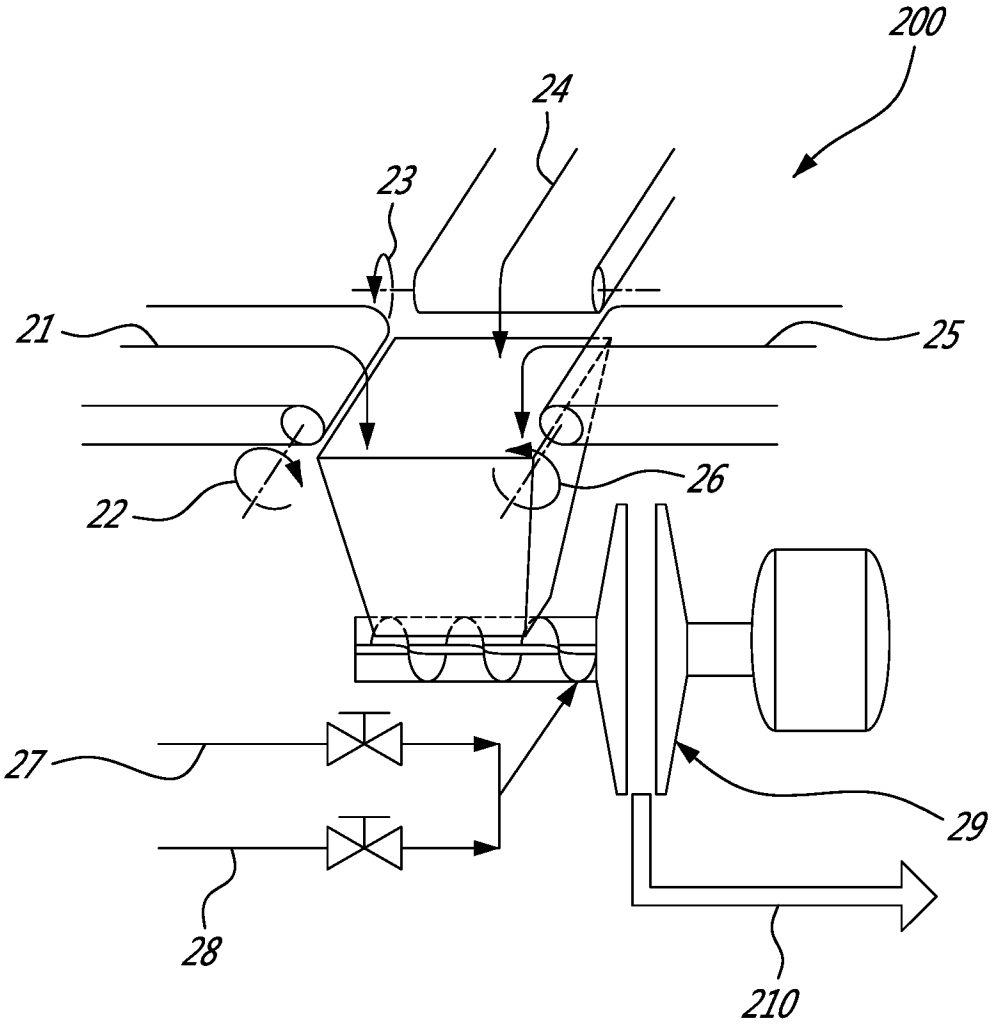
FIG. 2 illustrates a process schematic of blending pulp/fibers of different species at high consistency low energy—opening and pre-dispersing with minimal water evaporation according to one embodiment described herein.

The practice of the present method relies on the main components or major blocks of the three processes 1, 2 and 4. The layouts of the processes are described below:

FIG. 2 presents layout of the process 200 for blending fibers of different origins that can be wood fibers, plant fibers and their fibrillated fibers or synthetic fibers, or a combination of the different fibers. Thus making the fibers into blends that are evenly distributed. This is an important step before any pre-dispersing and/or chemical treatment during pre-dispersing. The feed fibers 23, 24 and 25 can be in any form and pre-diluted or diluted in refiner to as low as 20% solids and as high as 97% solids. The consistency of the refiner's output fibrous is controlled to a predetermined set-point using dilution liquid flow introduced directly to the refiner. The preferred dilution liquid is water 28, but other polar liquids of very low volatile organic compound (VOC) and high boiling temperature could be used alone or in combination with water.

When mixing different fibers having different density; as illustrated in FIG. 2, the feed speed of each conveyer 22, 23 and 26 is set respectively to exact set-point, so as to accurately control the desired blend with appropriate density.

Layout of FIG. 2: There are 10 process blocks in this mixing fibers/pulp from wood and non-wood. Block 21, Fibers or pulp conveyed into refiner. The speed of the conveyer in rotation per minute (RPM) (block 22) is controlled to a set-point target to achieve the desired final blend. The same description goes for block 23, 24, 25 and 26. Block 27 is the chemical addition in the eye of the refiner. Also being added at this location, block 28, is the dilution liquid to control the refiner blow line consistency to a set target. Block 29 is the thermomechanical disc refiner that could be atmospheric or pressurized refiner. Block 210 is the blow line pulp or uniformly blended fibers products.

Figure 3:
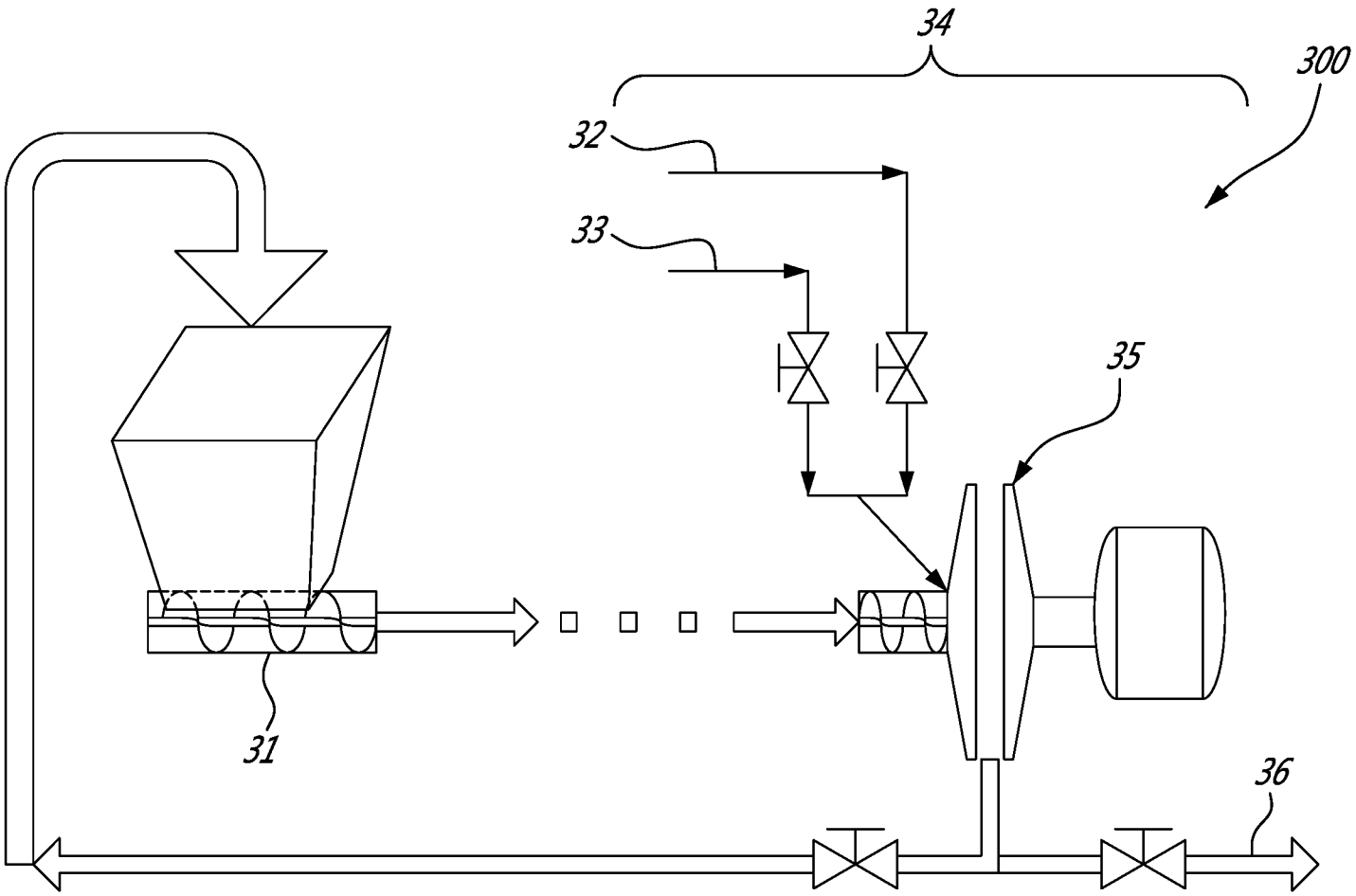
FIG. 3 illustrates a process schematic of a batch process: with a multi-stage opening, mixing with chemicals, fibrillation of pulp fibers and evaporating water at High Consistency Low Energy Refining according to one embodiment described herein.

FIG. 3 presents the batch multi pass process 300.

Layout of FIG. 3: There are 6 blocks in this figure. Block 31 is a tank containing one pulp or blend of pulp fibers to be processed. The pulp can be processed one pass or several passes. The refiner's output pulp is sent to next stage or returned back to undergo another pass. Thus, one or several passes can be done until the desired properties are achieved. The final processed fibrous is now ready to use or may be moved to a next stage converting by air agitation processing and forming into bales, webs or diced web pellets. The dilution liquid (block 32) is added at the eye of the refiner, when needed due to the fact that sometimes no dilution is done when the selected chemical used for treatment is non-water based. Chemicals, block 33, are also added at the eye of the refiner. Refiner feed during n pass, block 34. Block 35 is the high consistency thermomechanical disc refiner, which could be atmospheric or pressurized refiner. The output product of uniform blended fiber product is block 36.

Figure 4:
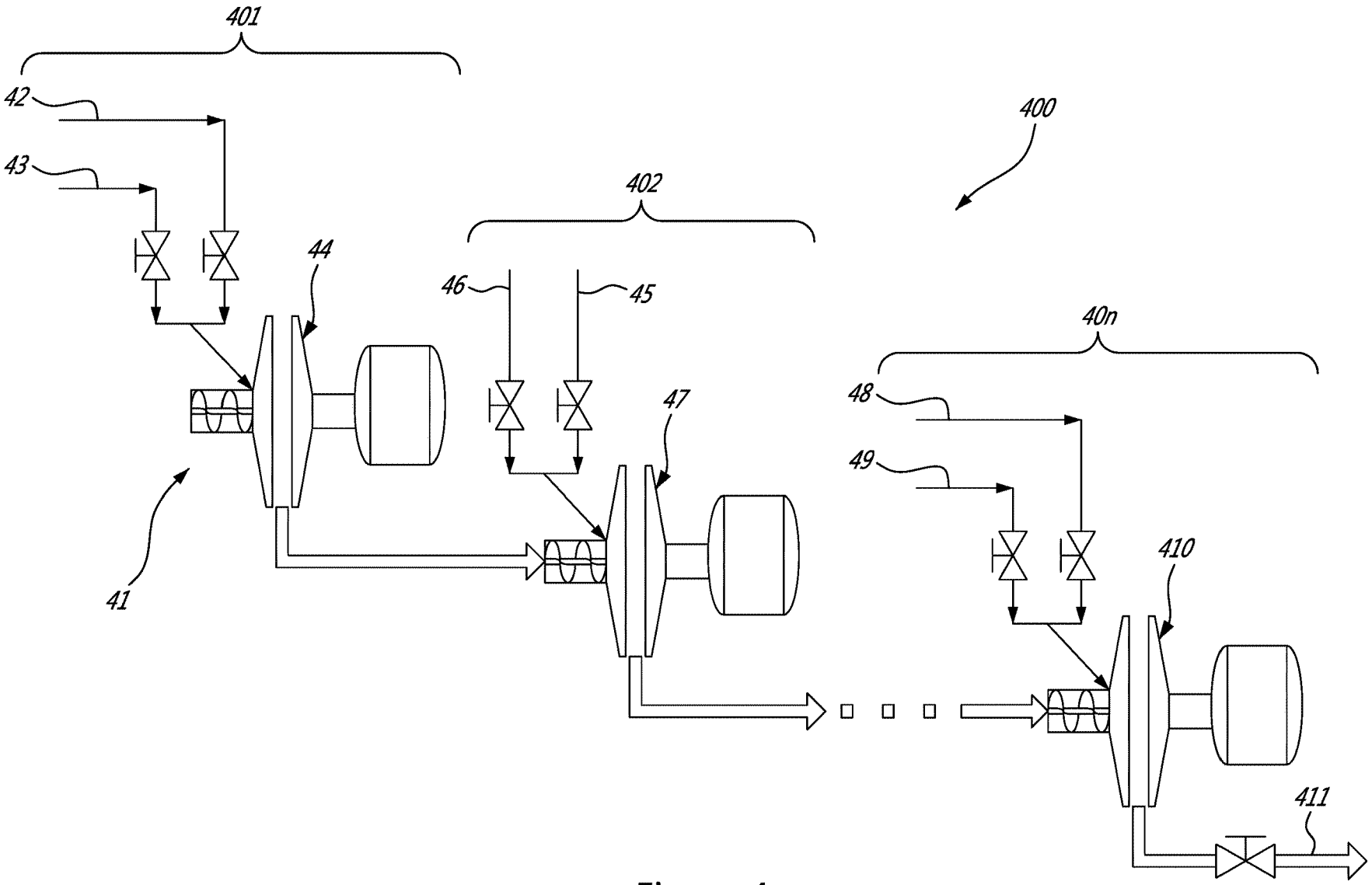
FIG. 4 illustrates a process schematic of a batch process: with a multi-stage opening, mixing with chemicals, fibrillation of pulp fibers and evaporating water at High Consistency Low Energy Refining according to one embodiment described herein.

FIG. 4 is a continuous multi-pass process 400.

Layout of process 400 is illustrated in FIG. 4: There are at least 11 process blocks presented in this figure (when 3 process stages are used), however FIG. 4 represent more than three stages i.e. n stages (401, 402, . . . , 40*n*). Block 41 is the feed pulp to the refiner 44 of stage 401. Block 42 is the water addition to control the refiner's output consistency according to a set point target. At Block 43, a first chemical is added in the eye of the refiner 42. A second chemical and water are be added, at blocks 45 and 46 respectively into refiner 47 of stage 402, and at any nth subsequent stage 40*n*, water and chemicals are added, blocks 48 and 49 respectively of refiner 410. All chemicals are added in the eye of the refiners 44, 47 and 410 according to an established sequence of chemical addition. The output fibre product 411 leaves refiner 410.

Figure 5:
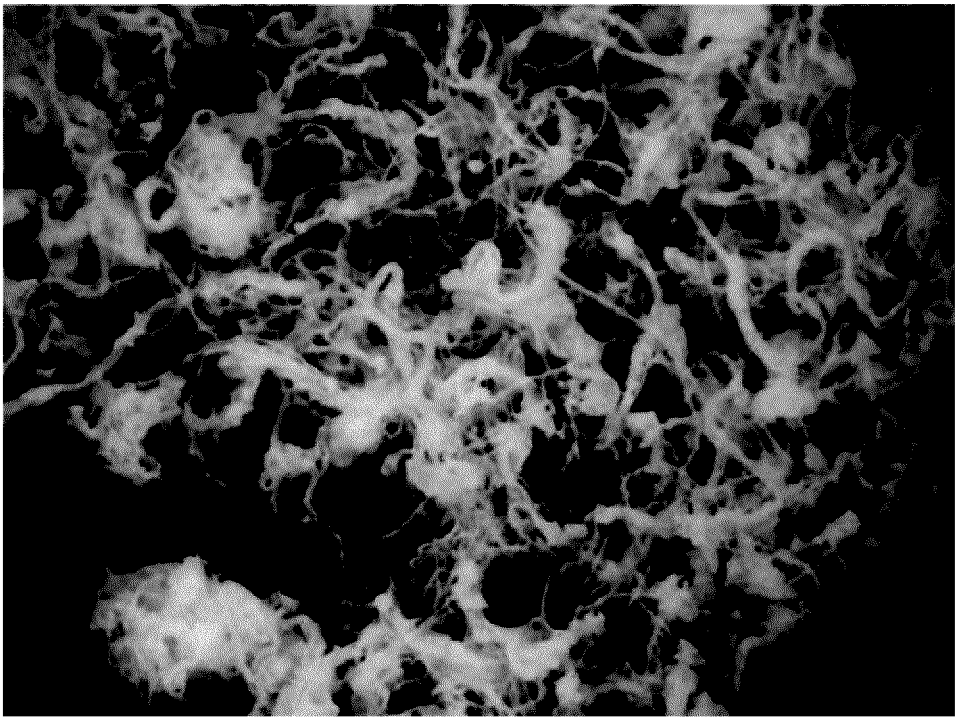
FIG. 5 illustrates a micrograph of reflected light microscopy of bundles of fibrillated fibers out of a high consistency, high energy refining stage according to one embodiment described herein.
Figure 6:
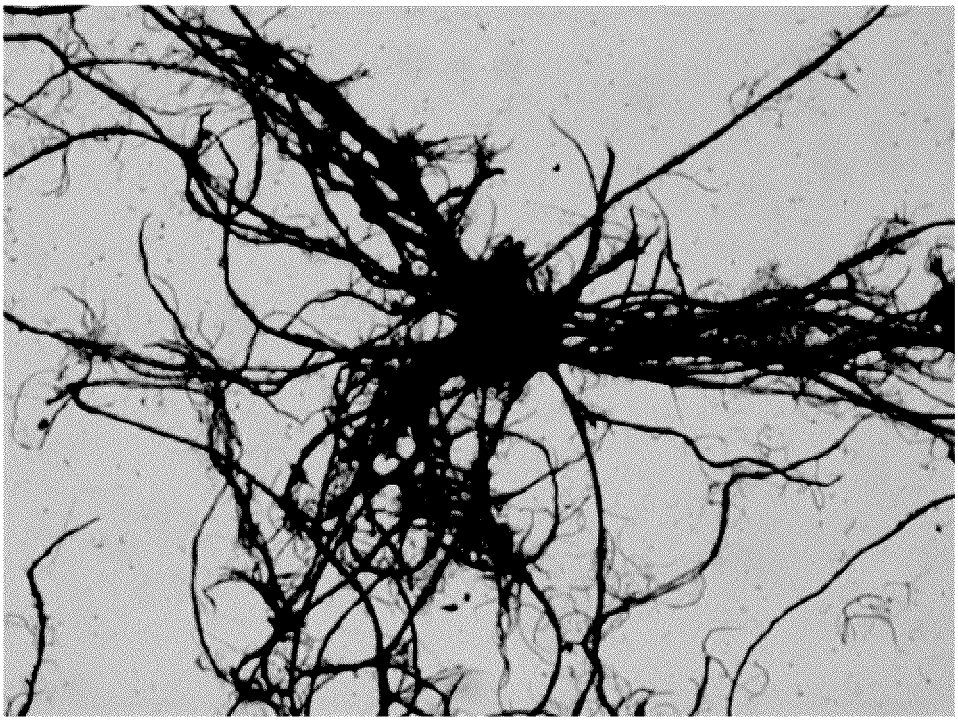
FIG. 6 illustrates a micrograph of transmitted light microscopy of one bundle showing entangled fibers out of a high consistency, high energy refining according to one embodiment described herein.

High consistency refining is usually coupled with the application of high energy and it is aimed at developing fibers by externally and internally fibrillating mechanisms, which result in a significant increase of fiber surface area at significantly low fiber cutting and an increase of pulp density. When the objective of high consistency refining is to develop fibers, the applied specific energy is higher than 800 kWh/t per pass and the space between refiner plates, gap, is reduced, very narrow or tight as tight as 0.5 mm gap between the refiner plates according to set alarm for plates protection. This would results in reduction of the refining zone volume. The pulp coming out of the refiner is mainly bundles of squeezed entangled fibers. This is illustrated in FIG. 5 and FIG. 6.

Figure 7:
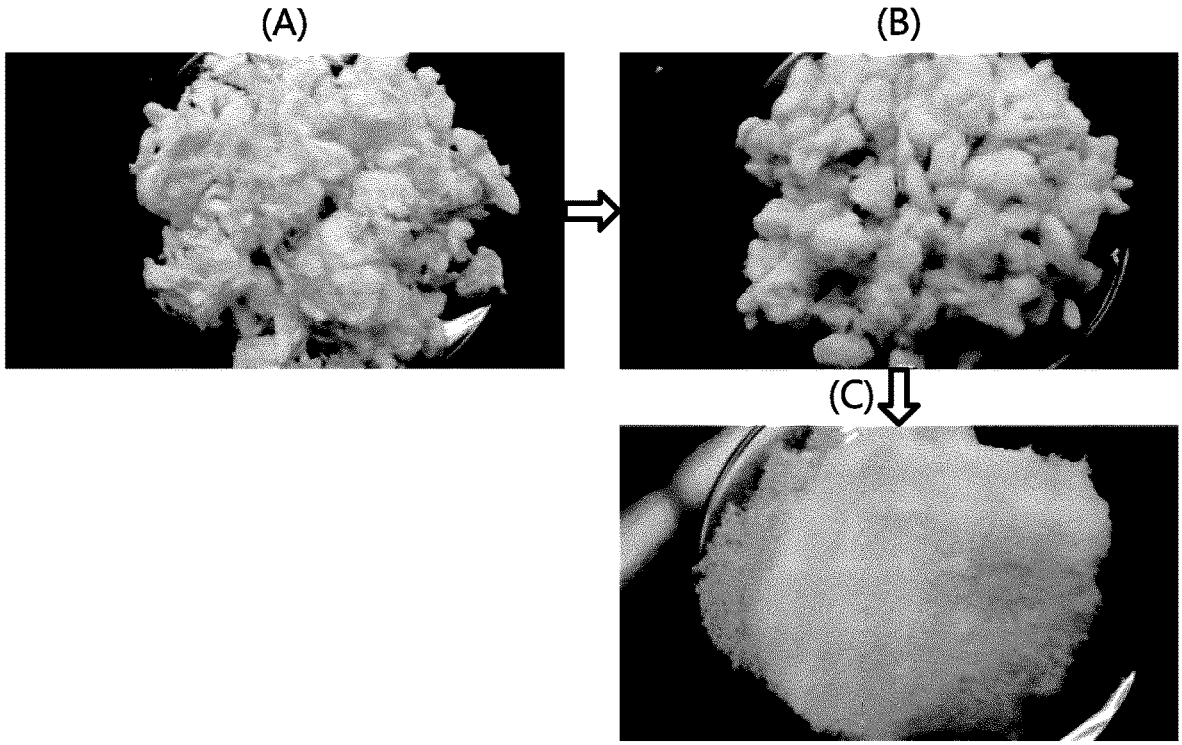
FIG. 7 illustrates three micrographs of samples of fibrous material (A) never dried pulp flakes. (B) treated pulp according to the present method. (C) Air dispersed pulp fibers.

The approach, disclosed here, is based on multi pass refining of a given pulp fibers. Each refining pass is at high consistency ranging between 20% and 97%. The applied specific energy per pass is low and it ranges between 50 kWh/t to 300 kWh/t per pass only. Under these conditions, the gap opening is very wide (low energy condition). It can range between 1.2 mm to 3.5 mm depending on the type of the industrial refiner being used and its capacity, the density of pulp and, plate conditions. For small refiner's mainly very low capacity, the gap opening would range between 0.5 mm to 1.2 mm. Because of the low production, the gap opening, for their normal production can be as low as 0.1 mm to allow and apply significant energy to develop fibers. For instance, when a large refiner, high capacity, is used under the conditions of high consistency and low applied specific energy, the refining zone volume is expended. This allows a large space where pulp bundles or aggregates are exploded into separated or pre-dispersed fibers and loosened entanglements and simultaneously the added chemicals will reach most fibrous surfaces in a matter of few seconds, which is equivalent to the residence time in the refiner. The perfect homogeneous mixing of chemicals on fibers can be seen in FIG. 7. FIG. 7A is the feeding of softwood BCTMP flakes to the refiner. FIG. 7B shows the output well pre-dispersed semi-dry fibers where their colors is turned to light green caused by the chemical introduced during one opening stage of pulp flakes. FIG. 7C shows the dried air dispersed pulp of FIG. 7B. This dry pulp has zero entanglements or residual knots.

In the method described herein the high consistency refiner is operated at wide open gap and thus the applied energy is pre-calculated to mainly separate fibers or de-entangle them and simultaneously evaporating water as will be shown here. In such conditions the shear created on fibers in refiner causes external fibrillation of unrefined fibers and help freeing or lifting fibrils of the previously highly refined fibers.

The advantage of this novel processing method is that, the opening/pre-dispersing in disc refiner can be done without significantly changing the initial properties of the pulp fiber or intentionally changing them by creating novel properties namely external fibrillation and curling. In such operation, unlike normal operation of high consistency, high energy refining of pulp, the gap between rotating discs is wide open. The gap is inversely proportional to the applied specific energy at a constant production rate. Also, fiber length is positively correlated with the plate gap. This means applying high energy would result in closing the gap and closing it will result in high fiber development and fiber shortening. An open gap which is our case here mainly promotes fiber opening and dispersion or freeing of fibrils of fibrillated fibers and creates some external fibrillation at no or minimal fiber shortening. In examples 2 and 3 we show bleached softwood pulp fiber (BSWK) of high freeness, before and after its pre-dispersing on refiner. The pulp coming out of the refiner its fibers is pre-dispersed—this is illustrated in the photo given in FIG. 10 where we can see clearly the increase in volume of the output pulp. In a normal operation of high consistency refining, the pulp bulk volume decreases due to an increase in its density. The microscopy images of FIG. 11 (same samples of FIG. 10). It can be seen that on pre-dispersing the fiber length of initial pulp is preserved and it is surrounded by tiny clouds representing attached fibrils due to some external fibrillation.

We found that with high energy (highly refined) cellulose nanofilaments produced according to method of patent CA2824191 A and other fibrillated fibers produced at lower energy levels their pre-dispersing and water evaporation under the gentle operating refiner conditions can be simultaneously achieved, even after 2-3 passes. The fibers inside the refiner are subjected to minimal stress as the water is being slowly evaporated. When the void left between fiber and its fibrils on water evaporation are being replaced by a portion of a chemical aid injected to pulp in refiner, the effect on fibrous hornification, shrinkage and self-sticking was prevented. This environment also provides the perfect mixing of reactive chemicals or additives with pulp fibrous during pre-dispersing operation. We found also that produced pre-dispersed semi-dry fibrous can be further improved when the pre-dispersed output fiber is agitated in high velocity air flow as this step allow further gentle drying and forming fibrous in to compressed bales, mats or diced pellets. The diced pellets are produced special cutting of compressed mats.

The mechanism of increasing consistency of the pulp while pre-dispersing it by applying a minimum level of energy is based on the following short expression predicting the blow line consistency of a thermomechanical disc refiner initially developed in the article "Predicting the performance of a chip refiner. A constitutive approach", by K. Miles et al., J. Pulp Paper Sci., 19(6): J268-J274, 1993.

$$C_0 = \frac{100\,prod}{\frac{100\,prod}{C_i} + 1.44\ \text{dilutions} - 24000\ \alpha\ mld}, \tag{1}$$

where α is the latent heat at the refiner inlet approximated to a ~2258 kJ. $kg^{-1}$, prod is the pulp production rate in T/D, mld is the motor load in MW, dilutions is the sum of all added dilutions in I/m including liquid chemicals at a given concentration according the desired chemical treatment and, Ci is the pulp consistency entering the refiner.

An important fact about this equation is that, dilutions=water and/or chemical solution. This equation shows that for a given pulp at a given consistency it could be treated to remain at the same consistency by evaporating its water and replacing it by the right liquid chemistry making new pulp moist and almost never dries as the boiling point of those selected chemicals are very high compared to water boiling temperature.

Taking the derivative of $C_0$ in equation (2) with respect to C, leads to:

$$\frac{\partial C_0(t)}{\partial C_i(t)} = \left(\frac{C_0(t)}{C_i(t)}\right)^2, \tag{2}$$

This last equation shows that the blow line consistency will increase almost exponentially if the inlet consistency increases. This can be accomplished through multi-passing the same pulp through the same refiner or through multi-refiners mounted in series at a minimum energy per stage as will be illustrated in the following. In the case of in-feed dilutions set at its minimum value just enough to prevent plugging. The minimal added water is referred to by $dil_{min}$ and if the objective of the refining is just to increase the blow line consistency, which would result in evaporating water from the pulp, then the condition on the specific energy for a given production rate would be that $$\frac{C_0}{C_i} > 1$$

This would lead to the following condition on the minimal energy, $spe_{min}$ required to increase the blow line consistency after each pass $$spe_{min} > 1.44\frac{dil_{min}}{\alpha prod}$$

Where specific energy in kWh/T is given by, $$spe = 24000\frac{mld(MW)}{\text{production}\left(\frac{T}{D}\right)}$$

The benefit of applying minimal energy at wide open plate gap is to disperse the high consistency clumpy pulp making its fibrous separated, de-entangled or loosened. The chemical aids on the fibrous surfaces will further prevent the fibers and their fibrils from collapsing and sticking on each other's during water evaporation. This is achieved due to the fact that at low energy the refiner gap is wider because at a constant production rate the gap is inversely proportional to the specific energy (spe). Considering the very short residence time at a wider plate gap there is no risk of fiber cutting or fiber burning inside the refiner, especially at very high consistency levels. As mentioned before, the gap opening is positively correlated with fiber length.

Figure 8:
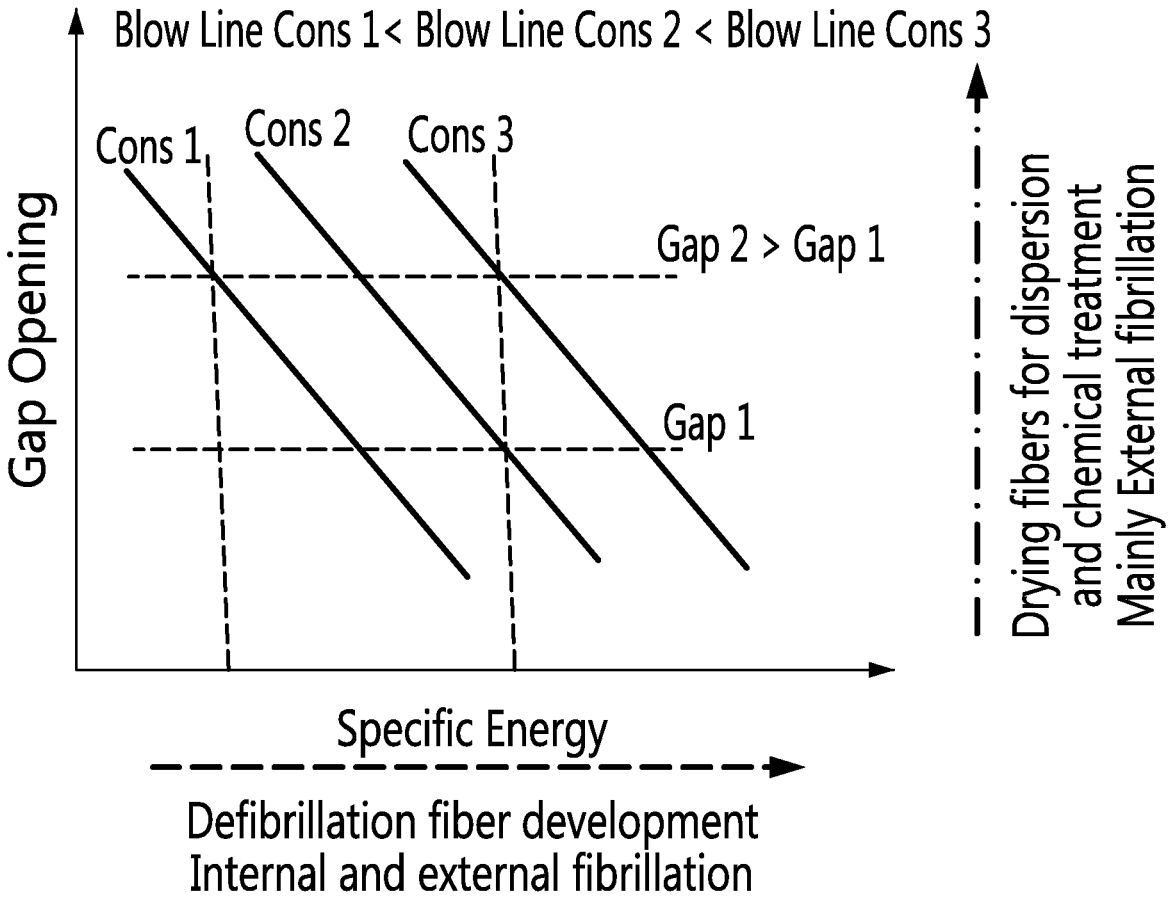
FIG. 8 illustrates a graph of refiner gap opening versus refiner specific energy applied for varying blow line consistencies (outputs) according to embodiments described herein.

According to the present method, the three thermomechanical refiner variables, Gap Opening, Output Blow Line Consistency and the Specific Energy constitute a three-dimension model illustrated in the following FIG. 8. It can be seen that these three parameters can be set for developing fibers, such in traditional high consistency high energy refining of fibers or set to produce pre-dispersed semi-dry individualized fibers. The later can be set to adequately blend fibers with chemicals to further improve pre-dispersing and individualizing semi-dry fibers and developing them with physical and/or chemical properties tailored for numerous specific applications.

In high consistency atmospheric thermomechanical refiners when fiber surfaces rub against each other's, the dissipated frictional energy transforms into heat (thermokinetic energy) and the pulp temperature can rise from room temperature to as high as 100° C. or more in a matter of seconds. The diffused heat into the bulk of fibers turns water within fibers to steam and eventually rapidly evaporates. In conventional high consistency, high energy refining of TMP or SWK fibers water dilution is used to maintain the pulp consistency inside the refiner and after discharge at levels similar to that of the feed inlet pulp solids, such as 30% solids. In the absence of water dilution, the generated frictional heat will rapidly cause pulp de-hydration and its consistency will increase to a certain level as was described earlier. The practice of achieving a very high consistency pre-dispersed fibrous at about 70% from initial pulps of 30 to 60% solids namely TMP or BCTMP is possible and can be desirable for the purpose of the present method. However, the practice of achieving a very high consistency pre-dispersed fibrous at about 70% from processing SWK fibers at starting consistencies 20 to 45%, preferably 30 to 40%, is less desirable for the purpose of the present method, as several refiners will be needed. Furthermore, severe hornification and curling of the kraft fibrous and the potential generation of fines or dust can take place. Yet, for some applications it is desirable to produce pre-dispersed curly or twisted fibers of crosslinked of hydrophobic nature and this can be achieved by processing in presence of desirable chemicals pulps that were previously refined at high consistency to impart curls and micro compressions. Creating curly fibers have been reported in literature as being incidentally created by devices such as plug screw feeders, screw presses, FROTAPULPER™, high consistency pumps and mixers, and twin-screw extruder (Jessica C. Sjöberg and Hans Höglund, Nordic Pulp and Paper Research Journal Vol 22 no. 1/2007). The imparted curls and micro compressions thus will provide pulp fibers with reduced strength, but with increased bulk, tear and stretch.

Furthermore, for other applications it is possible to prevent fibrous hornification and reduce curling during the pre-dispersing operation by using chemical aids. These are achieved when some of the expected amount of water to be evaporated from pulp fibers is replaced by a non-evaporating chemical and/or use of a surface active agent. To be efficient the molecules of the selected chemical should wet or interact with the hydroxyl groups of fiber. For some practical reasons the selected chemical can be preferably be blended with pulp in a stage prior to the pre-dispersing operation, but the best option is injecting the chemical directly into the refiner where immediate and homogeneous mixing takes place. The preferred chemicals should have the ability to wet, absorb and/or bond with pulp fibers and thermally stable under the frictional heat generated in the refiner. As described above, many chemicals or additives can be blended with moist pulp fibrous during pre-dispersing operation in refiner in order to create novel functionalities tailored for the specific applications of the final fibrous material.

EXAMPLES

The following series of examples will describe the application of the present method by illustrating fibrous materials processed by the same.

Example 1

Figure 9:
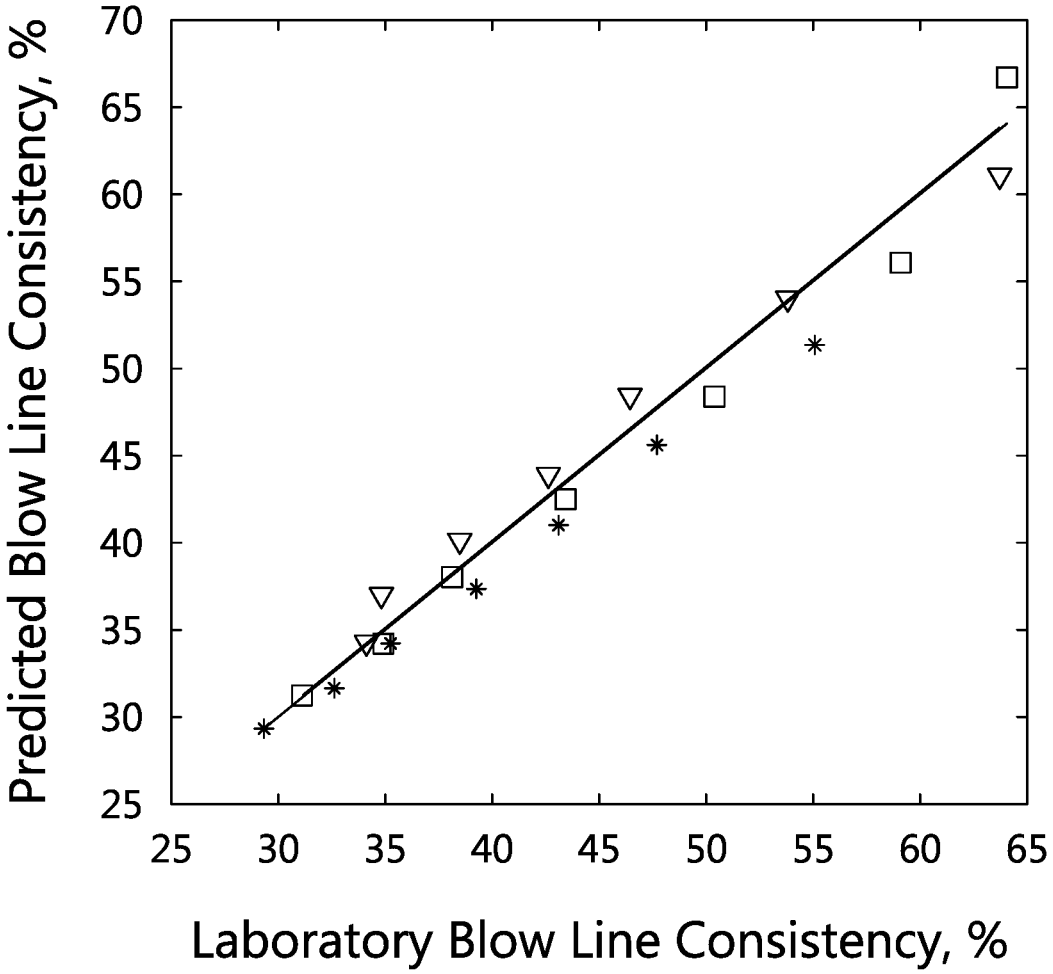
FIG. 9 illustrates a new three-dimensional model/plot of a predicted blow line consistency % laboratory blow line consistency % according to embodiments described herein, specifically three bleached softwood kraft pulps during processing passes in refiner: (+) initial pulp (unrefined), (Δ) pre-refined HCR1 (8,221 kWh/t), (□) pre-refined HCR2 (12,000 kWh/t)

To illustrate the refiner approach of increasing consistency while pre-dispersing and separating and de-entangling fibrous materials three moist high consistency pulps were used as examples. The experiments were performed on the atmospheric Bauer 400 double disc refiner. A dry market kraft pulp fiber of CSF 621 mL, which has 29% solids, is passed several times in an atmospheric disc refiner where for each pass a constant specific energy is applied to the pulp fiber and zero water dilution water was added to refiner. ("CSF stands for Canadian Standard Freeness which is determined in accordance with TAPPI Standard T 227 M-94 (Canadian Standard Method). The same type of experiment was repeated with a bleached softwood kraft pre-refined on the above atmospheric refiner to two high energy levels: HRC1 refined at 8,221 kWh/t and 33.7% solids and HCR2 refined at 12,000 kWh/t and 31.9% solids. The CSF values of both pulps were close to 0 mL. FIG. 9 shows the predicted refiner output consistency versus the measured consistency of samples caused by the increased number of pre-dispersing passes on the same atmospheric refiner. It can be seen that the output pulp consistency of the three pulps increased with the number of passes as predicted by modeling. For each of the three pulps the pre-dispersing (several passes at low energy and open gap) was done as a batch operation using one refiner. In a continuous operation the same pre-dispersing can be done using 2, 3 or more refiners placed in series.

Example 2

Figure 10:
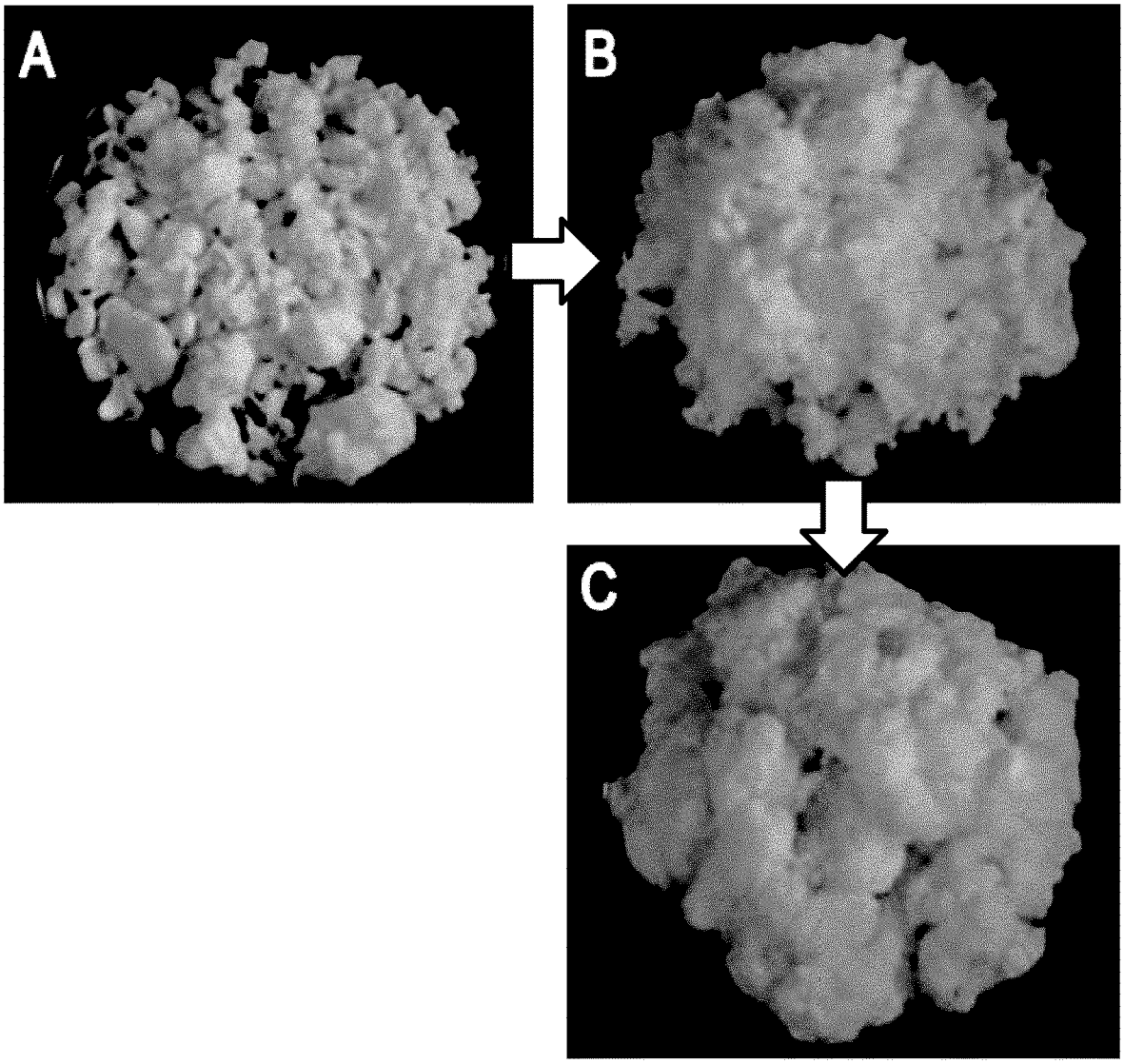
FIG. 10 illustrates three photographs fibers produced according to the method described herein, Sample A, moist clumpy softwood kraft pulp at 29% consistency; sample B after pre-dispersing sample A in a refiner 4 passes under the specific conditions described herein, and C after air drying the pulp of sample B to pulp of sample C, specifically the weight of samples A, B and C was 24 g (based on dry material)—the difference in volume of samples is caused by the simple pre-dispersing in refiner to semi-dry material then by air dispersion to dry separate fibers.

The following photos of FIG. 10 correspond to the bleached softwood kraft pulp (621 mL CSF) of example 1. Photo A corresponds to the initial moist pulp (29% solids), photo B after pre-dispersing it on the refiner 4 passes (semi-dry pulp) under the specific condition of the present method, and the photo C after air drying sample of photo B to 92% consistency. This example clearly demonstrates that the moist clumpy kraft pulp passed in opener refiner turns to pre-dispersed semi-dry and dry pulps where the fibers are largely separated but contains also a small amount of entangled fibers. The level of entangled fibers or knots in pre-dispersed pulp depends on pulp initial or input % solids (by weight) and the final output consistency as well as the level of energy used during each passes pre-dispersing. For instance a softwood kraft pulp input having % solids in the range 60% to 85% will tend to easily turn to pre-dispersed fibers with high level of separated fibers at minimal knot levels, even with one to two passes at the lowest energy levels. However, refiner pre-dispersing of the softwood kraft pulp having consistencies in the range 20% to 60% will tend to turn them to more externally fibrillated fibers with potential of curling of fibrous and creation of loose entanglement. Therefore, for this consistency range and depends on end-use requirements of the pre-dispersed softwood kraft pulp 2 to 4 passes might be required to separate fibrous and eliminate entanglements at a slightly higher energy levels compared to the kraft pulps at high consistency range. The pre-dispersed softwood kraft fibers could be delivered in semi-dry or dry forms or to the desirable consistencies for proper use in several applications, namely for making absorbent nonwoven mats, reinforcement of paper and tissue products, thermoplastic composites and thermoset composites.

Example 3

Figure 11:
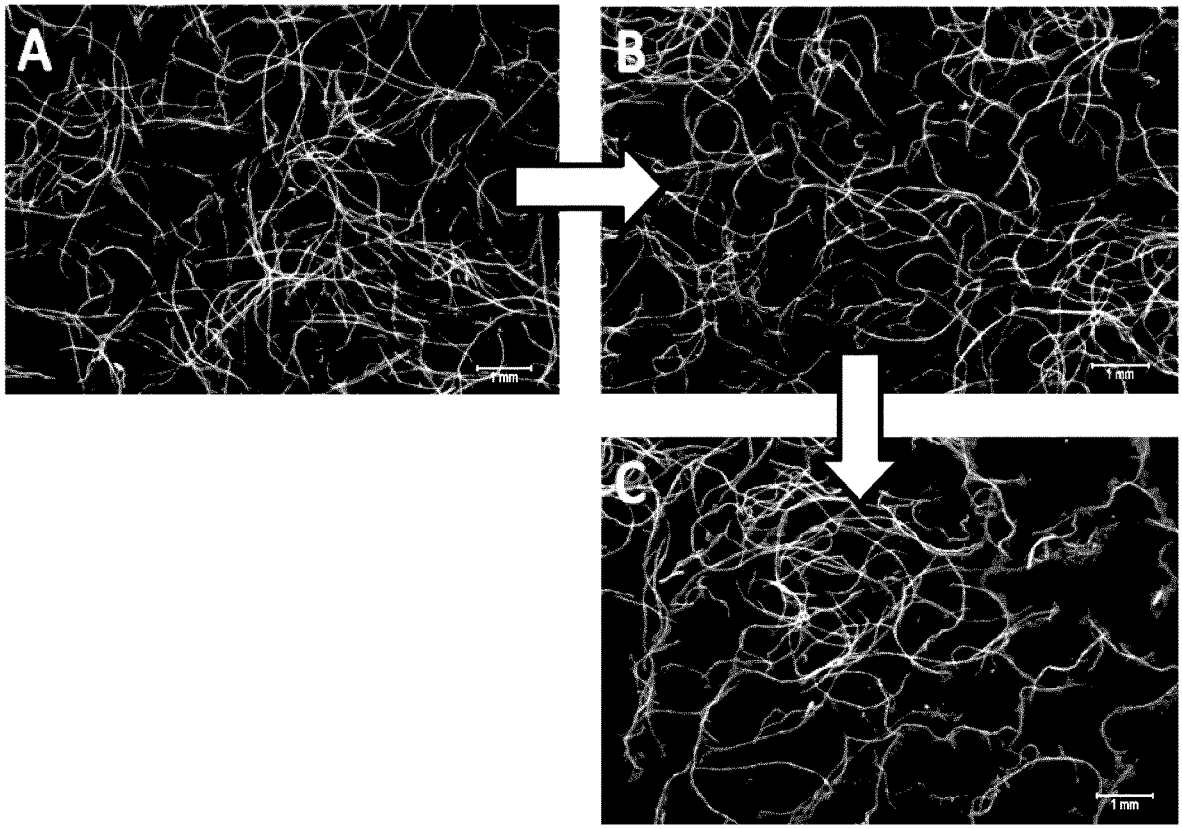
FIG. 11 are three micrographs of images of water disintegrated samples: Sample A is a softwood kraft pulp (29% solids), Samples B and C are pre-dispersed on the refiner 1 pass (33% solids) and 3 passes (39% solids) respectively under the specific conditions described herein.
Figure 12:
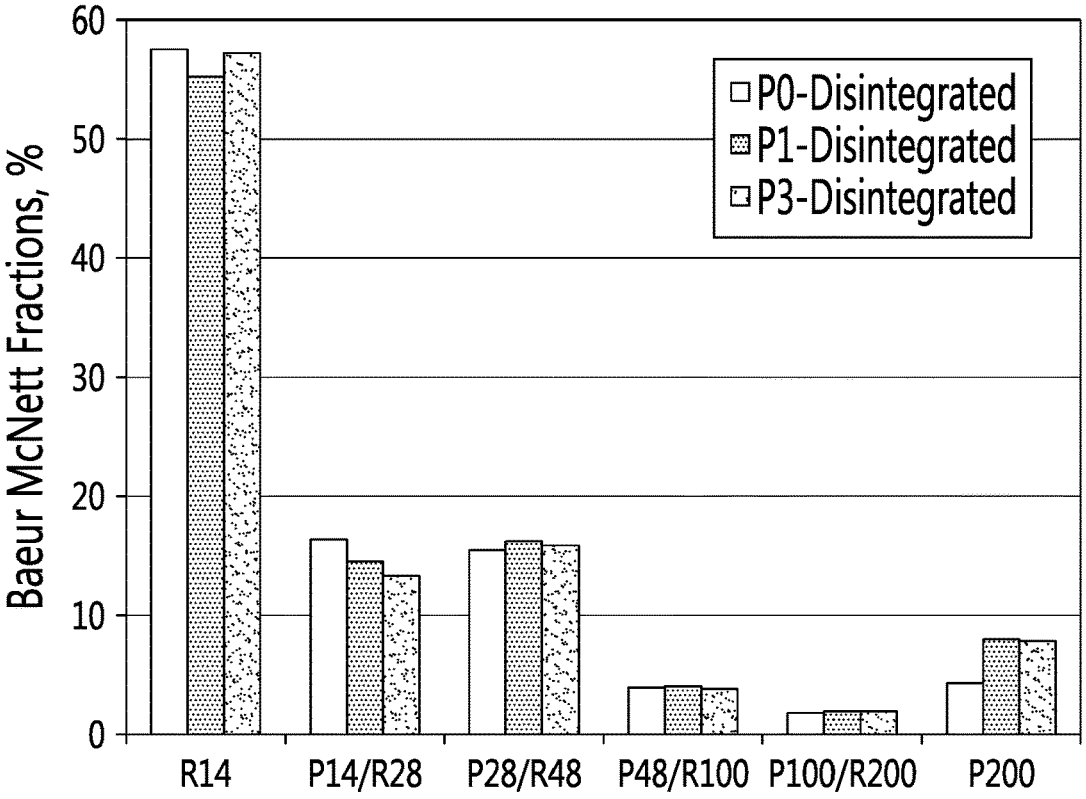
FIG. 12 illustrates a bar chart of Baeur McNett fibrous fractions of water disintegrated samples of example 3 (A, B, C): (P0) moist kraft pulp (29% solids), and (P1) and (P3) are after pre-dispersing them on the refiner 1 pass (33% solids) and 3 passes (39% solids) under the specific conditions described herein.

The following microscopy images of FIG. 11 are from the bleached softwood kraft pulp of example 2, before and after pre-dispersing in refiner. The samples were mixed with deionized water to 1.2% solids then disintegrated in British Standard Disintegrator [TAPPI T-205 & T-218] for 10 minutes. Image A corresponds to the initial moist pulp (29% solids), images B and C are after pre-dispersing them on the refiner 1 pass (33% solids) and 3 passes (39% solids) under the specific condition of the present method. This example clearly demonstrates that on increasing the number of passes in refiner the output pre-dispersed semi-dry fibers are easily dispersible in water and free of fibrous entanglements. FIG. 12 presents the Baeur McNett (B-M) fibrous fractions (T233 cm82) of the same samples of FIG. 11. Details regarding this fiber fractionation method can be found in the Journal of Pulp and Paper Science (VOL. 27 NO. 12 Dec. 2001). Clearly, while pre-dispersing, water evaporation and some external fibrillation and curling of fibers were achieved (B, C), the long fiber of B-M weight fractions were only slightly different from those of the control sample. This is probably due to a combination of minimum cutting of fibers. This means that at some consistency the pre-dispersing at minimal specific energy is an efficient means to achieve some external fibrillation without cutting the length of main fibers as indicated in microscopy image C.

Example 4

Table 1 below presents water retention value (WRV) [Useful Method UM 256 (2011)] and physical properties of sheets made from samples of bleached softwood kraft pulp of example 2 before and after several passes (each pass used 280 kWh/t) in the refiner. Each sample was mixed with deionized water to 1.2% consistency then disintegrated in British Standard Disintegrator [TAPPI T-205 & T-218] for 10 minutes. The sheets were made on a British Sheet Machine (T205 om-88). As the consistency increased with the number of passes from P1 to P3 there was a gradual decrease in freeness of pre-dispersed pulp and a similar trend of gradual increase in WRV. Then freeness started to increase and WRV to decrease from P4 to P5 to P6 as consistency further increased. All the other properties tensile strength, bulk and porosity tend to correlate well with the changes in freeness and water retention value. This means that by optimizing high consistency refining technique at minimal specific energy levels and wide open gap it becomes possible to produce in an efficient way pre-dispersed semi-dry fibrous of externally fibrillated form without significantly changing fiber length and thus achieving sheet with high tensile, stretch and tensile energy absorption without significantly impairing bulk.

TABLE 1

Solids content, CSF, WRV and physical properties of sheets made from disintegrated softwood kraft pulp samples before and after pre-dispersing on refiner.

| Sample | Solids, % | CSF, mL | WRV, g/g | Breaking length, km | TEAindex, mJ/g | Porosity PPS, mL/min | Bulk, $cm^3/g$ |
|---|---|---|---|---|---|---|---|
| P0 | 29.3 | 621 | 0.910 | 3.5 | 973 | 1862 | 1.992 |
| P1 | 32.7 | 476 | 1.350 | 5.7 | 2412 | 470 | 1.647 |
| P2 | 35.3 | 343 | 1.566 | 6.7 | 3273 | 157 | 1.579 |
| P3 | 39.3 | 254 | 1.850 | 6.2 | 3286 | 59 | 1.571 |
| P4 | 43.1 | 265 | 1.806 | 5.7 | 3079 | 60 | 1.598 |
| P5 | 47.8 | 279 | 1.785 | 5.3 | 2891 | 109 | 1.751 |
| P6 | 55.1 | 392 | 1.392 | 4.4 | 2365 | 891 | 2.249 |

Example 5

Figure 13:
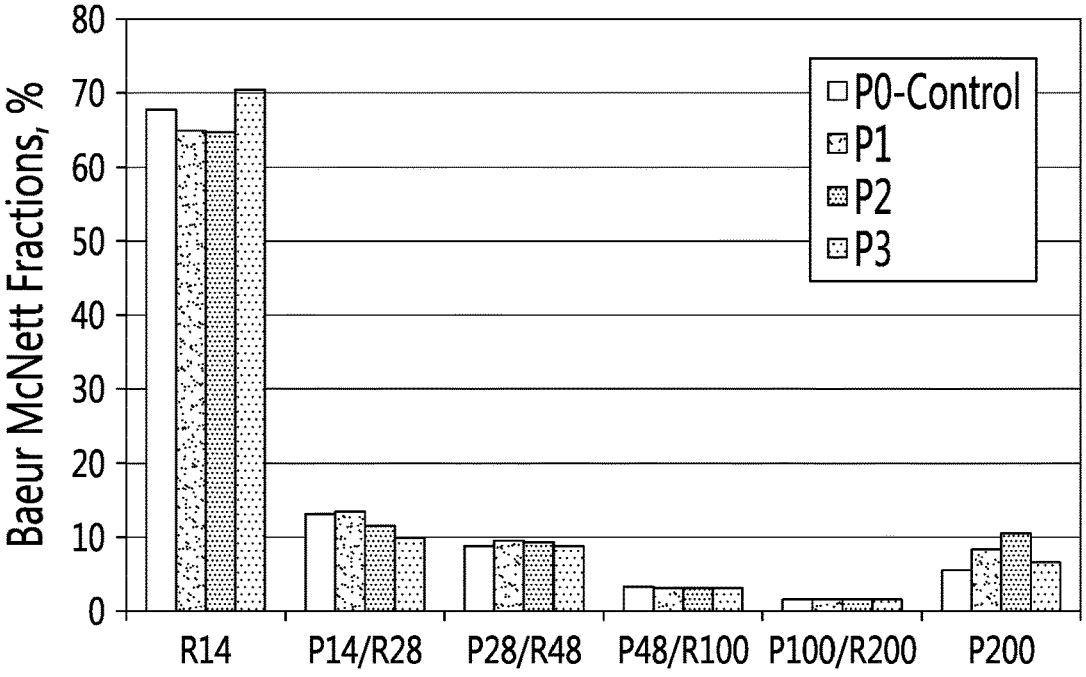
FIG. 13 illustrates a bar chart of Baeur McNett fiber fractions of disintegrated samples (P0-control, P1, P2 and P3): P0 (re-slushed from lap sheet, 39.2% solids), and P0 pre-dispersed to samples P1, P2 and P3) under the specific condition described herein, specifically all samples were diluted in water to 1.2% consistency and disintegrated in the standard British disintegrator for 10 minutes.

Table 2 below presents consistency, freeness, WRV and physical properties of sheets made from samples of bleached softwood market kraft pulp before and after three passes of pre-dispersing in the refiner. This example is similar to example 4, except that the pulp was from another source and its starting was 39% solids, and the average energy used for each pass in the refiner for pre-dispersing was 120 kWh/t. The pulp samples were mixed with deionized water to 1.2% consistency then disintegrated in British Standard Disintegrator [TAPPI T-205 & T-218] for 10 minutes. Compared to the control sample the disintegration of pre-dispersed samples was excellent for P1, P2 and P3. As the consistency increased with the number of passes from P1 to P3 there was a gradual initial decrease in freeness. Then freeness increased slightly and WRV decrease for P2 and P3 as consistency of pre-dispersed pulp further increased. When P3 was further disintegrated in Waring™ Blender (Waring™ Pro MX1000R, 120 VAC 13 amp. motor, maximum no load speed up to 30,000 rpm) for one minute the properties improved due to better fiber hydration and dispersion. All the other properties such as tensile strength, bulk and porosity tend to correlate well with the changes in freeness and water retention value. The Baeur McNett fiber fractions of the disintegrated pre-dispersed semi-dry samples P0-control pulp and P1, P2 and P3 are presented in FIG. 13. These results are quite similar to those reported example 4.

TABLE 2

Solids content, CSF, WRV and physical properties of sheets made from water disintegrated softwood kraft pulp samples before and after pre-dispersing on the refiner.

| Sample | Solids, % | CSF, mL | WRV, g/g | Breaking length, km | $TEA_{index}$, mJ/g | Porosity PPS, mL/min | Bulk, m3/g |
|---|---|---|---|---|---|---|---|
| Po—control | 39.2 | 658 | 0.822 | 2.89 | 776 | 2674 | 1.945 |
| P1—Disintegrated | 40.02 | 540 | 1.194 | 5.74 | 2357 | 1488 | 1.659 |
| P2—Disintegrated | 52.6 | 596 | 1.015 | 5.23 | 2216 | 2078 | 1.701 |
| P3—Disintegrated | 56.3 | 582 | 1.005 | 4.72 | 1988 | 2214 | 2.067 |
| P3—Disintegrated + 1 min blender | 56.3 | 550 | 1.185 | 5.32 | 2031 | 1603 | 1.694 |

Example 6

Figure 14:
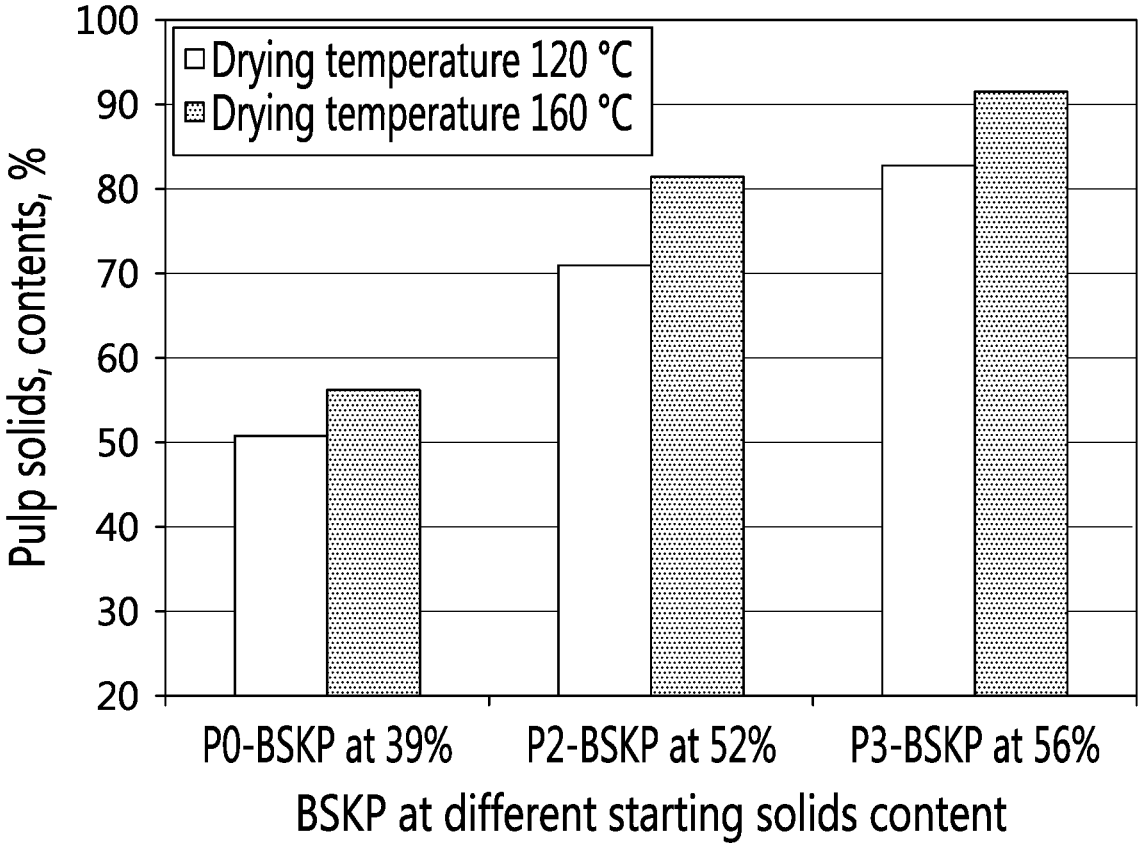
FIG. 14 illustrates a bar chart of pulp solids content after one pass drying in a pilot flash dryer at two set temperatures of 120 and 160° C. according to the method described herein.

FIG. 14 presents the effect of initial pulp % solids on final pre-dispersed fibrous material consistency after one pass on a pilot flash dryer commonly used to dry MDF thermomechanical fibers. The initial pulp samples P0, P2 and P3 of bleached softwood kraft pulp (BSWK) are the same to those in table 2 of example 5. The operating heating temperature of this flash dryer (production rate of 40 kg/h OD fiber) is usually around 90° C.-120° C. and the outlet fiber temperature is around 90° C. The residence time for one pass of the fiber in the drying tube is around 2.5 sec. However, other moisture targets for one pass can be achieved by adjusting the heating temperature. For our experiment we used two set of operating temperatures of 120° C. and 160° C. The trial data clearly show that pre-pre-dispersing of BSKW fiber in the disc refiner to higher consistencies is an efficient way to dry it faster. This result also means that a level of energy used to pre-disperse the pulp fibers to high consistencies will be compensated for by the lower energy used to dry the pulp in the flash dryer in one pass.

The pulp samples (P0, P2 and P3) before and after their drying one pass at 160° C. were mixed with deionized water to 1.2% consistency then disintegrated in British Standard Disintegrator [TAPPI T-205 & T-218] for 5 minutes. The pulp slurries were then used to make sheets of 60 $g/m^2$. The sheet properties in Table 3 show that as the consistency is increased by one pass flash drying there was a small drop in the freeness compared to the control samples. On flash drying there was some loss in the strength properties and an increase in bulk when comparing to the control semi-dry samples. The high loss in strength properties was measured with the more semi-dried samples. This result suggests that drying fibrillated fibers can be detrimental on strength paper strength due to fibrous hornification. Based on the results of Table 2 of example 5 the loss in strength properties on flash drying seen in Table 3 can be regained by applying more shear during disintegration in water.

TABLE 3

Pulp solids content, Canadian standard freeness (CSF) and sheet properties of BSWK samples before and after one pass drying in a pilot flash dryer at two set temperatures of 120 and 160 deg. C.

| Sample | Solids, % | CSF, mL | Stretch to break, % | Breaking length, km | $TEA_{index}$, mJ/g | Bulk, m3/g |
|---|---|---|---|---|---|---|
| Po—control | 39.2 | 658 | 3.80 | 2.89 | 776 | 1.945 |
| P0—dried at 160 deg. C. | 56.3 | 660 | 4.16 | 2.96 | 809 | 1.967 |
| P2—control | 52.6 | 596 | 6.38 | 5.23 | 2216 | 1.701 |
| P2—dried at 160 deg. C. | 81.5 | 587 | 6.60 | 3.60 | 1473 | 2.086 |
| P3—control | 56.3 | 582 | 5.75 | 4.72 | 1988 | 2.067 |
| P3—dried at 160 deg. C. | 91.5 | 565 | 6.04 | 3.28 | 1199 | 2.294 |

Example 7

Table 4 below presents consistency, freeness, and physical properties of sheets made from samples of bleached softwood market kraft pulp before and after five passes of pre-dispersing in the refiner. This example is similar to examples 4 and 5, except that the kraft pulp was from another source and was pre-dispersed at starting consistency of 50%. The average energy used for each pass on the refiner was in the range of 80 to 90 kWh/t. The dry lap sheets of kraft were first shredded to 4 to 20 $cm^2$ pieces then introduced to the refiner and a measured amount of dilution water was used in the first opening pass to achieve about 50% solids. As the number of passes in refiner increased the solids content of output samples increased. The pre-dispersed semi-dry pulps contain mostly separated fibers and the number of entangled fibers decreased as the number of passes increased. These pulp samples were mixed with deionized water to 1.2% consistency then disintegrated in British Standard Disintegrator [TAPPI T-205 & T-218] for 10 minutes. Sample 0P corresponds to the original shredded kraft sheet pieces, and samples 1P to 5P are after pre-dispersing the 0P on the refiner 1 to 5 passes under the specific condition of the present method. All samples disintegrated well in water and were free of entanglements. As the consistency increased with the number of passes from 1P to 5P there was a small decrease in freeness, but after 3P the freeness tended to slightly increase. The water dispersed samples were used to make handsheets. All sheet properties such as bond strength, tensile strength, tear resistance, porosity tend to correlate well with the changes in sheet bulk caused by pulp development and water evaporation on refiner. The changes in Baeur-McNett values of the water disintegrated samples 0P to 5P were only slightly different to those of examples 4 and 5 where the input consistency of pulps was 29 and 39%; in this example the input consistency was 50%.

TABLE 4

Solids content, CSF, WRV and physical properties of sheets made from water disintegrated softwood kraft pulp samples before and after pre-dispersing on the refiner.

| Sample | Solids, % | CSF, mL | B.L., km | Stretch, % | TEA index, mJ/g | Tear index, mNm2/g | Scott bond, J/$m^2$ | Bulk, $cm^3$/g |
|---|---|---|---|---|---|---|---|---|
| 0P—Control | 50.0 | 645 | 3.19 | 2.98 | 631 | 19.78 | 111 | 1.87 |
| 1P | 51.1 | 630 | 3.32 | 3.44 | 773 | 21.86 | 112 | 1.99 |
| 2P | 51.6 | 573 | 4.25 | 4.87 | 1439 | 24.23 | 203 | 1.78 |
| 3P | 58.1 | 502 | 4.55 | 5.37 | 1665 | 22.8 | 288 | 1.71 |
| 4P | 63.5 | 525 | 3.19 | 5.71 | 1287 | 21.86 | 263 | 2.08 |
| 5P | 69.4 | 538 | 2.56 | 6.08 | 1134 | 19.59 | 250 | 2.69 |

Example 8

Figure 15:
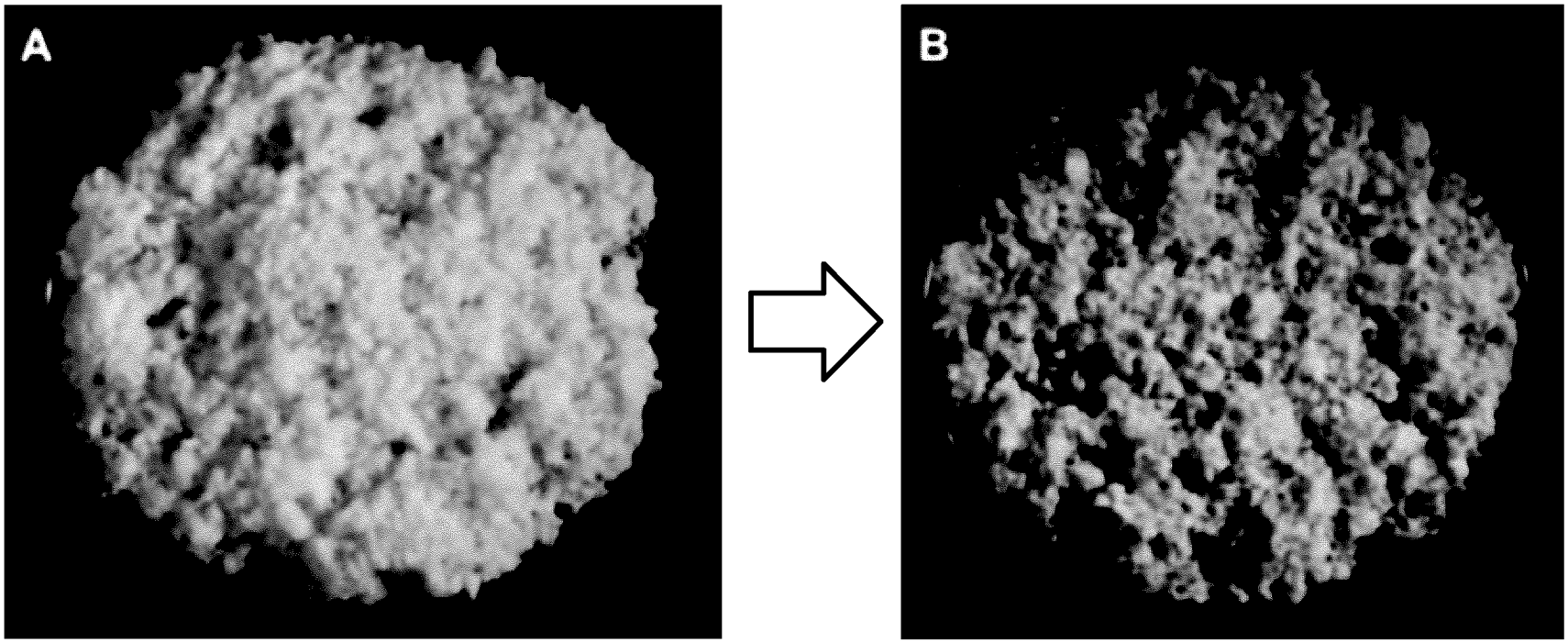
FIG. 15 illustrates photographs showing the high energy pulp HCR1 after discharge from the pilot scale disc refiner at 32% consistency (A) and after being air dried (B) where the weight of samples A and B was 24 g (based on dry material)

The following photos of FIG. 15 show samples of a refined pulp HCR1 (A) pre-refined high consistency softwood kraft pulp (8,221 kWh/t) and after letting it to air dry (B). This example clearly demonstrates that on water evaporation by simple air drying, without any pre-dispersing in refiner, the pulp turned into dense solid clumpy material (B) where the fibrous are collapsed and self-stuck on each other and thus are very difficult to disintegrate in in water using standard disintegrators. They can however be disintegrated we difficulty by soaking them in hot water and/or increasing pH to alkaline and using high shear mixers or low to medium consistency refiners, but the pulp slurry may still contain entangled fibrous. Never-been dried sample (A) can be disintegrated in water using the standard British laboratory disintegrator (T205sp-95) but the pulp slurry will also still contain entanglements. Some additional energy, such as using high shear mixing equipment or low consistency refiners, is thus necessary to break down some of the large knots and achieve full performance in the intended applications.

Example 9

Figure 16:
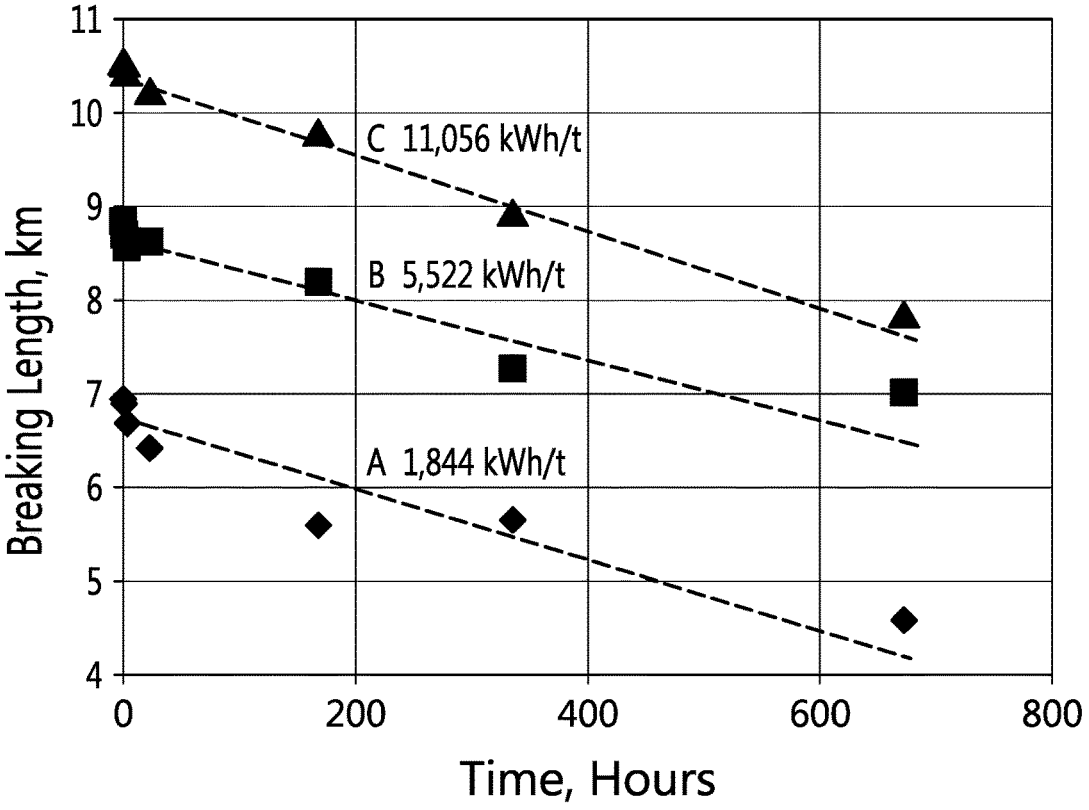
FIG. 16 illustrates a graph of breaking length (km) versus time (hours) showing the effect of aging time on strength of high consistency refined bleached softwood kraft pulp samples where refining energy levels of samples: A 1,844 kWh/t, B 5,522 kWh/t, and C 11,056 kWh/t.

A BSWK pulp was refined on HCR multiple passes to total energy levels of: (A) 1,844 kWh/t, (B) 5,522 kWh/t and (C) 11,056 kWh/t. The equivalent solids content of output samples was 29%, 30% and 27%. Each of the three samples was divided into several 48 g samples and stored in sealed plastic bags at room temperature (RT) for different ageing periods of maximum 4 days. The solids content of the aged samples was maintained constant because of putting the fresh samples in tight plastic bags. After the desired ageing times the samples were disintegrated in the standard British disintegrator for (1.2% Cs, 10 min). The disintegrated pulps were used to make handsheets under same conditions. FIG. 16 shows that the tensile strength of the sheets decreased almost linearly as the samples aged over time despite car was take to avoid water evaporation during their storage. After 4 days ageing the loss in tensile ranged between 25 and 30%, almost independently of the refining energy level. Other samples right after their output from refiner (a period of less than 15 min) were also disintegrated in the British disintegrator (1.2% Cs, 10 min). The samples were divided into two portions, one was immediately used to make handsheets and the other was thickened to about 20% solids then left to age in sealed plastic bags for 58 days. After this period, the pulps were re-disintegrated again (1.2% Cs, 10 min) and used to make handsheets. The tensile strength of the rapidly disintegrated samples and those disintegrated samples thickened and aged have practically the same values. Thus an immediate disintegration of the high consistency, high energy refined kraft pulps, can eliminate the negative effect of ageing as long as the disintegrated pulp is maintained at low consistency, thickened to any consistency or made into sheets. This phenomenon is similar to the well-known latency removal practiced when producing high consistency refined thermomechanical TMP. Rapid dilution of the refined TMP and mixing in a latency chest is always required to straighten the fibers for boosting strength of paper. These results suggest that high consistency softwood kraft pulp, refined to any energy level, if aged it will lose significant value of its reinforcement potential. This reinforcement value can be regained by an additional dispersion under high shear for a period of time such as in low consistency refiner.

TABLE 5

Changes in sheet properties of sheets made from disintegrated high energy refined softwood kraft pulp samples pulps aged 14 days and air dried to 50 and 90% solids contents.

| | Stretch, % | Breaking Length, km | $TEA_{index}$, mJ/g | PPS Porosity, mL/min | Bulk, $cm^3/g$ |
|---|---|---|---|---|---|
| BSWK-unrefined | 1.999 | 2.10 | 312.04 | 2434 | 2.339 |
| Energy: 1,844 kWh/t | | | | | |
| 15 min ageing at 29% solids, St. disint. | 6.967 | 6.93 | 3100 | 68 | 1.993 |
| 14 days ageing at 29% solids, St. disint. | 6.022 | 5.63 | 2479 | 63 | 1.893 |
| 14 days ageing + dried to 50% solids, St. disint. | 5.613 | 5.50 | 2259 | 98 | 2.485 |
| 14 days ageing + air dried to 90% solids, St. disint. | 5.583 | 4.57 | 1933 | 142 | 2.598 |
| Energy: 5,522 kWh/t | | | | | |
| 15 min ageing at 30% solids, St. disint. | 8.071 | 8.85 | 4719 | 2 | 1.638 |
| 14 days ageing at 30% solids, St. disint. | 11.014 | 7.29 | 4229 | 2 | 1.572 |
| 14 days ageing + dried to 50% solids, disint. | 7.708 | 7.45 | 3895 | 5 | 2.620 |
| 14 days ageing + air dried to 90% solids, St. disint. | 6.075 | 4.61 | 2271 | 4 | 2.507 |
| Energy: 11,056 kWh/t | | | | | |
| 15 min ageing at 27% solids, St. disint. | 8.377 | 10.55 | 6073 | 2 | 1.682 |
| 14 days ageing at 27% solids, St. disint. | 9.502 | 8.92 | 4946 | 2 | 1.678 |
| 14 days ageing + dried to 50% solids, disint. | 6.796 | 5.83 | 3277 | 4 | 2.391 |
| 14 days ageing + air dried to 90% solids, St. disint. | 2.690 | 2.99 | 585 | 7 | 3.018 |

Example 9

Figure 17:
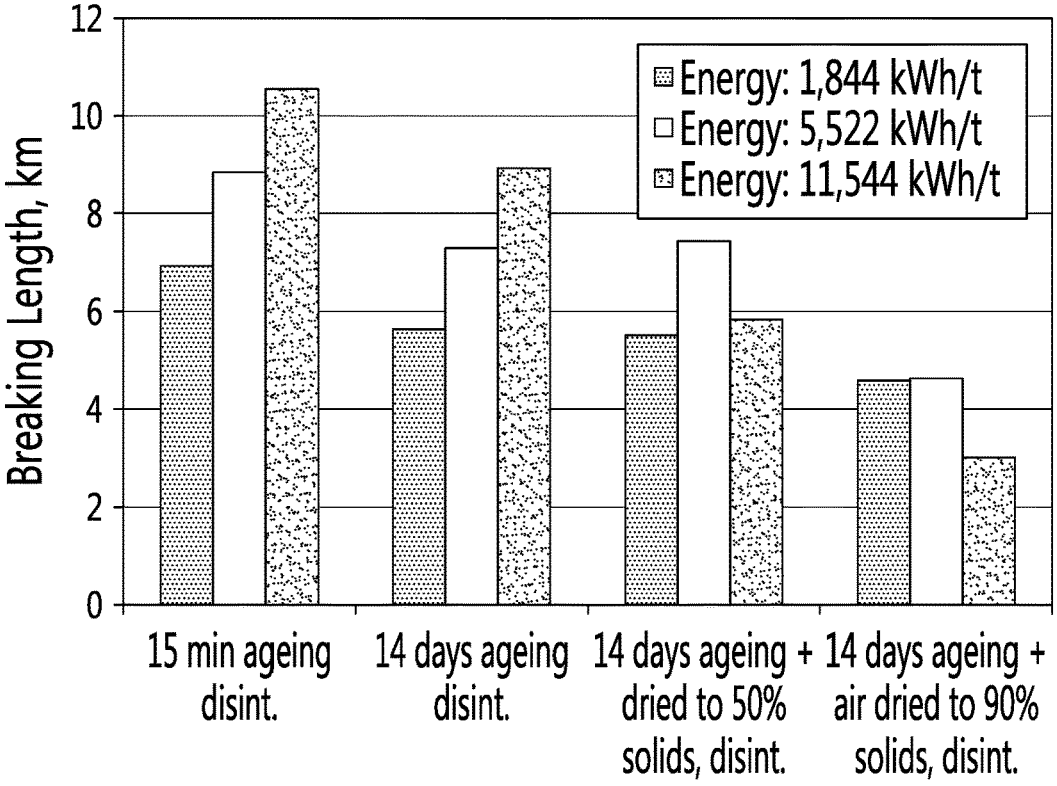
FIG. 17 illustrates a bar chart of changes in tensile strength of sheets made from disintegrated high energy refined softwood kraft pulp samples aged 14 days at constant moisture and air dried to 50 and 90% solids contents.

This example is a continuation of example 8. After 14 days ageing of HCR samples (A 1,844 kWh/t, B 5,522 kWh/t, and C 11,056 kWh/t) in sealed plastic bags at RT, without changes in their initial consistencies (29%, 30%, 27%), they were each air dried to 50% and 90% solids contents. The air dried samples were then disintegrated in the standard British disintegrator for (1.2% Cs, 10 min) and handsheets were produced for testing. The effect of air drying samples resulted in substantial changes in pulp and sheet properties. The pulp fibrous turned to very solids material greatly difficult to adequately disperse in water under the standard disintegration conditions and as a consequence the sheets became weaker and bulkier (Table 5). The slurries of disintegrated air dried samples have large number of entangled fibrous aggregates, especially with high energy refined samples B and C. The change in tensile strength of the three energy level samples is illustrated in FIG. 17. Aging of samples for 14 days without loss of moisture caused a reduction in tensile strength, but when air drying them to 50% and 90% consistency the loss in tensile strength was more severe. The loss was more dramatic for the higher energy refined sample C. For instance, air drying samples A, B and C to 90% solids caused a reduction in their tensile strength by 34%, 47% and 72% when comparing to their initial tensile strengths measured after 15 min pulp ageing only. As will be shown in the next examples this negative impact of drying highly refined pulps can be solved by combining hot water soaking and high shear mixing of dried pulps or by preventing it using selected chemical aids introduced to initial pulps prior to their drying.

Example 10

Figure 18:
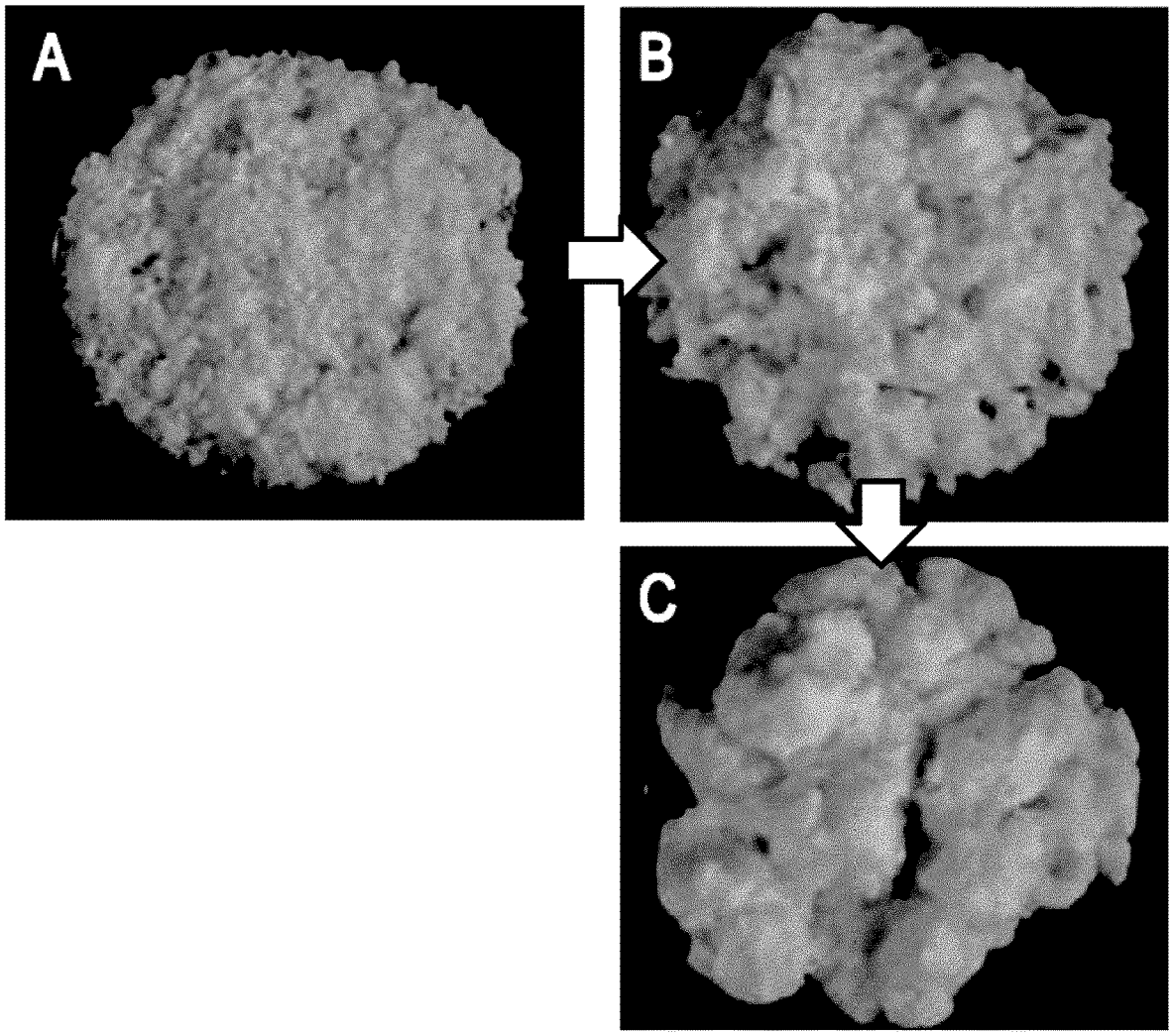
FIG. 18 illustrates photographs showing the high energy refined pulp HCR1 (8,221 kWh/t) after discharge from the pilot scale disc refiner (A), after pre-dispersing it on the same refiner 3 passes under the specific condition of the present method (B), and after air drying this 3 passes sample (C), where the weight of each of samples A, B and C was 24 g (based on dry material)

The following photos of FIG. 18 show the high energy refined softwood kraft HCR1 (8,221 kWh/t) as it is discharged from the pilot scale refiner at 32% consistency, and after pre-dispersing it on the same refiner three passes under the specific conditions of the method described herein, and after air drying the pre-dispersed sample. Photo A corresponds to the original discharge moist sample, photo B represents the semi-dry sample pre-dispersed in disc refiner, and photo C is that after air drying the pre-dispersed sample of photo B. This example clearly demonstrates that on water evaporation during pre-dispersing in the refiner the high energy pulp will turn to semi-dry material where the fibrous are mostly de-entangled and separated from each other's.

Example 11

Figure 19:
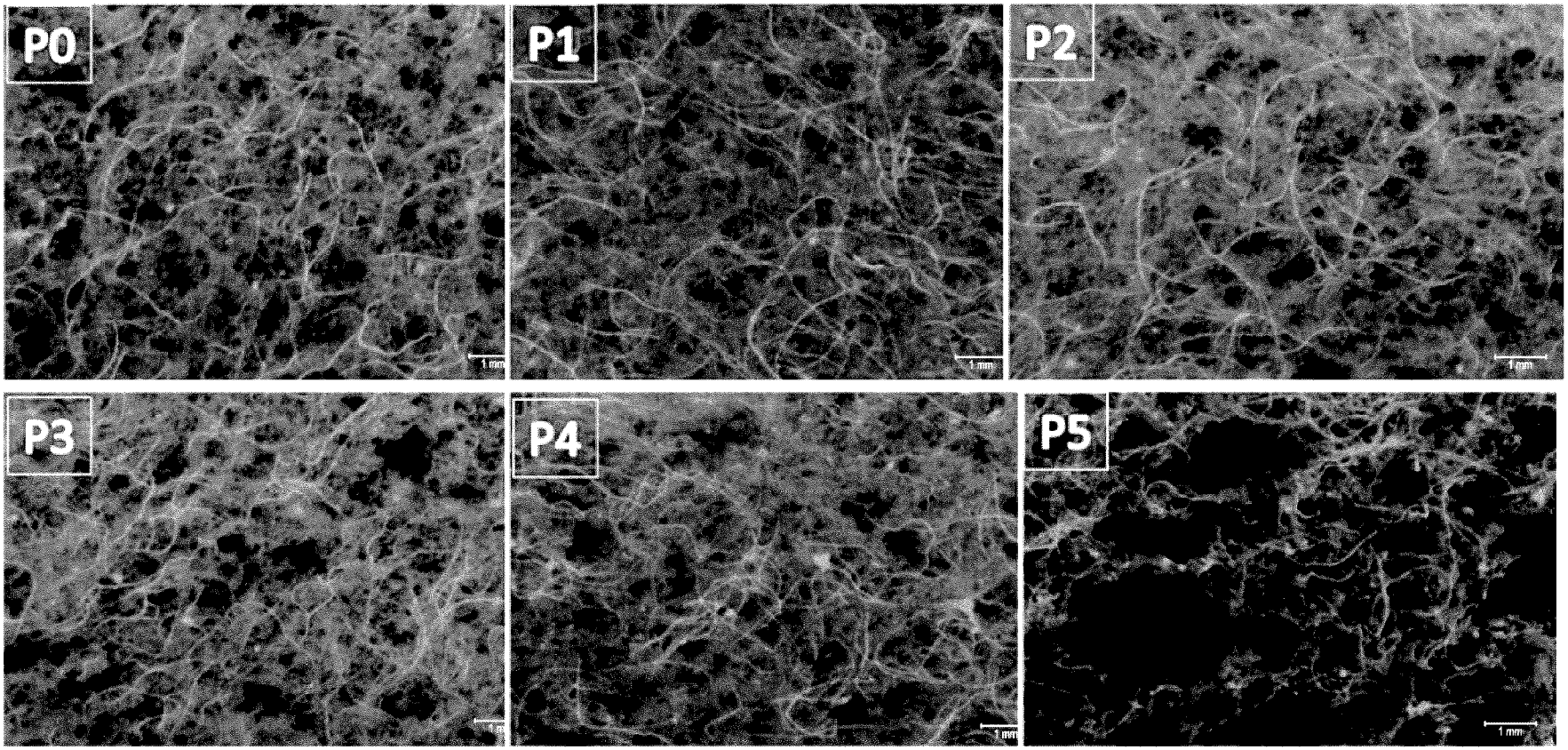
FIG. 19 illustrates a six optical micrographs images of refined pulp HCR1 of example 10-no pass on refiner (P0) and pre-dispersed semi-dry samples P1 to P5.

The following optical Microscopy images of FIG. 19 correspond to the high energy refined pulp HCR1 (8,221 kWh/t), as it is discharged from the pilot scale disc refiner and, after pre-dispersing it on the same refiner different passes under the specific conditions of the present method. Before taking the images the samples (P0 to P5) were first mixed with deionized water to 1.2% consistency then disintegrated in British Standard Disintegrator [TAPPI T-205 & T-218] for 10 minutes. The microscope images were taken after the samples were further diluted to 0.05% consistency and dried on glass plates. Image P0 corresponds to original moist high energy sample before any pre-dispersing; images P1 to P5 correspond to the number of pre-dispersing passes 1 to 5. This example clearly demonstrates that on water evaporation during pre-dispersing as the number of passes increases from 1 to 4 the pulp disintegration in water improved, however after P4 the disintegrated samples start showing some fibrous networks as seen from images P5.

Example 12

Figure 20:
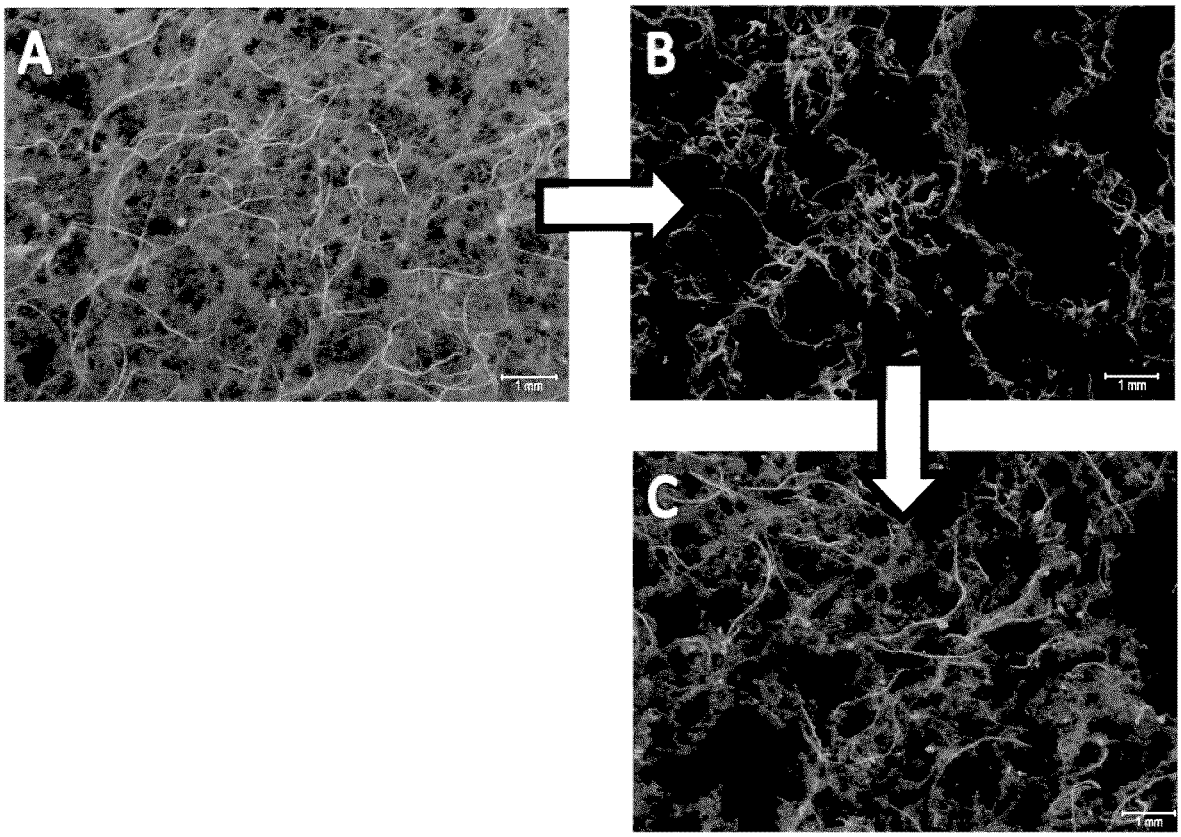
FIG. 20 illustrates 3 optical micrographs of refined pulp HCR1 (8,221 kWh/t)—no pass on refiner A (P0), refiner pre-dispersed B (P6), and C corresponds to P6 after being further water disintegrated in a Waring Blender.
Figure 21:
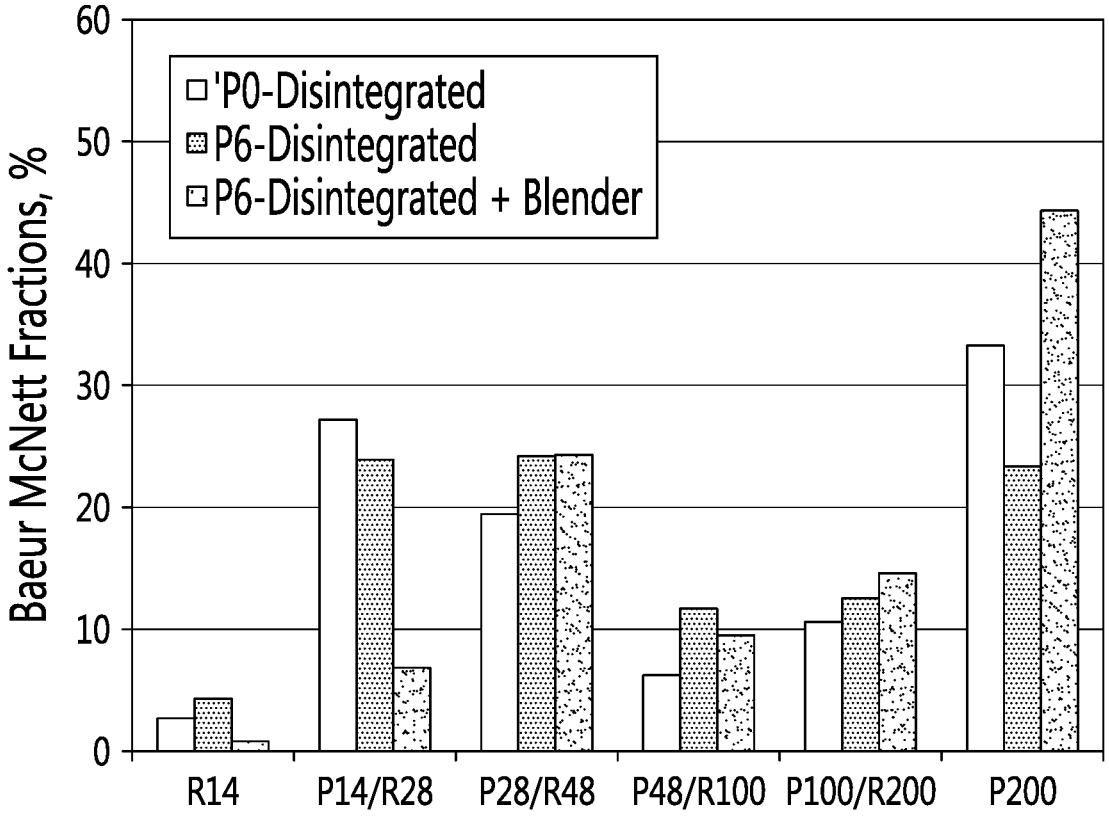
FIG. 21 illustrates a bar chart of percent weight of Bauer-McNett fractions of disintegrated high energy pulp HCR1 (8,221 kWh/t)-no pass on refiner A (P0), 6 passes on refiner B (P6), and C corresponds to P6 after being further water disintegrated in a Waring Blender.

The following optical Microscopy images of FIG. 20 correspond to the high energy pulp sample HCR1 (8,221 kWh/t), as it is discharged from the pilot scale disc refiner then water disintegrated and, the semi-dry sample after six passes pre-dispersing in refiner then water disintegrated. Images A and B correspond to original sample before any pre-dispersing and after 6 passes pre-dispersing in refiner, respectively, whereas C corresponds to P6 after being further water disintegrated for 5 min in a Waring Blender (Waring Pro MX1000R, 120 VAC 13-amp motor, Maximum no load speed up to 30,000 rpm). The disintegrated B (P6) sample shows networks of fibrous elements. However, by applying some additional shear to disintegrate B (P6) sample (by mixing in Waring Blender for 5 min) the network fibrous elements were separated and straightened as seen in image C. FIG. 21 presents the percent weight of different fiber size fractions of samples A, B and C as determined by the standard Baeur-McNett method (T233 cm82). This method is used here as an efficient way to compare samples processed before and after their pre-dispersing in the refiner. Because after 6 passes pre-dispersing the consistency significantly increased, and due to some cellulose hornification and formation of network fibrous elements the amount of fines fraction dropped and the large fractions, which normally correspond to individualized long fibers or fibrous aggregates, increased. However, on applying some additional shear during water disintegration these network fibrous elements disappeared and as can be seen in FIG. 21 the amount of fines increased. The fines fractions are slightly higher than in that of P0 sample due to some fibrillation and released fines during the several pre-dispersing passes in refiner. This means that the pre-dispersed hornificated fibrous could be disintegrated by soaking the material in hot water then applying some shear such as in low consistency refiner.

Example 13

Table 6 presents solids content, WRV and physical properties of sheets of samples before and after pre-dispersing corresponding to example 12. The sheets were made on a British Sheet Machine (T205 om-88) using pulp samples after their mixing with deionized water to 1.2% consistency then disintegrated in British Standard Disintegrator [TAPPI T-205 & T-218] for 10 minutes, and after further disintegration of sample P6 in a Waring™ Blender for periods of 2 and 5 minutes. The increase of consistency on pre-dispersing had two simultaneous opposite effects on pulp properties: opening and loosening entangled fibers of clumpy pulp an increasing hornification. The WRV of pulps decreased slowly as the consistency of P0 to P4 increased then at P5 and P6 where the consistency sharply increased the WRV dropped significantly due to fibrous hornification. The drop in the strength properties correlates well with the drop in WRV and the sheets of P6 sample were several times weaker than the control sample P0. The same trend was also measured with bulk and light scattering coefficient of sheets. The increase in bulk and light scattering coefficient suggest that the sheets made from water disintegrated pre-dispersed fibrous are de-bonded. However, when this sample P6 was further disintegrated in the Waring™ blender for 2 and 5 minutes (P6b) the values of WRV, tensile strength, bulk and light scattering coefficient were all almost similar to those values of P0. The network fibrous elements could have benefits in some products such as imparting bulk for paper and create porous fiber structures for absorbent and filtration products.

As can be seen from the next examples the negative consequences on WRV of fibrillated fibers caused during water evaporation on pre-dispersing in refiner can be restored by using some additional shearing energy during pulp disintegration in water or prevented by treatment of moist pulps with chemicals prior to the pre-dispersing operation, as will be shown later.

TABLE 6

Solids content, WRV and physical properties of sheets made from samples water disintegrated only and samples water disintegrated + warring blender.

| Sample | Solids content, % | WRV, g/g | Breaking length, km | $TEA_{index}$, mJ/g | Bulk, $cm^3/g$ | Light. Scatt, Coef., $m^2/kg$ |
|---|---|---|---|---|---|---|
| P0—Disintegrated | 31.9 | 2.613 | 10.82 | 6655 | 1.546 | 6.9 |
| P1—Disintegrated | 34.9 | 2.419 | 10.57 | 7271 | 1.497 | 5.8 |
| P2—Disintegrated | 38.5 | 2.327 | 9.82 | 5893 | 1.068 | 6.5 |
| P3—Disintegrated | 42.7 | 2.269 | 8.59 | 5868 | 1.628 | 6.3 |
| P4—Disintegrated | 46.5 | 2.182 | 7.06 | 3995 | 1.839 | 7.2 |
| P5—Disintegrated | 53.9 | 1.870 | 5.31 | 2814 | 1.876 | 11.0 |
| P6—Disintegrated | 63.8 | 1.417 | 2.51 | 673 | 2.249 | 25.2 |
| P6b—Disintegrated + 2 min in blender | 63.8 | 2.418 | 9.57 | 7042 | 1.547 | 6.5 |
| P6b—Disintegrated + 5 min in blender | 63.8 | 3.037 | 10.43 | 7099 | 1.412 | 6.7 |

Example 14

Figure 22:
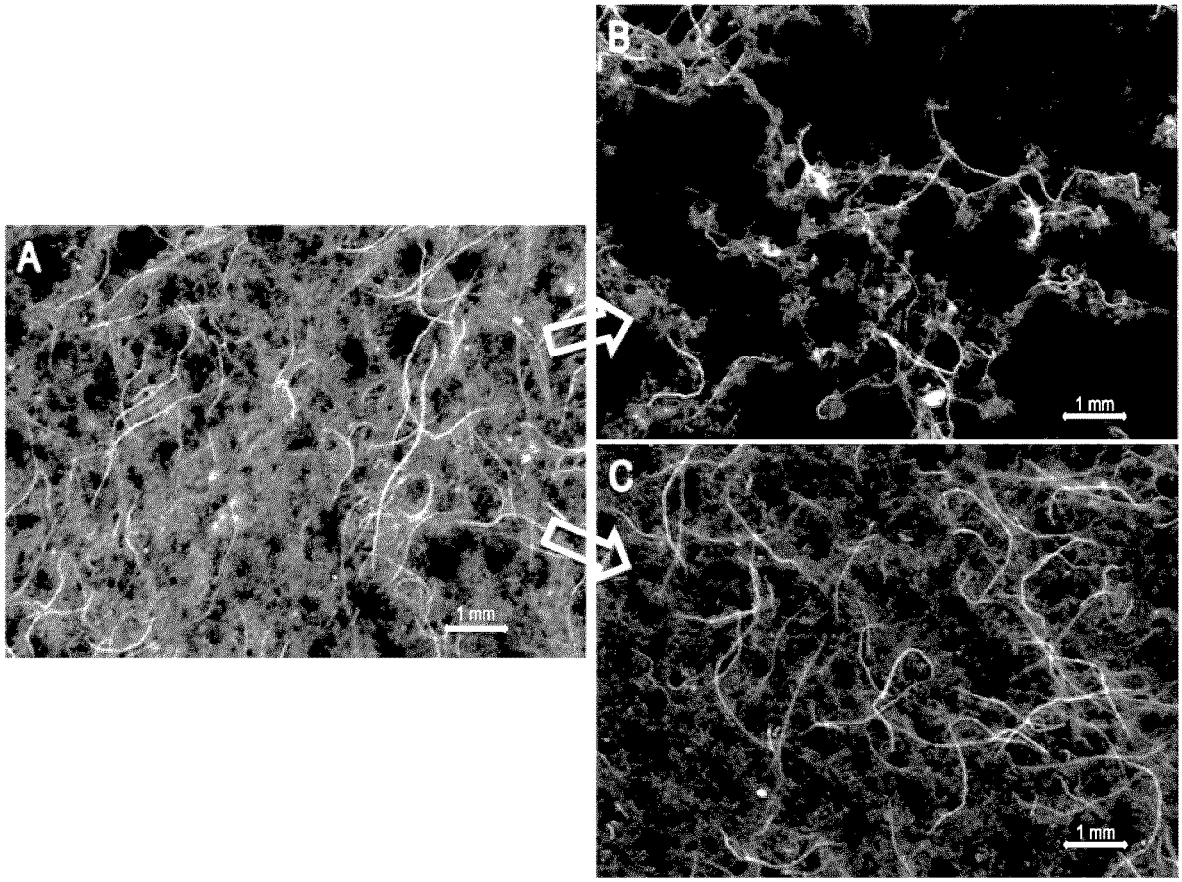
FIG. 22 illustrates optical micrographs images of high energy refined pulp HCR1 (8,221 kWh/t)—no pre-dispersing on refiner A (P0), P0 air dried B, and P0 treated with 20% propylene carbonate then air dried C.

An important element of the method described herein, resides in the fact that the moist clumpy highly refined pulps are pre-dispersed in the disc refiner in a way that the individual fibers and their fibrils are not allowed to collapse or stick on each other's during water evaporation and cellulose hornification is substantially prevented. This is demonstrated in FIG. 22 with the highly fibrillated fibrous HCR1 (8,221 kWh/t)—no pre-dispersing on refiner A (P0), P0 air dried B, and P0 treated with 20% propylene carbonate then air dried C. All samples were first mixed with deionized water to 1.2% consistency then disintegrated in British Standard Disintegrator [TAPPI T-205 & T-218] for 10 minutes. The Microscopy images clearly show that after air drying moist P0 sample (image B) the fibrous elements tend to stick on each other's. However, when the same moist P0 sample was treated with 20% propylene carbonate PC (C) no self-sticking of fibrous elements is observed and the product clearly resemble the initial sample P0 (A) before any drying. Similar results were also obtained with polyhydroxy compounds, namely glycerin, ethylene glycol. This means that additional energy might not be required to efficiently disintegrate the semi-dry pre-dispersed fibrous. Treatment of highly fibrillated fibrous with chemical aids are useful for preventing fibrous hornification and self-sticking to each other's during the pre-dispersing and water evaporation in refiner, and further drying to high solids.

Example 15

Figure 23:
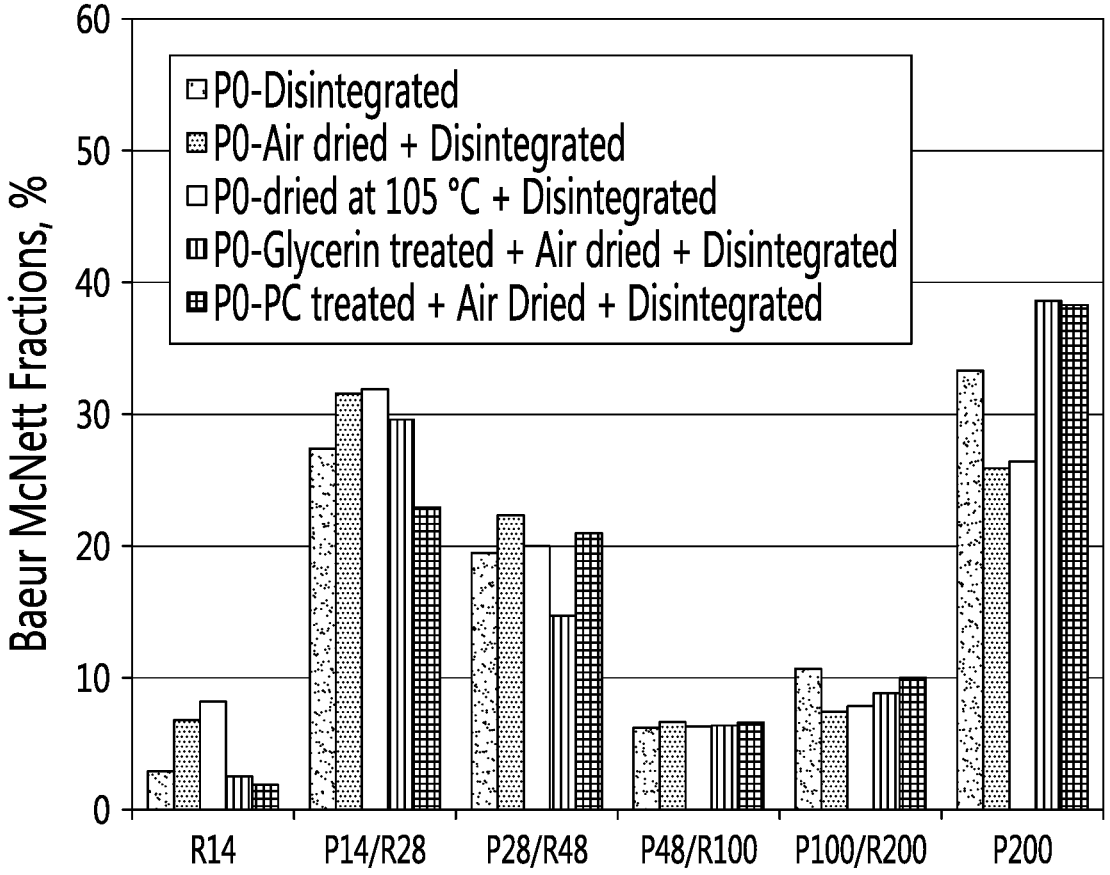
FIG. 23 illustrates a bar chart of Baeur-McNett fractions of high energy refined pulp HCR1 of example 7-P0 moist, P0-air dried, P0-oven dried, P0-treated with 20% propylene carbonate (PC) and with 20% glycerin then air dried.

The effect of drying of high energy refined pulp HCR1 (8,221 kWh/t), treated with a chemical aid, on the size distribution of fibrous was investigated and the results are show in FIG. 23. The samples include: P0 moist, P0-lab pre-dispersed and air dried, P0-lab pre-dispersed and oven dried, P0-treated with 20% propylene carbonate and with 20% glycerin then lab pre-dispersed and air dried. All samples were mixed with deionized water to 1.2% consistency then disintegrated in British Standard Disintegrator [TAPPI T-205 & T-218] for 30,000 revolutions. The Baeur-McNett results clearly show that after air dries or oven dries P0 the fines fraction P200 decreased and the fractions (P14 and R14/P24), which normally corresponding to the longer fibers, increased. However, when the same moist P0 sample was first treated with 20% propylene carbonate (PC) or with 20% glycerin the fibrous fractions were somewhat similar to the control never-dried P0 sample. In addition, it seemed that the chemical treatment helped the release of finer fibril elements, which were present in the control moist P0 sample as seen in images of FIG. 23.

Example 16

The strength properties of sheets made from disintegrated pulp samples of example 14 are shown in Table 7. Clearly these results demonstrate that on drying moist sample P0 in air or oven both showed drastic drop in tensile strength properties, and the bulk and light scattering coefficient both increased substantially. However, when the P0 sample was first treated with propylene carbonate (PC) or glycerin as well as other polyhydroxy compounds (results not shown here) the change in the properties due to drying was substantially reduced as seen from WRV, tensile strength properties, bulk and light scattering coefficient which were all only slightly different from those of the never-dried control P0 sample. For example, drying samples without any chemical treatment the loss in the tensile strength was about 70%, but after the chemical-pretreatment it was only 20%. This 20% loss in strength can easily be regained with some small additional shearing during repulping. Excellent results were also obtained when pulp was pre-treated with many other chemicals aids already described earlier as well as their mixtures or their mixtures with starch, carboxymethyl cellulose, anionic latex, and anionic polyacrylamide, to site few. We also found that by tailoring the treatment chemistry of the moist pulp fiber it became possible to pre-disperse it to semi-dry fibrous then drying it without impairing its strengthening potential for papermaking or other non-paper applications. The material with high bulk and high light scattering coefficient values could find use in paper for improving bulk and opacity, or to make tissue products or filtration and absorbent mats.

TABLE 7

WRV and physical properties of sheets made from the disintegrated samples of example 15.

| Sample | WRV, g/g | Breaking length, km | $TEA^{index}$, mJ/g | Bulk, $cm^3/g$ | Light. Scatt. Coef., $m^2/kg$ |
|---|---|---|---|---|---|
| P0 - control | 2.613 | 10.82 | 6655 | 1.546 | 6.9 |
| P0 - Air dried at 25° C. | 1.835 | 3.40 | 792 | 3.217 | 11.6 |
| P0 - Oven dried 105° C. | 1.775 | 3.20 | 835 | 4.199 | 18.6 |
| P0 - 20% glycerin, , Air dried at 25° C. | 2.257 | 8.55 | 5483 | 1.718 | 6.8 |
| P0 - 20% PC, Air dried at 25° C. | 2.320 | 8.41 | 5207 | 1.565 | 8.3 |

Example 17

Figure 24:
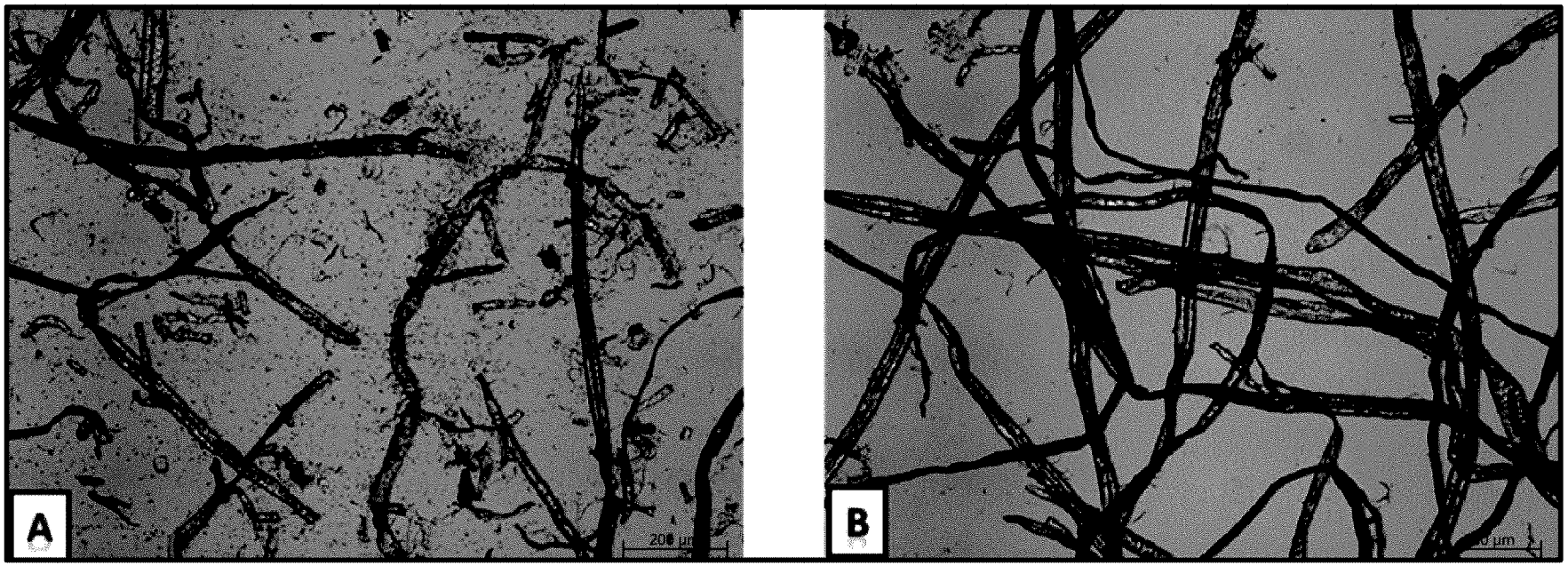
FIG. 24 illustrates optical micrographs images where sample A is untreated and sample B treated with 1% Quilon C according to the method of described herein.

A bleached softwood kraft pulp (BSWK) of CSF 625 mL and 30% solids content was blended in mixing unit, in absence (sample A) and presence (sample B) of Quilon C, a chromium complex solution. Quilon is a cationic hydrophobic agent of dark green color was diluted then blended with pulp. Both pulp samples were pre-dispersed, air dried to about 90% then further heated in an air forced oven at 105° C. for 10 min. The treated sample B was hydrophobic and disperses to separated fibers by mechanical action. Both dried samples were also soaked in water then disintegrated in the British standard disintegrator. The pulp slurries were used for microscope analysis and make handsheets. FIG. 24 presents optical microscopy images of the two samples. Image A of untreated sample shows dispersed fibers and small particles namely fines, whereas image B shows well dispersed fibers but practically free of particles. Further analysis revealed that because of its cationic nature Quilon C promoted the attachment of the small particles or fines onto fiber surfaces. Sheets made from sample B were much weaker than those of sample A. Similar trend results were obtained with cationic surfactants described earlier, such as Arquad 2HT-75. Such treated fibers can be useful for absorbent mats used in diapers or in composites materials.

Example 18

Figure 25:
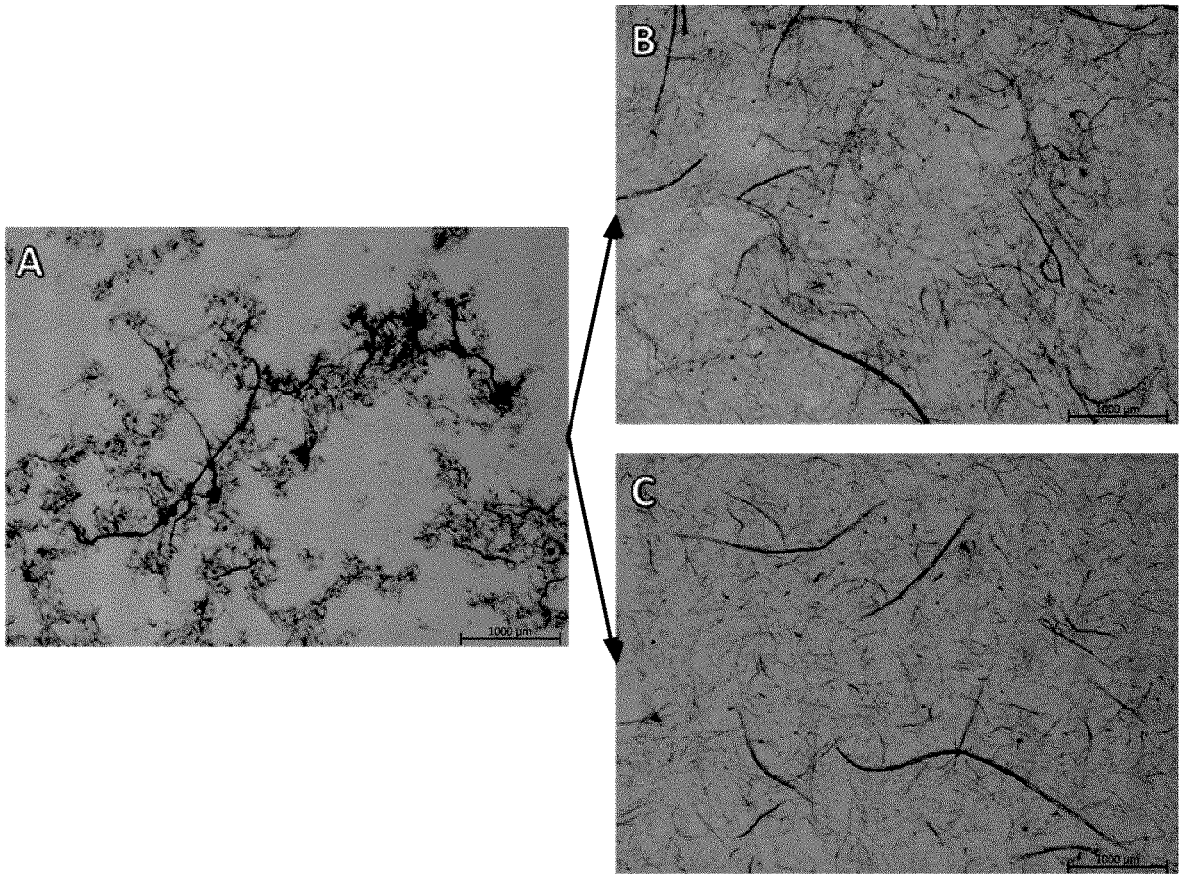
FIG. 25 illustrates optical micrographs that show that the treatment of high consistency, high energy refined BSWK pulp with selected chemicals according to the method described herein substantially improves dispersion of entangle pulp into individualized fibers and fibrils.

The experiment of example 17 was repeated on softwood bleached chemi-thermomechanical pulp (BCTMP) collected from a twin roll press has a solids content of 50%. This pulp was pre-dispersed one pass in the atmospheric disc refiner without and with addition of 10% Quilon C, a chromium complex solution. Quilon was diluted then metered to the pulp in refiner. For both samples the energy used for the one pass fluffing was 100 kWh/t. Mixing Quilon C with pulp fibrous was very uniform as the colour of the treated pulp homogeneously turned to light green. Both pre-dispersed samples were dried 10 min in an air forced oven set at 105° C. The fibrous of both pulps were completely separated and with no knots. The Quilon treated pulp sample was hydrophobic, but dispersed in water with agitation. The pulps were each diluted to 1.2% C in 50 C water then disintegrated in a Standard British disintegrator for 10 mins (30,000 revs) and used to make handsheets. Quilon increased freeness of pulp and reduced its water filtrate turbidity and the produced handsheets were hydrophobic with a contact angle of 122° and has high bulk and low strength (FIG. 25). The dry fibers treated with Quilon C were found compatible and dispersible in thermoplastic polymers, such as polypropylene and polyethylene.

TABLE 8

Effect of pulp treatment with 10% Quilon C on its fibers and sheets properties

| Sample | CSF, mL | WRV, g/g | Turbidity' NTU | B.L., km | TEAindex, mJ/g | Bulk, Cm3/g | PPS Porosity, mL/min |
|---|---|---|---|---|---|---|---|
| BCTMP | 461 | 1.331 | 122 | 1.278 | 162.1 | 3.893 | 2547 |
| BCTMP—10% Quilon | 618 | 0.716 | 47 | 0.897 | 39.7 | 4.683 | 2880 |

Example 19

An element of the present method is to achieve good water dispersion of high consistency, high energy refined BSWK fibers. In this example the refiner's output clumpy highly refined pulp (13,541 kWh/t) was mixed with different anionic polymers, resins or surfactants, namely carboxymethyl cellulose, latex, surfactant, ethyl acrylic acid (EAA), starch, alginate, then disintegrated in water. The results of FIG. 25 show microscopy images of control sample (A) and samples treated with anionic latex (Acronal™ 504s from BASF) (B) and with carboxymethyl cellulose (C) all disintegrated under same conditions. The treated samples (B) and (C) produced very highly dispersed fibrous with no entanglements remained whereas the untreated sample its fibrous are still aggregated and contains entanglement. This means that additional mixing energy is not required to efficiently disintegrate the treated semi-dry pre-dispersed fibrous. The well-water dispersed treated fibrous produced uniform sheets with much higher strength properties.

Example 20

Dispersion is an important issue for dried or semi dried pulps. This was highlighted previously by microscopy images. In order to access this aspect for pulp produced according to the method described herein, we consider knot test from MTS & Fempro. This method consists of air forced screening of 3 grams of pulp during only 2 minutes time into three streams, rejects, accepts and fines. The reject is portion of the pulp retained by mesh #16 (1.18 mm opening). Rejects are considered knots that need to be re dispersed further. The pulp that goes through the mesh #16 screen is a combined of accepts and fines. A screen mesh #30 (0.60 mm opening) is used to separate accept from fines.

In the following example we investigated three pulp samples:

Sample 1: High consistency, high energy semi-dry pulp, which was not further processed by our novel method.

Sample 2: High consistency, high energy semi-dry pulp, which was processed by our novel method in the presence of chemical aid mix, 20% propylene carbonate (PC).

Portions of the above samples were analysed as semi-dry and other portions were analyzed after their drying in a hot air forced oven set at 100° C. for 4 hours. The new samples are:

Sample 3: Sample 1 fully dried pulp

Sample 4: Sample 2 fully dried pulp

The results of the knot test are given in Table 9. It can be seen that the pulp treated with PC has a far of superior quality in term of knots count whether semi dried or dried. More importantly the fully dried pulp without any treatment has the highest number of knots count. In fact those knots would need high sheer force to disintegrate them in water, but would not be possible to separate them in dry form without irreversible damage. However, the treated pulp produced according to the present method when dried in the oven (extreme conditions) has fewer knots. Those knots, if we had expending the time span of the test would be possible to reduce their number significantly. The knots of treated samples are dispersible in water using conventional pulping techniques.

TABLE 9

Fibrous knots test for semi-dry and dried pulp samples processed without and with PC.

| Samples | Semi-dry samples % | Dry Sample 1% |
|---|---|---|
| Sample 1 | | |
| Rejects, % | 49.11 | 58.22 |
| Accept, % | 9.44 | 6.78 |
| Fines, % | 41.44 | 1.67 |
| Sample 2 | | |
| Rejects, % | 2.89 | 14.44 |
| Accept, % | 45.56 | 39.00 |
| Fines, % | 51.56 | 13.22 |

The present method provides a means to achieve in a simultaneous manner blending and opening of one or multiple pulp fibrous, pre-dispersing and fibrillating and treating them with chemicals while also evaporating water. It is based on using conventional thermomechanical refiners as efficient mixers of chemicals with pulp fibrous and pre-dispersing and fibrillating them and as thermokinetic dryers. The method can be used to process any forms of high consistency lignocellulose fibers and their fibrillated fibers made by high consistency, high energy disc refiners, and other synthetic fibers and blends of different fibers. The method can be integrated with high consistency, high energy refining operations using multiple refiners, in way that a small level of the total energy is dedicated for fibrous opening, pre-dispersing, fibrillating and chemical treatment according to the method described herein. In the refiner or prior to refiner stage, fibrous treatment with specific chemicals or additives can be done to prevent individual fibers and fibrils from collapsing onto each other's or to make entangled fibrous easily dispersible in the desired compositions. Pre-dispersing high energy moist pulp by the present method prevents pulp ageing on storage or transportation. The method is shown to work with experiment data presented here. The refining step uses specific parameters to allow the simultaneous blending, opening, pre-dispersing of fibrous, fibrillating and mixing them with chemicals and water evaporation while applying minimal energy under conditions as specified in the next paragraph.

In a normal thermomechanical pulp refining process, water dilution is used to minimize de-hydration and the energy applied is aimed to de-fiber wood chips of lingocellulose fiber bundles to separate them into individual fibers with good quality. As explained earlier, in normal high consistency pulp refining, the energy is applied on fibers by closing the refiner plate gap. In our case, the parameters of the pre-dispersing refiner are such that no water is added or simply dilution it is replaced by chemicals introduced into the refiner while the high consistency fibrous material are being pre-dispersed at low energy levels as the refiner plate gap is wide open. The output (blow line) consistency of the moist pulp fiber and its volumetric density are increased, and the resulted fibrous material is in pre-dispersed form of increased volume. Under these conditions the refiner rapidly evaporates water from the fibrous materials while the chemical aids remain with fibrous. These were possible to achieve despite the residence time of the fibrous material inside the refiner, which is only a few seconds. The mechanism is thus quick and very efficient. The chemicals will blend, impregnate fix or react with fibrous material in refiner. During application of the pre-dispersed materials the chemical aids will dissolve in contact with water for water-based applications or remain attached with fibrous material making them compatible with the ingredients of many compositions water-based and hydrophobic compositions.

The pre-dispersed semi-dry fibrous can be further processed, by batch or inline, using air agitation at velocities sufficient to more separate fibers and loosen entanglements and subsequently forming into compressed bales or air laying into compressed nonwoven webs or diced web pellets of desirable dryness levels using gentle drying technique. Depending on the chemical treatment and/or functional additives used the fibrous of the bales, webs or web pellets are dispersible either into dry particulates, in water and aqueous compositions or in hydrophobic compositions, such as thermoset resins and thermoplastic polymers.

The invention claimed is:

1. A method of transforming a pulp to a pre-dispersed pulp fibrous material comprising:

providing the pulp at a high consistency of 20 to 97 wt % solids content, the pulp comprising thermomechanical pulp and/or chemi-thermo mechanical pulp;

providing a treatment chemical; and dispersing the pulp and the treatment chemical in a multi-stage refiner system comprising at least one disc refiner, at a specific energy of 50 to 400 kWh/t per pass, wherein the at least one disc refiner has a disc refiner plate clearance defining a gap of 0.5 to 3.5 mm, wherein the pre-dispersed pulp fibrous material have a product consistency of 30 to 99 wt % solids content, and wherein the at least one disc refiner is operated under atmospheric pressure.

2. The method of claim 1, wherein the pre-dispersed pulp fibrous material is 70 to 100% individualized fibrous, and comprise a fiber surface fibrillation.

3. The method of claim 1, wherein during said dispersing the pulp in refiner consistency increases due to the specific energy evaporating water with at least some of water replaced by the treatment chemical.

4. The method of claim 1, wherein a total specific energy after the multi stage refiner system is a sum of all the specific energies per pass in the refiner system applied to the pulp and is 50 to 2000 kWh/t.

5. The method of claim 1, wherein the specific energy is 50 to less than 100 kWh/t per pass and the gap is greater than 2.5 mm to 3.5 mm; the specific energy is 100 to less than 200 kWh/t per pass and the gap is greater than 2.0 mm to 2.5 mm; or the specific energy is 200 to 400 kWh/t per pass and the gap is 1.5 mm to 2.0 mm.

6. The method of claim 1, wherein the pulp comprises fibers with a length of 0.1 to 10 mm, a diameter of 0.02 to 40 micron and an equivalent average aspect ratio of 5 to 2000.

7. The method of claim 1, wherein the method is a continuous process, a semi-continuous process, or a batch process.

8. The method of claim 1, wherein the treatment chemicals are introduced alone or mixed with water to pulp fibres and fibrous material in the refining system.

9. The method of claim 1, wherein the treatment chemicals are selected from the group consisting of plasticizers, lubricants, surfactants, fixatives, alkalis and acids, cellulose reactive functional chemicals, cellulose crosslinking chemicals, hydrophobic agents, hydrophobic substances, organic and inorganic (mineral) particulates, foaming or bulking agents, oil resistance agents, absorbent particulates, dyes, preservatives, bleaching agents, fire retardant agents, natural polymers, synthetic polymers, latexes, thermoset resins, lignin, and combinations thereof.

10. The method of claim 9, wherein the plasticizers are selected from the group consisting of polyhydroxy compounds.

11. The method of claim 9, further comprising mineral oil and a lubricant selected from the group consisting of phthalates, citrates, sebacates, adipates, phosphates and combinations thereof.

12. The method of claim 9, wherein the surfactant is Iso-octyl phenoxy polyethoxy ethanol, sodium dodecyl (ester) sulfate, dimethyl ether of tetradecyl phosphonic, polyethoxylated octyl phenol, glycerol diester (diglyceride), linear alkylbenzenesulfonates, lignin sulfonates, fatty alcohol ethoxylates, and alkylphenol ethoxylates and combinations thereof.

13. The method of claim 9, wherein the treatment chemicals are dipolar aprotic liquids selected from the group consisting of alkylene carbonates, used alone or combined with other chemicals.

14. The method of claim 13, wherein the other chemicals are at least one of triacetin, 1,4-cyclohexanedimethanol, and dimethylol ethylene urea.

15. The method of claim 13, wherein the alkylene carbonates are selected from the group consisting of propylene carbonate, ethylene carbonate, butylene carbonate, glycerol carbonate and combinations thereof.

16. The method of claim 9, wherein the treatment chemicals are water-soluble hydrophilic linear or branched polymers.

17. The method of claim 1, wherein in the multi-stage refiner system comprises three disc refiners and the treatment chemicals are added upstream of each of the three disc refiners.

18. The method of claim 17, wherein the treatment chemicals added upstream of each of the three disc refiners are the same or different treatment chemicals.

19. The method of claim 1, wherein the treatment chemical is at least one of a sizing chemical solution or emulsion, a de-bonding chemical and a softening chemical.

20. A method of transforming a pulp to a pre-dispersed pulp fibrous material comprising:

providing the pulp at a high consistency of 20 to 97 wt % solids content, the pulp comprising thermomechanical pulp and/or chemi-thermo mechanical pulp;

providing a treatment chemical; and dispersing the pulp and the treatment chemical in a multi-stage refiner system comprising three disc refiners, at a specific energy of 50 to 400 kWh/t per pass, and the treatment chemicals are added upstream of each of the three disc refiners, wherein the three disc refiners have a disc refiner plate clearance defining a gap of 0.5 to 3.5 mm, wherein the pre-dispersed pulp fibrous material have a product consistency of 30 to 99 wt % solids content.

* * * * *